US011845282B2

(12) United States Patent
Komatsu

(10) Patent No.: US 11,845,282 B2
(45) Date of Patent: Dec. 19, 2023

(54) LIQUID ACCOMMODATING BODY AND LIQUID EJECTING APPARATUS

(71) Applicant: SEIKO EPSON CORPORATION, Tokyo (JP)

(72) Inventor: Yuta Komatsu, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 19 days.

(21) Appl. No.: 17/650,320

(22) Filed: Feb. 8, 2022

(65) Prior Publication Data

US 2022/0250385 A1 Aug. 11, 2022

(30) Foreign Application Priority Data

Feb. 10, 2021 (JP) ..... 2021-020041

(51) Int. Cl.
*B41J 2/165* (2006.01)
*B41J 2/17* (2006.01)

(52) U.S. Cl.
CPC ..... *B41J 2/165* (2013.01); *B41J 2/16505* (2013.01); *B41J 2/1721* (2013.01)

(58) Field of Classification Search
CPC ..... B41J 2/165; B41J 2/16505; B41J 2/1721; B41J 2002/1728
See application file for complete search history.

(56) References Cited

U.S. PATENT DOCUMENTS 6,264,314 B1 * 7/2001 Mochizuki ..... B41J 2/17513 347/86
2005/0190215 A1 9/2005 Morikoshi
2009/0109257 A1 4/2009 Shimazaki
2012/0194604 A1 * 8/2012 Tamaki ..... B41J 2/165 347/22
2018/0203407 A1 * 7/2018 Hirasawa ..... G03G 21/1647
2019/0061353 A1 2/2019 Shimizu et al.

FOREIGN PATENT DOCUMENTS

JP 2004-142282 A 5/2004
JP 2009-101634 A 5/2009
JP 2012-061785 A 3/2012
JP 2019-038159 A 3/2019

* cited by examiner

*Primary Examiner* — Sharon Polk
(74) *Attorney, Agent, or Firm* — WORKMAN NYDEGGER

(57) ABSTRACT

A liquid accommodating body is detachably mounted on a mounting portion having a waste liquid flow-out portion for discharging a waste liquid, and a liquid flow-in portion. The liquid accommodating body includes a waste liquid flow-in portion that is coupled to the waste liquid flow-out portion when the liquid accommodating body is mounted on the mounting portion, and a waste liquid accommodating portion configured to accommodate the waste liquid discharged from the waste liquid flow-out portion. Further, the liquid accommodating body includes a liquid flow-out portion that is coupled to the liquid flow-in portion when the liquid accommodating body is mounted on the mounting portion, and an adjusting water accommodating portion configured to accommodate adjusting water.

12 Claims, 19 Drawing Sheets

LIQUID ACCOMMODATING BODY AND LIQUID EJECTING APPARATUS

The present application is based on, and claims priority from JP Application Serial Number 2021-020041, filed Feb. 10, 2021, the disclosure of which is hereby incorporated by reference herein in its entirety.

BACKGROUND

1. Technical Field

The present disclosure relates to a liquid accommodating body for accommodating a liquid and a liquid ejecting apparatus.

2. Related Art

A liquid ejecting apparatus, which is an example of the liquid ejecting apparatus described in JP-A-2012-61785, includes a recording head (an example of a liquid ejecting portion) having a plurality of nozzles for ejecting a recording liquid to be attached to a target for recording, and a cap facing the nozzles in a state of contacting the recording head to be capable of receiving the recording liquid (waste liquid). The cap has a recording liquid receiving portion capable of receiving the recording liquid ejected from the nozzles and a moisturizing liquid receiving portion capable of receiving a moisturizing liquid. The liquid ejecting apparatus includes a waste liquid tank (liquid accommodating body) for storing the waste liquid sucked from the cap by a pump, and a moisturizing cartridge for supplying the moisturizing liquid to the moisturizing liquid receiving portion by the pump. The recording liquid ejected from the nozzle to the cap is stored in the waste liquid tank as a waste liquid.

Even if the moisturizing liquid decreases due to evaporation or the like when the cap is kept in contact with the recording head for a long period of time, the moisturizing liquid is supplied from the moisturizing cartridge, and thus the recording head can be moisturized for a long period of time.

However, in the liquid ejecting apparatus described in JP-A-2012-61785, it is necessary to newly provide a liquid accommodating portion such as the moisturizing cartridge for moisturizing the nozzle. Since the number of cartridges to be replaced increases in addition to the ink cartridges, there is a problem that a user has to spend more time and effort to replace an accommodating body such as the cartridge, and the usability of the liquid ejecting apparatus deteriorates.

SUMMARY

According to an aspect of the present disclosure, there is provided a liquid accommodating body that is detachably mounted on a mounting portion having a discharge portion for discharging a waste liquid and a liquid flow-in portion, the liquid accommodating body including a waste liquid flow-in portion that is coupled to the discharge portion when the liquid accommodating body is mounted on the mounting portion, a waste liquid accommodating portion configured to accommodate the waste liquid discharged from the discharge portion, and a liquid flow-out portion that is coupled to the liquid flow-in portion when the liquid accommodating body is mounted on the mounting portion, and a liquid accommodating portion configured to accommodate a liquid flowing out to the liquid flow-in portion, in which the liquid is a liquid containing water for humidifying a humidified portion.

According to another aspect of the present disclosure, there is provided a liquid ejecting apparatus including a liquid ejecting portion that ejects, from a nozzle, a liquid supplied from a liquid supply source, a cap configured, as a humidified portion, to contact the liquid ejecting portion to form a closed space where the nozzle is open, a mounting portion on which the liquid accommodating body is detachably mounted, a supply flow path through which the liquid flow-in portion and the cap communicate with each other, and a first liquid feeding portion that feeds the liquid in the liquid accommodating body to the cap.

DESCRIPTION OF EXEMPLARY EMBODIMENTS

Figure 1:
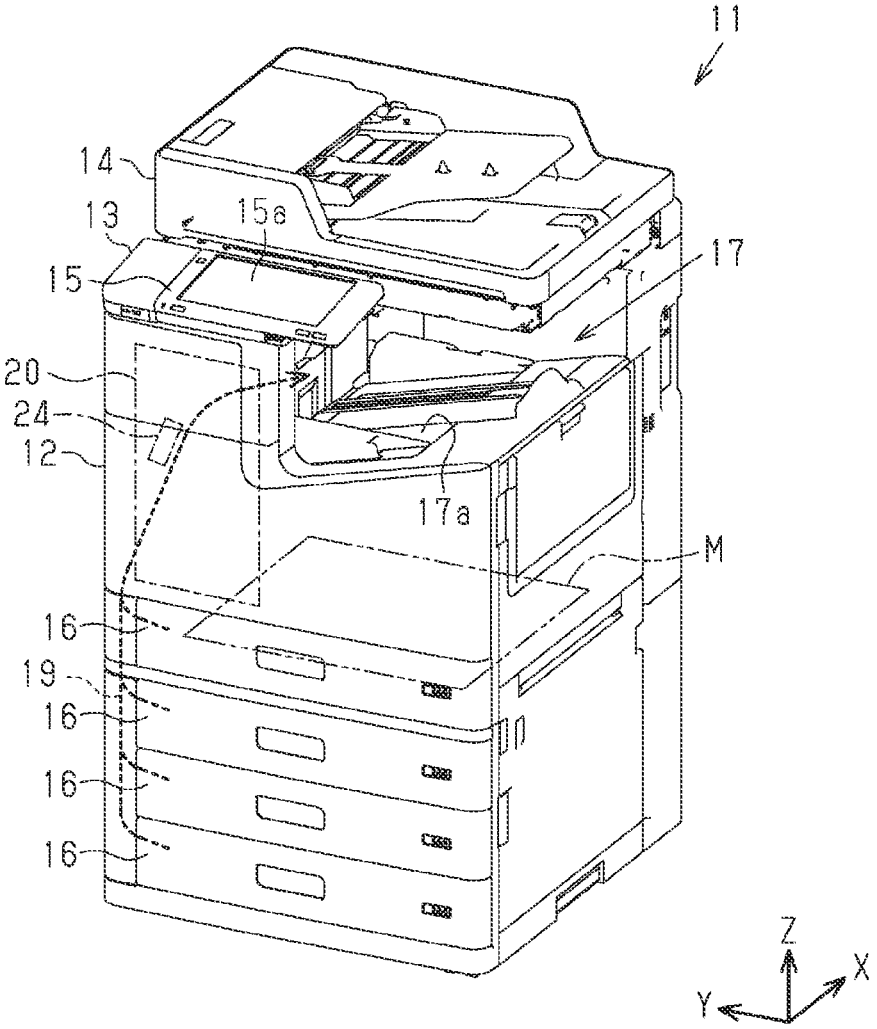
FIG. 1 is a perspective view showing a liquid ejecting apparatus according to an embodiment.

Hereinafter, an embodiment of a liquid ejecting apparatus, a capping device used in the liquid ejecting apparatus, and a maintenance method for the capping device used in the liquid ejecting apparatus will be described with reference to the drawings. The liquid ejecting apparatus is an ink jet printer which ejects ink, which is an example of a liquid, to perform recording (printing) on a medium such as a paper sheet.

In the drawings, it is assumed that the liquid ejecting apparatus 11 is placed on a planar surface, and a width direction and a depth direction are substantially horizontal. The vertical direction is indicated by a Z axis, and the directions along the plane intersecting the Z axis are indicated by an X axis and an Y axis. The X axis, the Y axis, and the Z axis are preferably orthogonal to one another. In the following description, the X-axis direction is also referred to as the width direction X, the Y-axis direction is also referred to as the depth direction Y, and the Z-axis direction is also referred to as the vertical direction Z.

About Configuration of Liquid Ejecting Apparatus

As shown in FIG. 1, the liquid ejecting apparatus 11 includes a main body 12 having a rectangular parallelepiped shape, an image reading portion 13 attached to the upper portion thereof, and an automatic feeding portion 14. The liquid ejecting apparatus 11 has a configuration in which the main body 12, the image reading portion 13, and the automatic feeding portion 14 are stacked in this order from the bottom in the vertical direction Z.

The image reading portion 13 is configured to be able to read images such as characters and photographs recorded on the original document. The automatic feeding portion 14 is configured to be able to feed the original document to the image reading portion 13. Further, the image reading portion 13 has an operation portion 15 operated when an instruction is given to the liquid ejecting apparatus 11. The operation portion 15 includes, for example, a display 15*a* including a touch panel type screen, buttons for operation, and the like.

The main body 12 has a plurality of medium accommodating portions 16 capable of accommodating a medium such as a paper sheet. The main body 12 in the present embodiment has a total of four medium accommodating portions 16. The medium accommodating portion 16 is configured to be retractable with respect to the main body 12. Further, the main body 12 has a recording portion 20 for making recording on the medium M in the main body 12. The recording portion 20 includes a head unit 24 having a liquid ejecting head 21 capable of ejecting a liquid. Further, the main body 12 has a placement portion 17 on which the medium M on which recording has been made is placed. The placement portion 17 has a placement surface 17*a* on which the medium M is placed. The number of medium accommodating portions 16 may be only one.

The medium M accommodated in the medium accommodating portion 16 is transported along a transport path 19 from the medium accommodating portion 16 to the placement portion 17 through the recording portion 20. As a feeding roller (not shown) comes into contact with the uppermost medium among the plurality of media M accommodated in the medium accommodating portion 16 and rotates, the uppermost medium M is sent from the medium accommodating portion 16 to the recording portion 20 positioned above the medium accommodating portion 16. When the medium M passes through the recording portion 20, the liquid ejecting head 21 makes recording by ejecting a liquid toward the medium M and attaching the ejected liquid to the medium M. The medium M after recording is discharged toward the placement portion 17 by a discharge roller pair (not shown).

Figure 2:
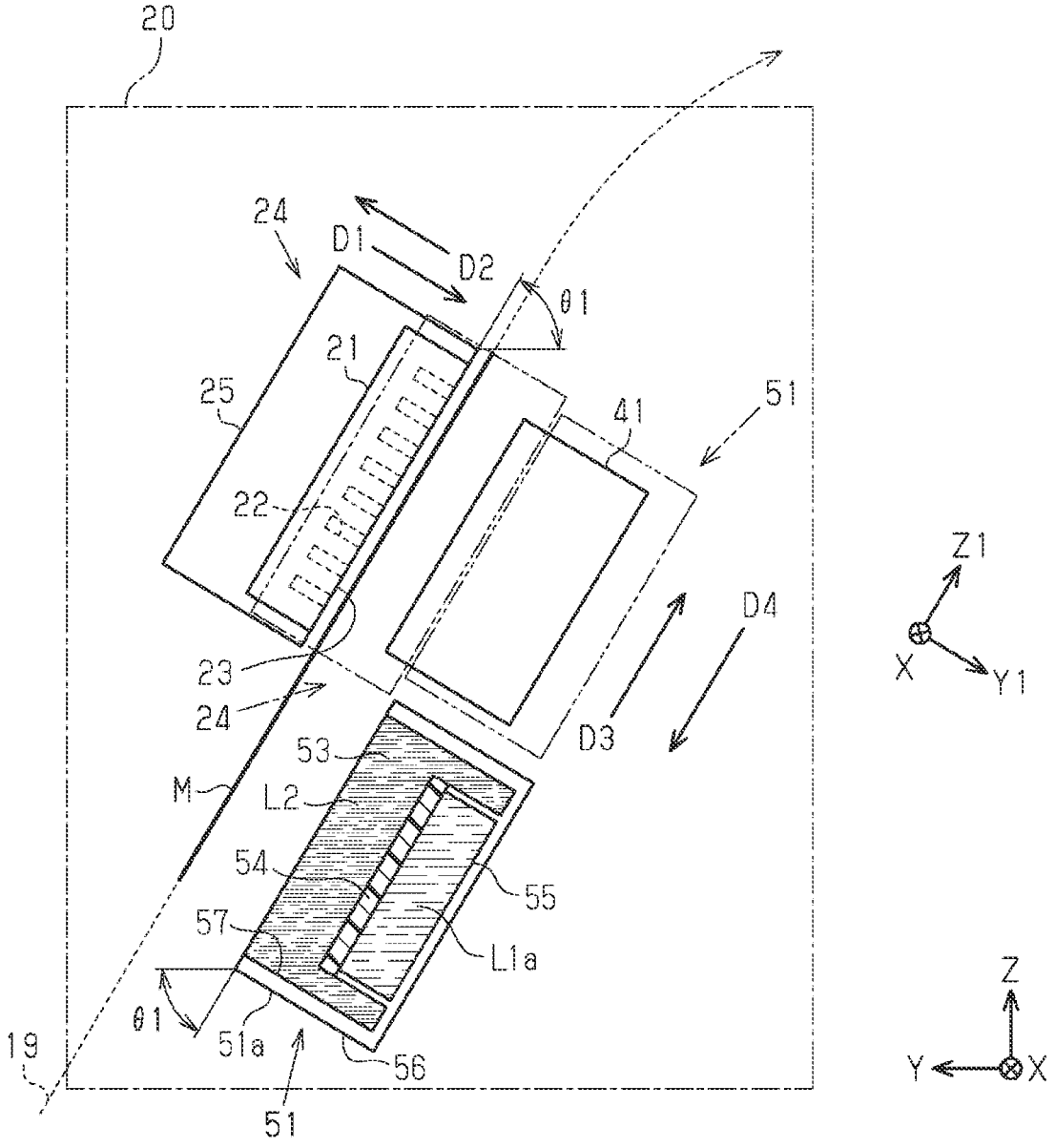
FIG. 2 is a schematic view showing the arrangement of components around a liquid ejecting head.

As shown in FIG. 2, around the liquid ejecting head 21 included in the recording portion 20, a cap unit 51 included in a capping device to be described later and a wiper carriage 41 are disposed on the side opposite the head unit 24 with respect to the transport path 19. The head unit 24 includes the liquid ejecting head 21 and a support portion 25 for holding the liquid ejecting head 21.

The liquid ejecting head 21 is configured to eject liquid to the medium M from a plurality of nozzles 22 constituting a plurality of nozzle groups in a state extending in the width direction X. The direction in which the liquid is ejected when the liquid ejecting head 21 ejects the liquid to the medium M is referred to as an ejecting direction Y1. Further, the direction in which the medium M is transported when the liquid ejecting head 21 ejects the liquid to the medium M is referred to as a first transport direction Z1.

In the present embodiment, the nozzle surface 23 on which the nozzles 22 are arranged is not horizontal and has the first predetermined angle θ1 with respect to the horizontal. That is, in the present embodiment, the liquid ejecting head 21 is disposed in a state where the nozzle surface 23 has a first predetermined angle θ1 with respect to the horizontal, and the liquid ejecting head 21 ejects the liquid to the medium M in that state. The nozzle surface 23 on which the nozzles 22 are arranged may be disposed horizontally. That is, the liquid ejecting head 21 may be disposed in a state where the nozzle surface 23 is horizontal.

The liquid ejecting head 21 of the present embodiment is a line head having a number of nozzles 22 capable of simultaneously ejecting the liquid over the entire width of the medium M in the width direction X intersecting the first transport direction Z1 and the ejecting direction Y1. The liquid ejecting apparatus 11 performs line printing by ejecting the liquid from the plurality of nozzles 22, which are located at positions facing the entire width of the medium M which is transported at a constant speed, toward the medium M.

In the liquid ejecting apparatus 11, maintenance operations such as capping, cleaning, flushing, and wiping are performed in order to prevent or eliminate ejection failure caused by clogging of the nozzles 22 of the liquid ejecting head 21, adhesion of foreign matter, or the like.

Capping refers to an operation in which the cap unit 51 contacts the nozzle surface 23 of the liquid ejecting head 21 to surround the nozzles 22 when the liquid ejecting head 21 does not eject the liquid. Since the thickening of the liquid in the nozzles 22 is suppressed by the capping, the occurrence of ejection failure can be prevented.

Cleaning refers to an operation of forcibly discharging the liquid from the nozzles 22 by applying pressure upstream of the liquid ejecting head 21, or forcibly discharging the liquid from the nozzles 22 by applying a suction force to the nozzles 22 of the liquid ejecting head 21.

Flushing refers to an ejection operation for discharging droplets unrelated to printing from the nozzles 22. Flushing is also called empty ejection. By flushing, a thickened ink, air bubbles, or foreign matter that causes ejection failure is discharged from the nozzles 22, and thus clogging of the nozzles 22 can be prevented. In the liquid discharged from the liquid ejecting head 21, the liquid that is not used for printing is called waste liquid. The liquid discharged by flushing is waste liquid since it is not used for printing. The waste liquid discharged by flushing is received by the cap unit 51. That is, flushing is performed by the liquid ejecting head 21 ejecting droplets from the nozzles 22 toward the inside of the cap unit 51.

Wiping refers to an operation of wiping the nozzle surface 23 with a rubber wiper, a cloth wiper, or the like. By wiping, dirt such as liquid, dust, or the like adhering to the nozzle surface 23 of the liquid ejecting head 21 is removed. The liquid wiped off by wiping is also a waste liquid since it is not used for printing.

The position of the head unit 24 when the liquid ejecting head 21 ejects the liquid to the medium M, that is, when the liquid ejecting head 21 makes recording on the medium M is referred to as a recording position. Further, the position of the cap unit 51 when the liquid ejecting head 21 ejects the liquid to the medium M is referred to as a retreat position. Further, the position of the head unit 24 when the liquid ejecting apparatus 11 performs the maintenance operation is referred to as a maintenance position. The position of the cap unit 51 when the liquid ejecting apparatus 11 performs the maintenance operation is also referred to as the maintenance position.

As shown in FIG. 2, the head unit 24 is moved between the recording position indicated by a solid line in FIG. 2 and the maintenance position indicated by a two-dot chain line in FIG. 2, by a head moving mechanism (not shown). The direction in which the head unit 24 moves from the recording position to the maintenance position is referred to as a first direction D1. The direction in which the head unit 24 moves from the maintenance position to the recording position is referred to as a second direction D2.

The cap unit 51 is moved between the retreat position indicated by the solid line in FIG. 2 and the maintenance position indicated by the two-dot chain line in FIG. 2, by a cap moving mechanism (not shown). The direction in which the cap unit 51 moves from the recording position to the maintenance position is referred to as a third direction D3. The direction in which the cap unit 51 moves from the maintenance position to the recording position is referred to as a fourth direction D4. The cap unit 51 has a recessed portion 57 that receives, as a waste liquid L2, a liquid such as ink discharged from the nozzles 22 of the liquid ejecting head 21 for maintenance. The recessed portion 57 accommodates an absorber 53 that absorbs the waste liquid L2. Further, the cap unit 51 of the present embodiment has a humidifying chamber 55 that supplies a humidifying fluid L1*a* into the recessed portion 57, and a first moisture permeable membrane 54 that covers one open surface of the humidifying chamber 55. The humidifying fluid L1*a* that has passed through the first moisture permeable membrane 54 from the humidifying chamber 55 moisturizes the nozzle 22 of the liquid ejecting head 21 during capping. The detailed configurations of the first moisture permeable membrane 54 and the humidifying chamber 55, and a supply system for supplying the humidifying fluid L1*a* to the humidifying chamber 55 will be described later.

As shown in FIG. 2, the cap unit 51 moves from the retreat position indicated by the solid line in FIG. 2 in the third direction D3, and is positioned at the maintenance position indicated by the two-dot chain line in FIG. 2, and then the head unit 24 moves from the recording position indicated by the solid line in FIG. 2 in the first direction D1 and is positioned at the maintenance position indicated by the two-dot chain line in FIG. 2. Thereby, the head unit 24 is capped by the cap unit 51. In the present embodiment, in the capping state, flushing is performed by the liquid ejecting head 21 ejecting droplets from the nozzle 22 toward the inside of the cap unit 51. That is, in the liquid ejecting apparatus 11 of the present embodiment, both capping and flushing are performed at the maintenance position. The flushing may be performed in a state where the liquid ejecting head 21 is separated from the cap unit 51.

When the maintenance is completed, the head unit 24 moves from the maintenance position indicated by the two-dot chain line in FIG. 2 in the second direction D2, and is positioned at the recording position indicated by the solid line in FIG. 2. Then, the cap unit 51 moves from the maintenance position indicated by the two-dot chain line in FIG. 2 in the fourth direction D4, and is positioned at the retreat position indicated by the solid line in FIG. 2. At this time, the wiper carriage 41 is positioned at a position that is not overlapped with the head unit 24 and the cap unit 51 in the width direction X. The movement of the wiper carriage 41 will be described later.

About Configuration of Liquid Ejecting Head and Cap Unit

Figure 3:
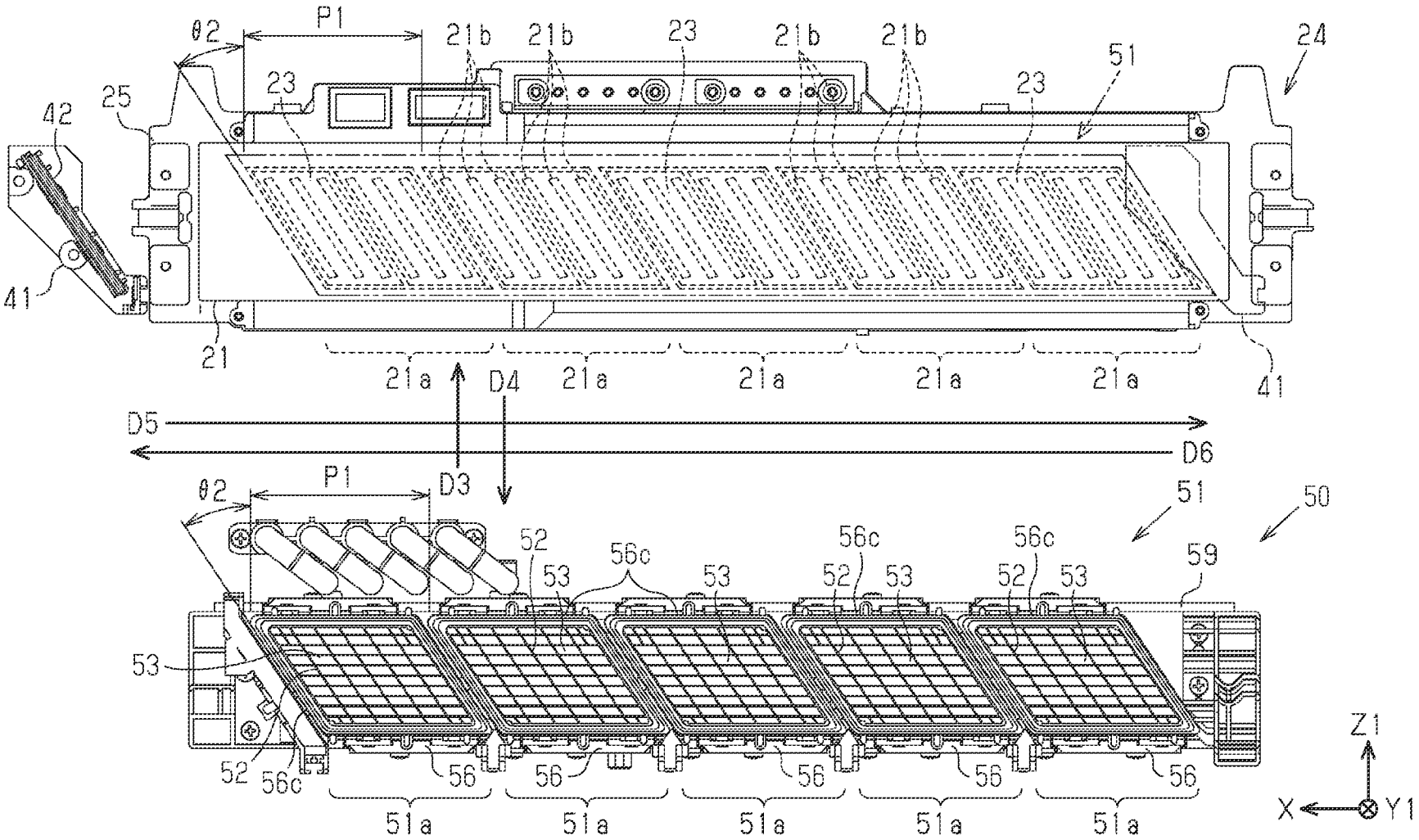
FIG. 3 is a schematic front view of components when viewed in a direction along an ejecting direction in FIG. 2.

As shown in FIG. 3, the liquid ejecting head 21 includes a plurality of unit ejecting heads 21*a*. On the surface of the support portion 25 facing the transport path 19 shown in FIG. 2, a plurality of unit ejecting heads 21*a* are arranged in the width direction X at a first predetermined pitch P1. The unit ejecting head 21*a* includes a plurality of nozzle rows 21*b*. The plurality of unit ejecting heads 21*a* are arranged in a state of being inclined by a second predetermined angle θ2 with respect to the first transport direction Z1 in which the medium M is transported. That is, the nozzle rows 21*b* are also arranged in a state of being inclined by the second predetermined angle θ2 with respect to the first transport direction Z1. In the present embodiment, the liquid ejecting head 21 includes five unit ejecting heads 21*a*, and each unit ejecting head 21*a* includes six nozzle rows 21*b*.

In the present embodiment, the cap unit 51 has a plurality of caps 51*a* and a holding portion 59 for holding the plurality of caps 51*a*. The cap 51*a* is an object to be humidified, and corresponds to an example of a humidified portion. A plurality of unit caps 51*a* are arranged in the width direction X at the first predetermined pitch P1 on the side opposite the head unit 24 with respect to the transport path 19 shown in FIG. 2. The plurality of unit caps 51*a* are arranged in a state of being inclined by a second predetermined angle θ2 with respect to the first transport direction Z1 in which the medium M is transported. That is, the unit cap 51*a* has a substantially parallelogram shape when viewed in the direction along the ejecting direction Y1. In the present embodiment, the cap unit 51 includes five unit caps 51*a*.

For each unit ejecting head 21*a*, one unit cap 51*a* is disposed at the opposite position. Therefore, when the head unit 24 is capped by the cap unit 51, the plurality of unit ejecting heads 21*a* are each covered by a separate unit cap 51*a*. That is, the plurality of nozzles 22 included in the liquid ejecting head 21 are covered for each unit ejecting head 21*a* by the same number of unit caps 51*a* as the unit ejecting heads 21*a*. In the present embodiment, the plurality of nozzles 22 included in the liquid ejecting head 21 including the five unit ejecting heads 21*a* are covered for each unit ejecting head 21*a* by the five unit caps 51*a* included in the cap unit 51. Thereby, at the time of capping, all the nozzles 22 included in the liquid ejecting head 21 are covered by the cap unit 51. The unit cap 51*a* includes a case 56 having an opening opened toward the first transport direction Z1. An annular seal portion 56*c* is fixed to an open end of the case 56. In the case 56, a grid-shaped restriction member 52 is accommodated and, and further, in the back thereof, an absorber 53 is accommodated that is capable of absorbing a waste liquid in a state where the position is restricted by the restriction member 52. Hereinafter, the unit cap 51*a* is also simply referred to as "cap 51*a*".

The head unit 24 shown in FIG. 3 moves from the recording position shown by the solid line in FIG. 2 to the maintenance position shown in FIG. 3 (the position of the two-dot chain line in FIG. 2) by a head moving mechanism (not shown) during non-recording and maintenance. Next, the cap unit 51 shown in FIG. 3 moves from the retreat position shown in FIG. 3 in the third direction D3, and is disposed at the maintenance position shown by the two-dot chain line in FIG. 2 (see also FIG. 4). Thereby, the liquid ejecting head 21 is capped by the cap 51*a*. For example, after the maintenance is completed, the cap unit 51 moves from the maintenance position in the fourth direction D4 to return to the retreat position shown in FIG. 3.

The wiper carriage 41 shown in FIG. 3 is reciprocally moved between the retreat position indicated by the solid line in FIG. 3 and a folding position shown by a two-dot chain line in FIG. 3 by the wiper moving mechanism (not shown). The head unit 24 moves from the recording position shown in FIG. 2 in the first direction D1, and is positioned at the maintenance position indicated by the two-dot chain line in FIG. 2, and then the wiper carriage 41 moves from the retreat position indicated by the solid line in FIG. 3 in the fifth direction D5 and moves to the folding position indicated by the two-dot chain line in FIG. 3. Thereby, the nozzle surface 23 of the head unit 24 is wiped by a wiper member 42 included in the wiper carriage 41.

When the wiping is completed, the head unit 24 moves from the maintenance position indicated by the two-dot chain line in FIG. 2 in the second direction D2, and is positioned at the recording position indicated by the solid line in FIG. 2. Then, the wiper carriage 41 moves from the folding position indicated by the two-dot chain line in FIG. 3 in the sixth direction D6, and is returned to the retreat position shown in FIG. 3.

About Configuration of Cap

Next, the configuration of the cap 51*a* will be described with reference to FIG. 4.

Figure 4:
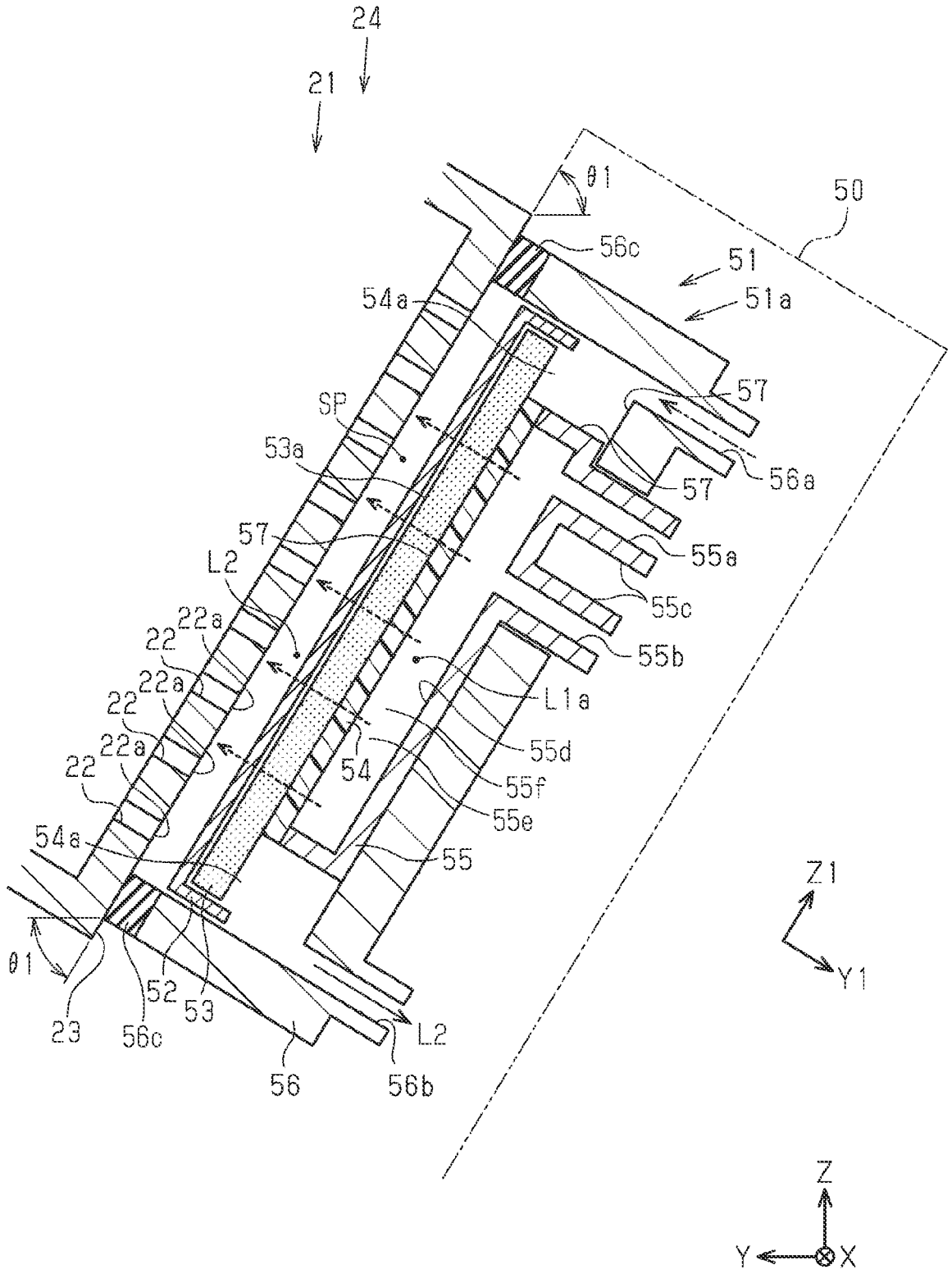
FIG. 4 is a schematic front cross-sectional view of a unit cap.

As shown in FIG. 4, the liquid ejecting apparatus 11 includes a capping device 50. The capping device 50 includes a cap 51*a* capable of contacting the liquid ejecting head 21 to form a closed space SP where the nozzle 22 is open.

Figure 5:
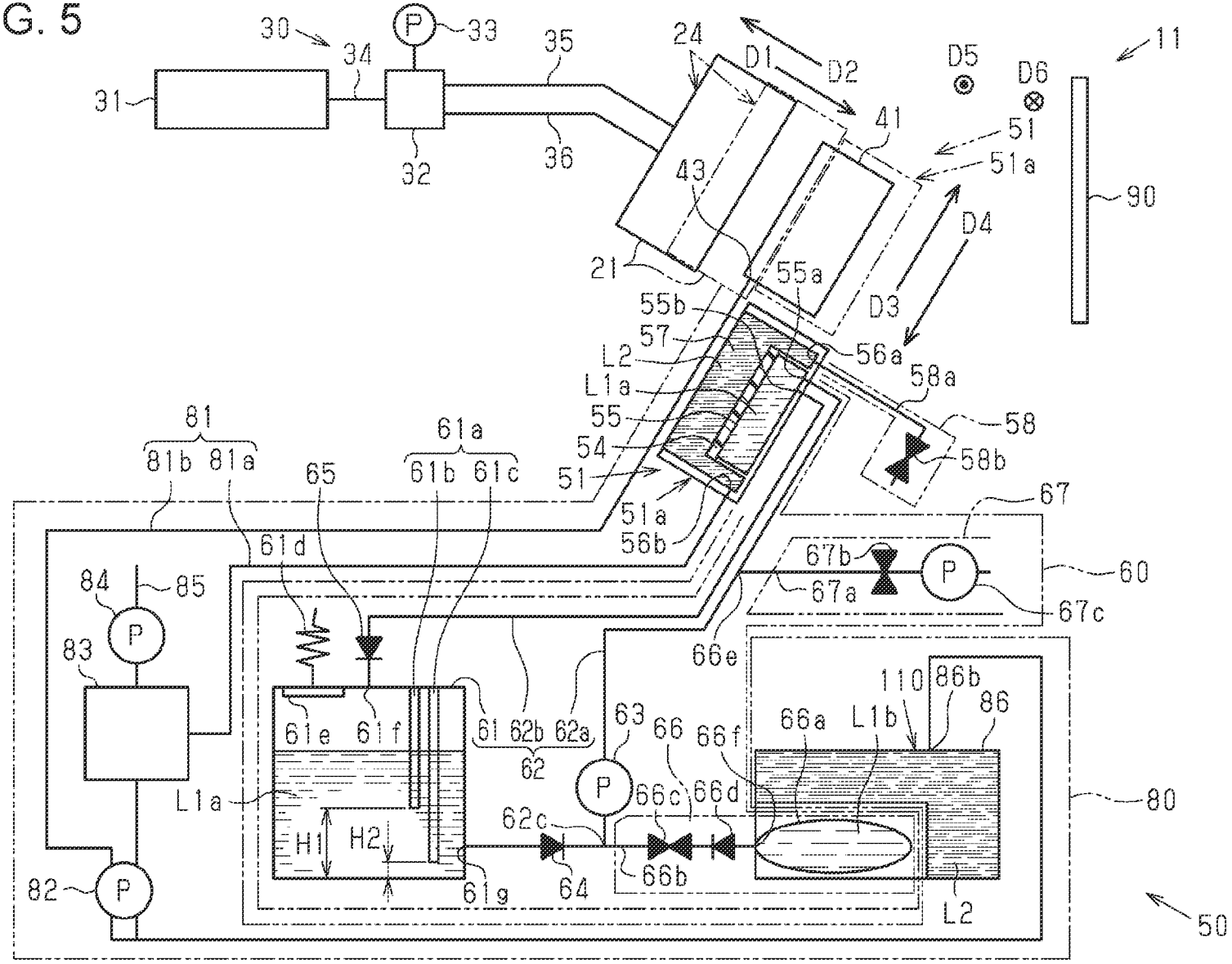
FIG. 5 is a schematic view showing a configuration of a capping device.

As shown in FIG. 4, the cap 51*a* has the restriction member 52, the absorber 53, the first moisture permeable membrane 54, the humidifying chamber 55, and the case 56. The cap 51*a* exhibits a low-height prismatic shape with a bottom surface of a substantially parallelogram. In the present embodiment, the cap 51*a* is used in a state where the bottom surface of the substantially parallelogram is disposed on an XZ1 plane shown in FIG. 2. That is, the cap 51*a* shown in FIG. 5 is used in a state where the bottom surface of the substantially parallelogram is inclined with respect to the horizontal. The XZ1 plane is a plane parallel to the nozzle surface 23 of the liquid ejecting head 21 shown in FIG. 2.

As shown in FIG. 4, the restriction member 52 is a grid-shaped or mesh-shaped member for restricting the position of the absorber 53 on the −Y1 direction side. The material used for the restriction member 52 is, for example, a thin metal plate such as a stainless steel material. Thereby, the cap 51*a* is configured to allow the liquid to pass through the restriction member 52 from the −Y1 direction side to the +Y1 direction side and from the +Y1 direction side to the −Y1 direction side, in the cap 51*a*.

As shown in FIG. 4, the absorber 53 is formed in a shape of a substantially parallelogram thin plate extending in the XZ1 plane. The absorber 53 is configured to be able to absorb the liquid. Therefore, the absorber 53 may be displaced, or swollen, to increase its volume by absorbing the liquid.

The restriction member 52 restricts the absorber 53 at a predetermined position in order to widely expose the surface 53*a* of the absorber 53 and to keep constant the distance between the surface 53*a* and the nozzle surface 23 shown in FIG. 4. That is, the restriction member 52 suppresses the displacement of the absorber 53 in the −Y1 direction when the absorber 53 is swollen.

As shown in FIG. 4, the first moisture permeable membrane 54 is formed in a shape of a substantially parallelogram sheet extending in the XZ1 plane. The first moisture permeable membrane 54 has gas permeability. That is, the first moisture permeable membrane 54 allows the passing-through of gas, but restricts the passing-through of liquid. In the present embodiment, the material used for the first moisture permeable membrane 54 is a material obtained by coating a cloth with a fluororesin. The material used for the first moisture permeable membrane 54 may be any material that does not allow liquid to pass through but allows gas to pass through, and may be a film membrane or an elastomer membrane.

The first moisture permeable membrane 54 forms, on a peripheral edge of the recessed portion 57, a communication portion 54*a* that allows the liquid to pass from the −Y1 direction side to the +Y1 direction and from the +Y1 direction side to the −Y1 direction side, by slightly cutting the center portions of at least three of the four sides of the first moisture permeable membrane 54 inwardly.

As described above, in the present embodiment, the bottom surface of the substantially parallelogram of the cap 51*a* shown in FIG. 4 is provided on the XZ1 plane inclined with respect to the horizontal. Since the force that causes the liquid to flow in the −Z direction in the vertical direction acts by gravity, the liquid is difficult to flow to the side of the substantially parallelogram positioned foremost in the +Z direction. Therefore, the first moisture permeable membrane 54 may also have a configuration in which the communication portion 54*a* is not provided on one side of the first moisture permeable membrane 54 positioned foremost in the +Z direction.

As shown in FIG. 4, the case 56 has an atmosphere communication hole 56*a* at a portion foremost in the +Z direction. Thereby, the space inside the case 56 and the atmosphere can communicate with each other through the atmosphere communication hole 56*a*.

As shown in FIG. 4, the humidifying chamber 55 has two pipe portions 55*c* protruding from surfaces on the +Y1 direction side and the +Z direction side and an inlet 55*a* and an outlet 55*b* open at the respective tips. In the humidifying chamber 55, a rib 55*e* forming a groove 55*d* communicating with the inlet 55*a* and the outlet 55*b* extends along a predetermined path. Inside the humidifying chamber 55, a flow path 55*f* of a predetermined path partitioned by the rib 55*e* and the first moisture permeable membrane 54 is formed.

The case 56 has the atmosphere communication hole 56*a*, a discharge hole 56*b* which is an example of the hole, and the seal portion 56*c*. The atmosphere communication hole 56*a* and the discharge hole 56*b* allow the +Y1 direction side and the −Y1 direction side of the bottom surface of the substantially parallelogram to communicate with each other.

On the surface of surrounding walls forming the case 56 positioned foremost in the −Y1 direction, the seal portion 56*c* is formed in a frame shape along the surrounding wall. The material used for the seal portion 56*c* is, for example, a flexible material such as a rubber material or an elastomer. In order to suppress drip of the liquid in the cap 51*a* from the seal portion 56*c* to the outside of the cap 51*a*, the material of the seal portion 56*c* may be a water-repellent elastomer material that repels the liquid ejected from the liquid ejecting head 21.

The case 56 forms a low-height prismatic outer shape having a bottom surface of a substantially parallelogram of the cap 51*a* to accommodate the restriction member 52, the absorber 53, the first moisture permeable membrane 54, and the humidifying chamber 55.

The humidifying chamber 55 shown in FIG. 4 has the groove 55*d* that winds in a meandering manner so as to cover the entire surface thereof, and is formed in a single-way labyrinthine shape from the inlet 55*a* to the outlet 55*b*. The surface on the side of the opening of the humidifying chamber 55 and the first moisture permeable membrane 54 are sealed over the entire area from the inlet 55*a* to the outlet 55*b*. Therefore, a single-way, winding flow path having a meandering and complicated path is formed by the groove 55*d* and the first moisture permeable membrane 54, and the inlet 55*a* and the outlet 55*b* communicate with each other. That is, the humidifying chamber 55 is formed in a shape of a flow path through which the inlet 55*a* and the outlet 55*b* communicate with each other with a part of the wall surface of a chamber through which the humidifying fluid, which will be described later, flows, covered with the first moisture permeable membrane 54.

As will be described later, since the closed space SP inside the cap 51*a* is humidified by the humidifying fluid flowing through the groove 55*d*, it is desirable that, in the XZ1 plane, the area occupied by the groove 55*d* in the cap 51*a* is large. That is, in order to increase the area occupied by the groove 55*d* with respect to the bottom surface of the cap 51*a*, it is desirable to draw the flow path around the entire bottom surface of the cap 51*a*.

Configuration of Cap Unit

As shown in FIG. 4, the liquid ejecting apparatus 11 includes a capping device 50. The capping device 50 has the movable cap unit 51 shown in FIG. 3. In addition, the cap unit 51 has the cap 51*a*.

When the cap unit 51 moves in the first direction D1 and is positioned at a maintenance position shown in FIG. 4, and then the head unit 24 moves in the third direction D3 and is positioned at a maintenance position shown in FIG. 4, the cap 51*a* included in the capping device 50 comes into contact with the nozzle surface 23 of the liquid ejecting head 21. When the capping device 50 and the liquid ejecting head 21 come into contact with each other, the nozzle surface 23 and the seal portion 56*c* come into close contact with each other, and the nozzle surface 23 is sealed by the seal portion 56*c*. That is, the capping device 50 is configured to be able to form the closed space SP surrounding openings 22*a* of the nozzles 22 when the cap 51*a*, which is an example of the cap, comes into contact with the liquid ejecting head 21 having the nozzles 22 for ejecting the liquid.

The cap 51*a* has the recessed portion 57 that forms the closed space SP. In the present embodiment, as shown in FIG. 4, the recessed portion 57 is constituted by an inner surface of the case 56, an outer surface of the outer periphery of the humidifying chamber 55, and a surface of the first moisture permeable membrane 54 close to the absorber 53. The recessed portion 57 has the absorber 53 capable of absorbing a liquid at a position in contact with the first moisture permeable membrane 54, which is an example of the partition wall. The first moisture permeable membrane 54 having gas permeability partitions the recessed portion 57 and the humidifying chamber 55. Thereby, when the capping device 50 and the liquid ejecting head 21 come into contact with each other, the recessed portion 57 forms the closed space SP surrounding the openings 22*a* of the nozzles 22.

The restriction member 52 and the absorber 53 have liquid permeability. The first moisture permeable membrane 54 has no liquid permeability. Therefore, at the time of flushing, the liquid discharged from the nozzles 22 passes through the restriction member 52 and the absorber 53 from the −Y1 direction side to the +Y1 direction side, but does not pass through the first moisture permeable membrane 54 from the −Y1 direction to the +Y1 direction.

Even if the absorber 53 approaches a state in which it cannot absorb the liquid any more, the liquid does not flow into the humidifying chamber 55 since the first moisture permeable membrane 54 does not have liquid permeability. Then, the liquid passes through the communication portion 54*a* by gravity, and is discharged to the outside of the cap 51*a* through the discharge hole 56*b* of the case 56.

The humidifying chamber 55 has the inlet 55*a* through which the humidifying fluid described later for humidifying the closed space SP flows in, and the outlet 55*b* through which the humidifying fluid flows out. Since the first moisture permeable membrane 54 does not have liquid permeability, the first moisture permeable membrane 54 restricts the passing-through of liquid of the humidifying chamber 55 from the +Y1 direction side to the −Y1 direction side. Thereby, in the humidifying chamber 55, the liquid flowing in through the inlet 55*a* flows out through the outlet 55*b*. The humidifying chamber 55 is provided in an inclined attitude with respect to the horizontal. The inlet 55*a* and the outlet 55*b* are provided above the center of the humidifying chamber 55 in the vertical direction Z. In the present embodiment, the inlet 55*a* and the outlet 55*b* are positioned in the +Z direction with respect to the center of the humidifying chamber 55 in the vertical direction Z. By providing the inlet 55*a* and the outlet 55*b* on the side of the humidifying chamber 55 in the +Z direction, it is possible to suppress the liquid in the humidifying chamber 55 from flowing out of the humidifying chamber 55 by the water head pressure from the inlet 55*a* or the outlet 55*b*.

As shown in FIG. 4, the restriction member 52, the absorber 53, and the first moisture permeable membrane 54 have gas permeability. Therefore, the atmosphere or water vapor, which is a gas, passes through the restriction member 52, the absorber 53, and the first moisture permeable membrane 54 from the −Y1 direction side to the +Y1 direction side and from the +Y1 direction side to the −Y1 direction side. Thereby, the capping device 50 is configured such that the water vapor evaporated from the humidifying fluid described later can flow from the humidifying chamber 55 into the recessed portion 57 in the cap 51*a*.

The recessed portion 57 has the atmosphere communication hole 56*a* for allowing the closed space SP to communicate with the atmosphere. The atmosphere communication hole 56*a* is provided above the center of the cap 51*a* in the vertical direction. In the present embodiment, the atmosphere communication hole 56*a* is provided in the +Z direction with respect to the center of the recessed portion 57 in the vertical direction Z. By providing the atmosphere communication hole 56*a* above the center of the cap 51*a* in the vertical direction, the blockage of the atmosphere communication hole 56*a* by the liquid can be suppressed. Further, the atmosphere communication hole 56*a* may be provided at a position higher than that of the first moisture permeable membrane 54, that is, in the +Z direction with respect to the first moisture permeable membrane 54.

Liquid Supply Mechanism

As shown in FIG. 5, the liquid ejecting apparatus 11 includes a liquid supply mechanism 30. The liquid supply mechanism 30 includes a liquid supply source 31 for accommodating a liquid such as ink, a sub tank 32, and a pump 33. The liquid supply source 31 and the sub tank 32 are coupled to each other through a liquid supply path 34. The sub tank 32 is coupled to the liquid ejecting head 21 through a supply flow path 35 and a recovery flow path 36.

As shown in FIG. 5, the liquid ejecting apparatus 11 includes the liquid supply mechanism 30 including the liquid supply source 31 for accommodating the liquid to be supplied to the liquid ejecting head 21, the sub tank 32 for temporarily storing the liquid from the liquid supply source 31, and a pump 33 for feeding liquid to the liquid ejecting head 21. The liquid ejecting apparatus 11 includes the liquid ejecting head 21 as an example of the liquid ejecting portion that ejects, from the nozzle 22, the liquid supplied from the liquid supply source 31.

The pump 33 pressurizes the inside of the sub tank 32 to supply the liquid from the sub tank 32 to the liquid ejecting head 21 through the supply flow path 35. The liquid supplied to the liquid ejecting head 21 and not consumed is recovered in the sub tank 32 through the recovery flow path 36. As described above, the liquid supply mechanism 30 is configured such that the liquid circulates in the circulation path passing through the sub tank 32, the supply flow path 35, the liquid ejecting head 21 and the recovery flow path 36 by driving the pump 33.

There may be a configuration in which there is no recovery flow path 36, and the liquid is supplied from the liquid supply source 31 to the liquid ejecting head 21 through the supply flow path 35. In addition, there may be a configuration in which the liquid is supplied from the liquid supply source 31 to the liquid ejecting head 21 through the supply flow path 35 by using water head difference. Further, there may be a configuration in which the liquid supply source 31 is detachably mounted on the mounting portion of the head unit 24. In addition, the liquid supply source 31 may be a cartridge such as an ink cartridge, a tank such as an ink tank, a liquid pack such as an ink pack, or the like.

Configuration of Humidifying Fluid Circulation Mechanism

As shown in FIG. 5, the capping device 50 includes the cap unit 51 having the cap 51*a*, the cap moving mechanism (not shown), a humidifying fluid circulation mechanism 60, and a waste liquid recovery mechanism 80.

The humidifying fluid circulation mechanism 60 included in the capping device 50 includes a humidifying fluid accommodating portion 61 accommodating a humidifying fluid L1*a*, a supply flow path 62*a*, and a recovery flow path 62*b*. The supply flow path 62*a* allows the humidifying fluid accommodating portion 61 to communicate with the inlet 55*a*. That is, the supply flow path 62*a* allows the humidifying fluid accommodating portion 61 to communicate with the cap 51*a*, which is an example of the cap. The recovery flow path 62*b* allows the outlet 55*b* to communicate with the humidifying fluid accommodating portion 61. That is, the recovery flow path 62*b* allows the cap 51*a*, which is an example of the cap, to communicate with the humidifying fluid accommodating portion 61. The humidifying fluid circulation mechanism 60 includes the humidifying fluid accommodating portion 61, the supply flow path 62*a*, and a circulation path 62 including a recovery flow path 62*b*.

The humidifying fluid accommodating portion 61 has an inlet portion 61*f* and an outlet portion 61*g*. The humidifying fluid accommodating portion 61 communicates with the recovery flow path 62*b* at the inlet portion 61*f*. The humidifying fluid accommodating portion 61 communicates with the supply flow path 62*a* at the outlet portion 61*g*.

In the humidifying fluid circulation mechanism 60, the humidifying fluid L1*a* flowing in the circulation path 62 is a fluid containing water for humidifying the closed space SP shown in FIG. 4. It is desirable that the moisturizing power of the humidifying fluid L1*a* is equivalent to the moisturizing power of the liquid ejected from the liquid ejecting head 21. The moisturizing power refers to the concentration of the moisturizing agent contained in the humidifying fluid L1*a* and the liquid ejected from the liquid ejecting head 21. For example, it is desirable that when the liquid ejecting head 21 performs printing by ejecting an ink, which is an example of the liquid, to a medium such as a paper sheet, the moisturizing power of the humidifying fluid L1*a* is equivalent to the moisturizing power of fresh ink. Further, it is desirable that the moisturizing power of the ink is balanced in each color. The details of the humidifying fluid L1*a* will be described later.

As shown in FIG. 3, the cap unit 51 included in the capping device 50 of the present embodiment has five caps 51*a*. That is, in the capping device 50, a plurality of caps 51*a*, each being an example of the cap, are arranged. Then, each of the five caps 51*a* has the inlet 55*a* shown in FIG. 4 and the outlet 55*b* shown in FIG. 4. Therefore, in the present embodiment, among the plurality of caps 51*a*, the outlet 55*b* of one cap 51*a* is coupled to the inlet 55*a* of another cap 51*a* adjacent to the cap 51*a*. For example, the outlet 55*b* of one cap 51*a* and the inlet 55*a* of another cap 51*a* adjacent to the cap 51*a* are coupled to each other by a tube (not shown), and the outlet 55*b* and the inlet 55*a* communicate with each other, accordingly. Thereby, the inlet 55*a* positioned furthest upstream and the outlet 55*b* positioned furthest downstream communicate with each other. The inlet 55*a* positioned furthest upstream is coupled to the supply flow path 62*a* shown in FIG. 5. The outlet 55*b* positioned furthest downstream is coupled to the recovery flow path 62*b* shown in FIG. 5. That is, the capping device 50 of the present embodiment is configured such that the humidifying fluid L1*a* flowing in the circulation path 62 shown in FIG. 5 can flow through the groove 55*d* of the humidifying chamber 55 which is shown in FIG. 4 in the caps 51*a*. When the capping device 50 has only one cap 51*a*, the inlet 55*a* of the cap 51*a* may be coupled to the supply flow path 62*a*, and the outlet 55*b* of the cap 51*a* may be coupled to the recovery flow path 62*b*.

As shown in FIG. 5, the humidifying fluid accommodating portion 61 accommodates the humidifying fluid L1*a* containing water for humidifying the closed space SP shown in FIG. 4. The humidifying fluid accommodating portion 61 has a detecting portion 61*a* that detects a liquid surface in the humidifying fluid accommodating portion 61. The detecting portion 61*a* has a first electrode 61*b* and a second electrode 61*c*.

The humidifying fluid L1*a* contains a conductive additive. The detecting portion 61*a* detects the liquid surface in the humidifying fluid accommodating portion 61 with the electric resistance between the first electrode 61*b* and the second electrode 61*c*. When the liquid surface height of the humidifying fluid L1*a* accommodated in the humidifying fluid accommodating portion 61 is higher than a first predetermined height H1, conduction occurs between the first electrode 61*b* and the second electrode 61*c*. When the liquid surface height of the humidifying fluid L1*a* accommodated in the humidifying fluid accommodating portion 61 is lower than the first predetermined height H1 and higher than a second predetermined height H2, there is no conduction between the first electrode 61*b* and the second electrode 61*c*. In this way, the detecting portion 61*a* can determine whether or not the liquid surface height of the humidifying fluid L1*a* is higher than the first predetermined height H1 since the output level is changed depending on whether the first electrode 61*b* is in contact with the liquid surface or not.

The reference "when the liquid surface height of the humidifying fluid L1*a* exceeding the first predetermined height H1 is detected by the detecting portion 61*a*" means that the humidifying fluid accommodating portion 61 is fully filled with the humidifying fluid L1*a*. In the present embodiment, the full state of the humidifying fluid accommodating portion 61 is detected. Not only the full state of the humidifying fluid accommodating portion 61 may be detected, but also the empty state or the near-empty state of the humidifying fluid accommodating portion 61 may be detected. Further, the method of detecting the liquid surface is not limited to the electrode method, and may include an optical method or a capacitance method.

The humidifying fluid accommodating portion 61 has a second atmosphere communication passage 61*d* and a second moisture permeable membrane 61*e*. The second atmosphere communication passage 61*d* allows the humidifying fluid accommodating portion 61 to communicate with the atmosphere. The second atmosphere communication passage 61*d* may have a labyrinthine capillary structure. The labyrinthine capillary structure refers to a tubular structure of conduits having a narrow, complicated, and meandering path to the extent that air can enter and exit but the ingress and egress of liquid is considerably restricted. The labyrinthine capillary structure suppresses evaporation of the liquid in the humidifying fluid accommodating portion 61.

The second moisture permeable membrane 61*e* is provided at a coupling portion between the humidifying fluid accommodating portion 61 and the second atmosphere communication passage 61*d*. Further, the second moisture permeable membrane 61*e* allows passing-through of gas from the inside of the humidifying fluid accommodating portion 61 to the second atmosphere communication passage 61*d*, and restricts passing-through of liquid from the inside of the humidifying fluid accommodating portion 61 to the second atmosphere communication passage 61*d*. In order to increase the efficiency of the passing-through of gas from the humidifying fluid accommodating portion 61 to the second atmosphere communication passage 61*d*, it is desirable that the area of the second moisture permeable membrane 61*e* is large.

As shown in FIG. 5, the humidifying fluid circulation mechanism 60 includes a first pump 63, which is an example of a first liquid feeding portion capable of causing the humidifying fluid L1*a* to flow in the circulation path 62, and a first check valve 64, and a pressure control valve 65. The first pump 63 causes the fluid to flow in the circulation path 62. By driving the first pump 63, the liquid flowing through the supply flow path 62*a* is sent to the humidifying chamber 55 in the cap 51*a*.

The first check valve 64 allows the flow of liquid from the humidifying fluid accommodating portion 61 side to the cap 51*a* side, and prevents the backflow of the liquid from the cap 51*a* side to the humidifying fluid accommodating portion 61 side due to a water head difference. An on-off valve may be provided instead of the first check valve 64. By driving the first pump 63 when the on-off valve is open, the liquid may flow from the humidifying fluid accommodating portion 61 side to the cap 51*a* side. Opening the valve of the on-off valve is called opening the valve. Further, closing the valve of the on-off valve is called closing the valve.

When the humidifying fluid accommodating portion 61 side becomes a predetermined negative pressure, the pressure control valve 65 allows flow of the liquid from the cap 51*a* side to the humidifying fluid accommodating portion 61 side and always prevents the liquid from flowing back from the humidifying fluid accommodating portion 61 side to the cap 51*a* side. The pressure difference of the water head difference is controlled by the pressure control valve 65 such that the liquid does not flow from the cap 51*a* to the humidifying fluid accommodating portion 61 due to the water head pressure.

As shown in FIG. 5, the humidifying fluid circulation mechanism 60 includes an adjusting water supply portion 66 capable of supplying adjusting water L1*b* containing water for concentration adjustment as a main component in the circulation path 62. The adjusting water supply portion 66 includes an adjusting water accommodating portion 66*a* as an example of a liquid accommodating portion, an adjusting water supply flow path 66*b*, a first on-off valve 66*c*, and a second check valve 66*d*. The adjusting water accommodating portion 66*a* accommodates the adjusting water L1*b* that can be supplied into the circulation path 62. The adjusting water supply flow path 66*b* communicates with the circulation path 62. The first on-off valve 66*c* is configured to be able to open and close the adjusting water supply flow path 66*b*.

As shown in FIG. 5, the humidifying fluid circulation mechanism 60 includes supply flow paths 62*a* and 66*b* that communicate between a liquid flow-in portion 104 (see FIG. 6) and the cap 51*a*, and a first pump 63 that feeds, to the cap 51*a*, the adjusting water L1*b*, which is the liquid in the adjusting water accommodating portion 66*a*. The supply flow path through which the liquid flow-in portion 104 and the cap 51*a* communicate with each other is constituted by the supply flow path 62*a* that constitutes the circulation path 62 and the adjusting water supply flow path 66*b*.

The adjusting water accommodating portion 66*a* has an outlet portion 66*f* The adjusting water accommodating portion 66*a* communicates with the adjusting water supply flow path 66*b* at the outlet portion 61*g*. The adjusting water supply flow path 66*b* communicates with the circulation path 62 at a first merging portion 62*c* of the circulation path 62. That is, the adjusting water accommodating portion 66*a* and the circulation path 62 communicate with each other. It is desirable that the adjusting water accommodating portion 66*a* is configured to be replaceable.

The adjusting water L1*b* supplied from the adjusting water accommodating portion 66*a* into the circulation path 62 is a concentration adjusting replenishing water for replenishing the moisture evaporated from the humidifying fluid L1*a*. The adjusting water L1*b* as an example of the liquid is a liquid containing water and a preservative. Specifically, the adjusting water L1*b* is a liquid containing pure water and a small amount of preservative.

By opening the first on-off valve 66*c*, the adjusting water accommodating portion 66*a* and the circulation path 62 communicate with each other by the adjusting water supply flow path 66*b*. The second check valve 66*d* allows the flow of the liquid from the adjusting water accommodating portion 66*a* side to the circulation path 62 side, and prevents the backflow of the liquid from the circulation path 62 side to the adjusting water accommodating portion 66*a* side due to the water head difference. The second check valve 66*d* may not be provided. When the second check valve 66*d* is not provided, by driving the first pump 63 when the first on-off valve 66*c* is open, the first pump 63 may cause the adjusting water L1*b* to flow from the adjusting water accommodating portion 66*a* side to the cap 51*a* side.

As shown in FIG. 5, the humidifying fluid circulation mechanism 60 included in the capping device 50 further includes a pressurized air supply portion 67. The pressurized air supply portion 67 is configured to be able to supply pressurized air into the circulation path 62. The pressurized air supply portion 67 has a pressurized air supply path 67*a* communicating with the circulation path 62, a second on-off valve 67*b*, and a second pump 67*c*. By opening the second on-off valve 67*b*, the second pump 67*c* and the circulation path 62 communicate with each other by the pressurized air supply path 67*a*. The second pump 67*c* is, for example, a pressurizing pump. The second pump 67*c* applies pressure to the atmosphere to obtain pressurized air, and supplies the pressurized air to the pressurized air supply path 67*a*.

In the circulation path 62, the pressurized air supply portion 67 may not be provided downstream of the first pump 63, and an atmosphere supply portion may be provided upstream of the first pump 63 and downstream of the first merging portion 62*c*. The atmosphere supply portion may have an atmosphere communication passage that communicates with the atmosphere and an on-off valve. Then, the atmosphere may be sent out to the circulation path 62 by the first pump 63 in a state where the circulation path 62 and the atmosphere communicate with each other through the atmosphere communication passage by opening the on-off valve. That is, in the circulation path 62 in which the humidifying fluid L1*a* flows, the capping device 50 may have an atmosphere supply portion for supplying the atmosphere to the circulation path 62 between the first merging portion 62*c* where the adjusting water supply portion 66 and the circulation path 62 merge and the inlet 55*a* of the cap 51*a*. The capping device 50 may further have a pump for pumping the atmosphere into the circulation path 62.

Configuration of Waste Liquid Recovery Mechanism

As shown in FIG. 5, the waste liquid recovery mechanism 80 included in the capping device 50 includes a waste liquid recovery path 81, a third pump 82 as an example of a second liquid feeding portion, a buffer chamber 83, a fourth pump 84, a third atmosphere communication passage 85, and a waste liquid accommodating portion 86.

The waste liquid recovery path 81 includes a first waste liquid flow path 81*a* and a second waste liquid flow path 81*b* as an example of the waste liquid flow path. The first waste liquid flow path 81*a* communicates with the closed space SP formed by the recessed portion 57 in the cap 51*a*, which is shown in FIG. 4, in the discharge hole 56*b* of the cap 51*a*. Then, the first waste liquid flow path 81*a* allows the closed space SP and the waste liquid accommodating portion 86 to communicate with each other through the buffer chamber 83. The downstream end of the first waste liquid flow path 81*a* is coupled to the waste liquid accommodating portion 86 through an inlet portion 86*b*. Further, the second waste liquid flow path 81*b* communicates with the wiper carriage 41 at a waste liquid outlet 43 of the wiper carriage 41. Then, the second waste liquid flow path 81*b* allows the wiper carriage 41 and the waste liquid accommodating portion 86 to communicate with each other.

At the time of flushing or cleaning, the liquid is discharged as the waste liquid L2 from the nozzle 22 of the liquid ejecting head 21. The waste liquid L2 is recovered from inside the cap 51*a* and flows to the first waste liquid flow path 81*a*. Further, at the time of wiping, the liquid adhering to the nozzle surface 23 of the liquid ejecting head 21 is wiped off and recovered in the wiper carriage 41 as the waste liquid L2. The waste liquid L2 is recovered from the wiper carriage 41 and flows to the second waste liquid flow path 81*b*. The waste liquid L2 recovered by flushing or cleaning and the waste liquid L2 recovered by wiping are sent to the waste liquid accommodating portion 86 by the third pump 82. Then, the waste liquid L2 is accommodated in the waste liquid accommodating portion 86.

As shown in FIG. 3, each of the five caps 51*a* included in the cap unit 51 of the present embodiment has the discharge hole 56*b* shown in FIG. 4. Therefore, in the present embodiment, the five discharge holes 56*b* are coupled to the first waste liquid flow path 81*a*, and the five discharge holes 56*b* and the waste liquid accommodating portion 86 communicate with each other by the first waste liquid flow path 81*a*. When the capping device 50 has only one cap 51*a*, only the discharge hole 56*b* of the cap 51*a* may be coupled to the first waste liquid flow path 81*a*.

As shown in FIG. 5, in the present embodiment, the fourth pump 84 is a depressurization pump. The fourth pump 84 lowers the air pressure in the buffer chamber 83 by discharging the air in the buffer chamber 83 to the outside of the buffer chamber 83 through the third atmosphere communication passage 85. Thereby, the waste liquid L2 discharged from the nozzles 22 of the liquid ejecting head 21 into the cap 51*a* at the time of flushing or cleaning can easily flow into the buffer chamber 83 through the first waste liquid flow path 81*a*. The buffer chamber 83, the fourth pump 84, and the third atmosphere communication passage 85 may not be provided.

As shown in FIG. 5, the cap unit 51 having the cap 51*a* has an atmosphere opening mechanism 58. The atmosphere opening mechanism 58 has a first atmosphere communication passage 58*a* and a third on-off valve 58*b*.

The first atmosphere communication passage 58*a* allows each atmosphere communication hole 56*a* of the cap 51*a* and the atmosphere to communicate with each other in the cap unit 51. The third on-off valve 58*b* is an on-off valve capable of opening and closing the first atmosphere communication passage 58*a*. In the present embodiment, the atmospheric side of the first atmosphere communication passage 58*a* is open. The third on-off valve 58*b* is configured such that, when the cap unit 51 moves in the fourth direction D4 from the maintenance position indicated by a two-dot chain line in FIG. 5 and positioned at the retreat position indicated by a solid line in FIG. 5, the open portion hits a wall (not shown), and the wall blocks the first atmosphere communication passage 58*a*. That is, the third on-off valve 58*b* is opened and closed by the movement of the cap unit 51. At the time of flushing or cleaning, the liquid ejecting head 21 discharges the liquid into the cap 51*a* in a state where the first atmosphere communication passage 58*a* is open.

Configuration of Waste Liquid Box

Next, a specific configuration of a waste liquid box 110 provided with the adjusting water accommodating portion 66*a* will be described with reference to FIGS. 6 to 15.

Figure 6:
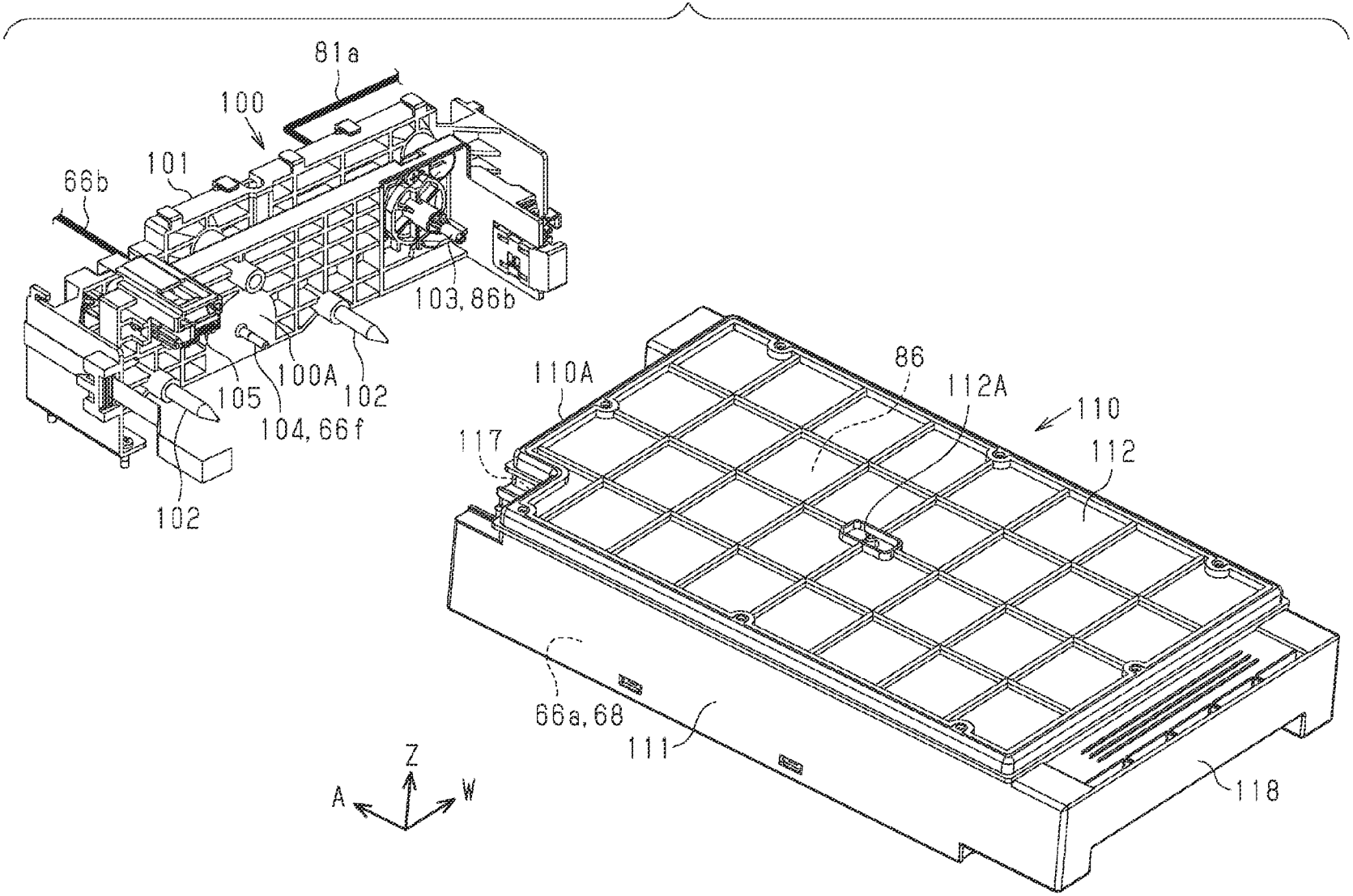
FIG. 6 is a perspective view showing a mounting portion and a waste liquid box.

As shown in FIG. 6, the liquid ejecting apparatus 11 includes a mounting portion 100 on which the waste liquid box 110 as an example of the liquid accommodating body is detachably mounted. The waste liquid box 110 is detachably mounted on the mounting portion 100. The waste liquid box 110 is configured to be able to accommodate the waste liquid L2 discharged from a waste liquid flow-out portion 103 of the mounting portion 100. The waste liquid box 110 has, for example, a square plate shape.

In FIG. 6, a direction in which the waste liquid box 110 is mounted on the mounting portion 100 is defined as a mounting direction A. Further, a direction that intersects the two directions, that is, the mounting direction A and the vertical direction Z is defined as a width direction W. The mounting portion 100 is configured such that the waste liquid box 110 can be attached and detached in the mounting direction A.

As shown in FIG. 6, the mounting portion 100 includes a mounting portion main body 101, and two positioning pins 102 protruding from a mounted surface 100A, which is a surface of the mounting portion main body 101 on which the waste liquid box 110 is attached and detached. Further, the mounting portion 100 includes the waste liquid flow-out portion 103, which is an example of a discharge portion that discharges the waste liquid L2, and the liquid flow-in portion 104, which is an example of the liquid flow-in portion. The waste liquid flow-out portion 103 may be a needle-shaped pipe portion protruding from the mounted surface 100A of the mounting portion main body 101. The waste liquid flow-out portion 103 is coupled to the first waste liquid flow path 81*a*. Therefore, the waste liquid L2 recovered from the plurality of caps 51*a* flows out from the waste liquid flow-out portion 103.

Further, the liquid flow-in portion 104 may be a needle-shaped pipe portion protruding from the mounted surface 100A of the mounting portion main body 101. The liquid flow-in portion 104 is coupled to the adjusting water supply flow path 66*b*. Therefore, the adjusting water L1*b* flowing in from the liquid flow-in portion 104 is replenished to the humidifying fluid accommodating portion 61 from the adjusting water supply flow path 66*b* through the circulation path 62.

Further, as shown in FIG. 6, the mounting portion 100 has a board coupling portion 105. When the waste liquid box 110 is mounted on the mounting portion 100, the waste liquid box 110 is electrically coupled to the board coupling portion 105.

Figure 7:
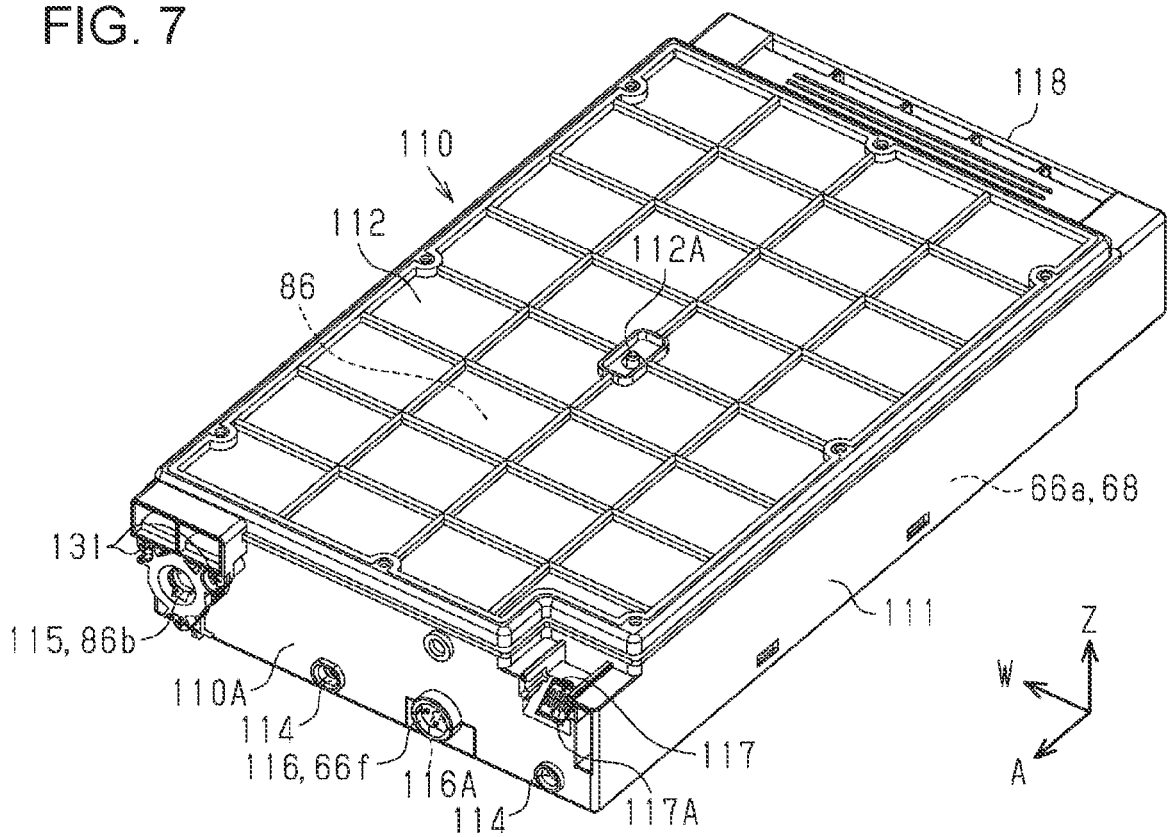
FIG. 7 is a perspective view of the waste liquid box when viewed from diagonally above.

As shown in FIGS. 6 and 7, the surface of the waste liquid box 110 downstream in the mounting direction A is a mounting surface 110A facing the mounting portion 100. The mounting surface 110A includes a waste liquid flow-in portion 115 coupled to the waste liquid flow-out portion 103 when the waste liquid box 110 is mounted on the mounting portion 100, and a liquid flow-out portion 116 coupled to the liquid flow-in portion 104. The waste liquid box 110 includes an adjusting water accommodating portion 66*a* in which the adjusting water L1*b* flowing out to the liquid flow-in portion 104 is accommodated. The adjusting water L1*b*, which is an example of the liquid, is a liquid containing water for humidifying the cap 51*a*. The waste liquid flow-out portion 103 and the waste liquid flow-in portion 115 coupled to each other constitute the inlet portion 86*b* in FIG. 5. Further, the liquid flow-in portion 104 and the liquid flow-out portion 116 coupled to each other constitute the outlet portion 66*f* in FIG. 5.

As shown in FIG. 6, the waste liquid box 110 includes a box main body 111 having a square plate shape with both sides open, a first cover 112 for closing a first opening 111A that opens above the box main body 111, and a second cover 113 (see FIG. 8) for closing a second opening 111C (see FIG. 12) that opens below the box main body 111. As shown in FIGS. 6 and 7, the waste liquid box 110 includes the first cover 112 that covers the waste liquid accommodating portion 86. The first cover 112 is fixed to the box main body 111 in a liquid-tight state. This fixing is, for example, welding, but may also be screw fastening.

The waste liquid box 110 is provided with the waste liquid accommodating portion 86 (see FIG. 11) in which the waste liquid L2 is accommodatable, and the adjusting water accommodating portion 66*a* (see FIG. 12) in which the adjusting water L1*b* which is an example of the liquid is accommodated. A ventilation hole 112A through which the inside and the outside (atmosphere) of the waste liquid box 110 communicate with each other is opened in the central portion of the upper surface of the first cover 112. When the waste liquid L2 is accommodated in the waste liquid box 110, the same amount of air as the volume of the accommodated waste liquid L2 escapes from the ventilation hole 112A. Thereby, in the waste liquid accommodating portion 86, the waste liquid L2 is accommodated until it reaches a predetermined full amount.

As shown in FIG. 7, on the mounting surface 110A of the waste liquid box 110, a plurality of (for example, two) positioning holes 114 into which a plurality of (for example, two) positioning pins 102 on the mounting portion 100 side can be inserted, the waste liquid flow-in portion 115 to which the waste liquid flow-out portion 103 can be coupled, and the liquid flow-out portion 116 to which the liquid flow-in portion 104 can be coupled are provided. The waste liquid flow-in portion 115 is, for example, a hole portion into which a needle-shaped waste liquid flow-in portion 115 can be inserted. The liquid flow-out portion 116 is, for example, a hole portion into which the needle-shaped liquid flow-in portion 104 can be inserted.

The positioning hole 114 is provided at a position facing the positioning pin 102. The waste liquid flow-in portion 115 is provided at a position facing the waste liquid flow-out portion 103. The waste liquid flow-in portion 115 is fixed by a plurality of screws 131. The liquid flow-out portion 116 is provided at a position facing the liquid flow-in portion 104. The liquid flow-out portion 116 has a circular tubular mouth portion formed by joining a pair of semi-arc-shaped protrusions formed at the ends on the box main body 111 and the second cover 113 (see FIG. 8) on the mounting surface 110A side, respectively.

Further, as shown in FIG. 7, the waste liquid box 110 includes a circuit board 117 having a coupling terminal 117A that is electrically coupled to the board coupling portion 105 when mounted on the mounting portion 100. The circuit board 117 is provided at a position corresponding to the board coupling portion 105 in the attitude when the waste liquid box 110 is mounted on the mounting portion 100. The circuit board 117 is fixed to a recessed portion positioned on the mounting surface 110A side of the waste liquid box 110 and at an upper portion of the end in the width direction W. When the waste liquid box 110 is mounted on the mounting portion 100, the coupling terminal 117A of the circuit board 117 and the board coupling portion 105 on the mounting portion 100 side are electrically coupled to each other. For example, a storage element is mounted on the circuit board 117. In the storage element, information regarding an accommodation amount of the waste liquid L2 recovered in the waste liquid box 110 is stored.

Further, as shown in FIGS. 6 and 7, a handle 118 for a user to grip the waste liquid box 110 is formed at an end of the waste liquid box 110 opposite to the mounting surface 110A.

Figure 8:
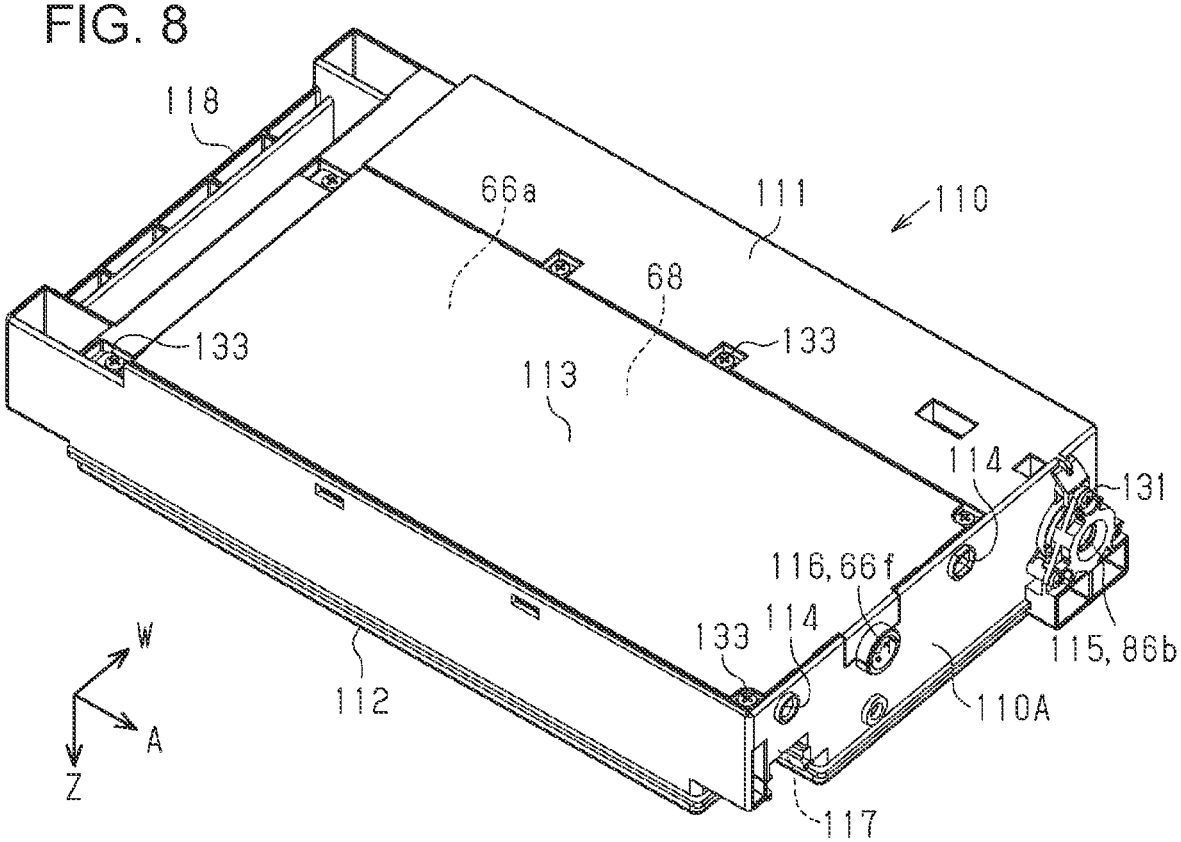
FIG. 8 is a perspective view showing a bottom surface of the waste liquid box.

As shown in FIG. 8, the waste liquid box 110 includes the second cover 113 that covers the adjusting water accommodating portion 66*a*. In the posture in which the waste liquid box 110 is mounted on the mounting portion 100, the lower surface of the adjusting water accommodating portion 66*a* is covered with the second cover 113. The opening area of a second accommodating recessed portion 111D (see FIG. 12) is larger than that of a first accommodating recessed portion 111B (see FIG. 11). A part of the first accommodating recessed portion 111B bulges to the vicinity of the second surface (bottom surface) of the box main body 111, and the second accommodating recessed portion 111D is formed in a region avoiding the bulging portion. This is because it is necessary to secure a larger capacity for the waste liquid L2 than the capacity for the adjusting water L1*b*.

Figure 9:
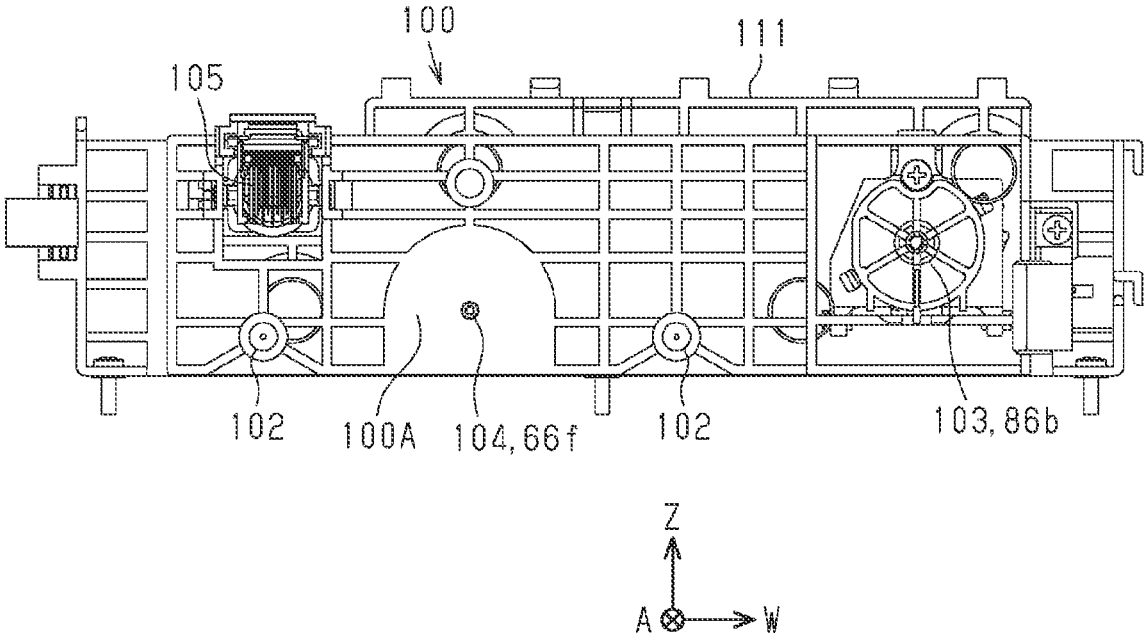
FIG. 9 is a front view showing a mounted surface of the mounting portion.

As shown in FIG. 9, in the width direction W intersecting the mounting direction A, the waste liquid flow-out portion 103 is provided on one side, and the board coupling portion 105 is provided on the other side. Further, the liquid flow-in portion 104 is provided between the waste liquid flow-out portion 103 and the board coupling portion 105 in the width direction W, and is provided at a position lower than the board coupling portion 105 in the vertical direction Z.

Figure 10:
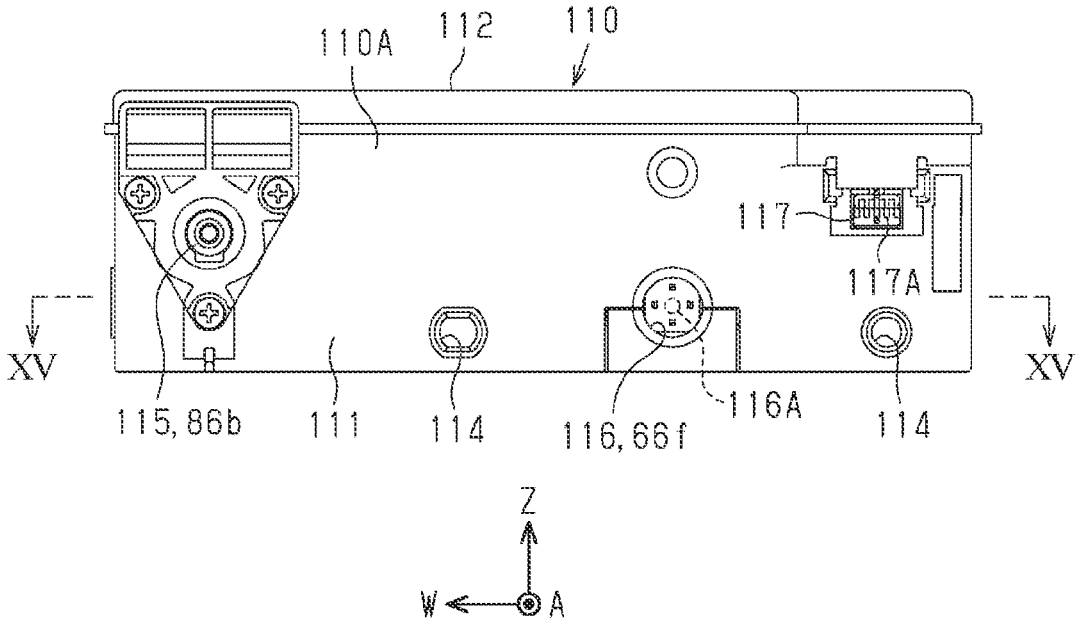
FIG. 10 is a front view showing a mounting surface of the waste liquid box.

Thereby, as shown in FIG. 10, in the width direction W intersecting the mounting direction A, the waste liquid flow-in portion 115 is provided on one side, and the circuit board 117 is provided on the other side. Further, the liquid flow-out portion 116 is provided between the waste liquid flow-in portion 115 and the circuit board 117 in the width direction W, and is provided at a position lower than the circuit board 117 in the vertical direction Z. As shown in FIG. 10, in the posture in which the waste liquid box 110 is mounted on the mounting portion 100, the coupling terminal 117A of the circuit board 117 is provided at a position higher than the center of the waste liquid flow-in portion 115.

Figure 11:
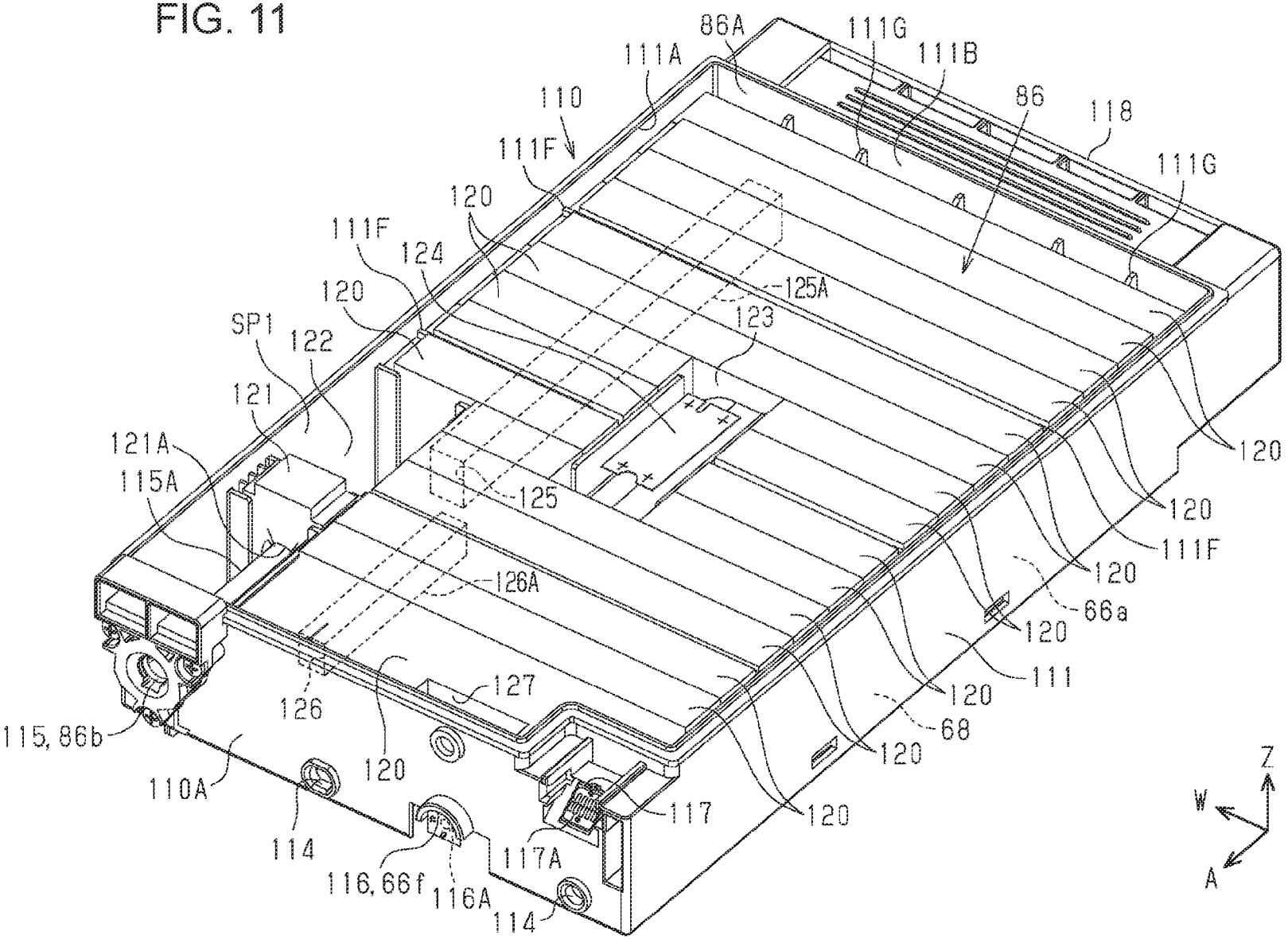
FIG. 11 is a perspective view showing the waste liquid box with a first cover removed.

FIG. 11 shows a first surface side of the waste liquid box 110 when the first cover 112 is removed. As shown in FIG. 11, the first accommodating recessed portion 111B opened by the first opening 111A is provided on the first surface of the box main body 111 in a recessed manner.

As shown in FIG. 11, a plurality of partition plates 111F extend inward on the inner surfaces of two side walls facing each other that extend in a long side direction of an inner peripheral wall in the first accommodating recessed portion 111B. Further, a plurality of guide plates 111G protrude inward on the inner surfaces of two side walls facing each other that extend in a short side direction of the inner peripheral wall of the first accommodating recessed portion 111B.

As shown in FIG. 11, the first accommodating recessed portion 111B accommodates a plurality of absorbing members 120 capable of absorbing the waste liquid L2. The waste liquid accommodating portion 86 of the present embodiment is constituted by the first accommodating recessed portion 111B, a first cover 112 (see FIG. 13) that covers the first accommodating recessed portion 111B, a waste liquid chamber 86A (see also FIG. 13) formed by being partitioned by the first accommodating recessed portion 111B and the first cover 112, and a plurality of absorbing members 120 accommodated in the waste liquid chamber 86A.

Figure 15:
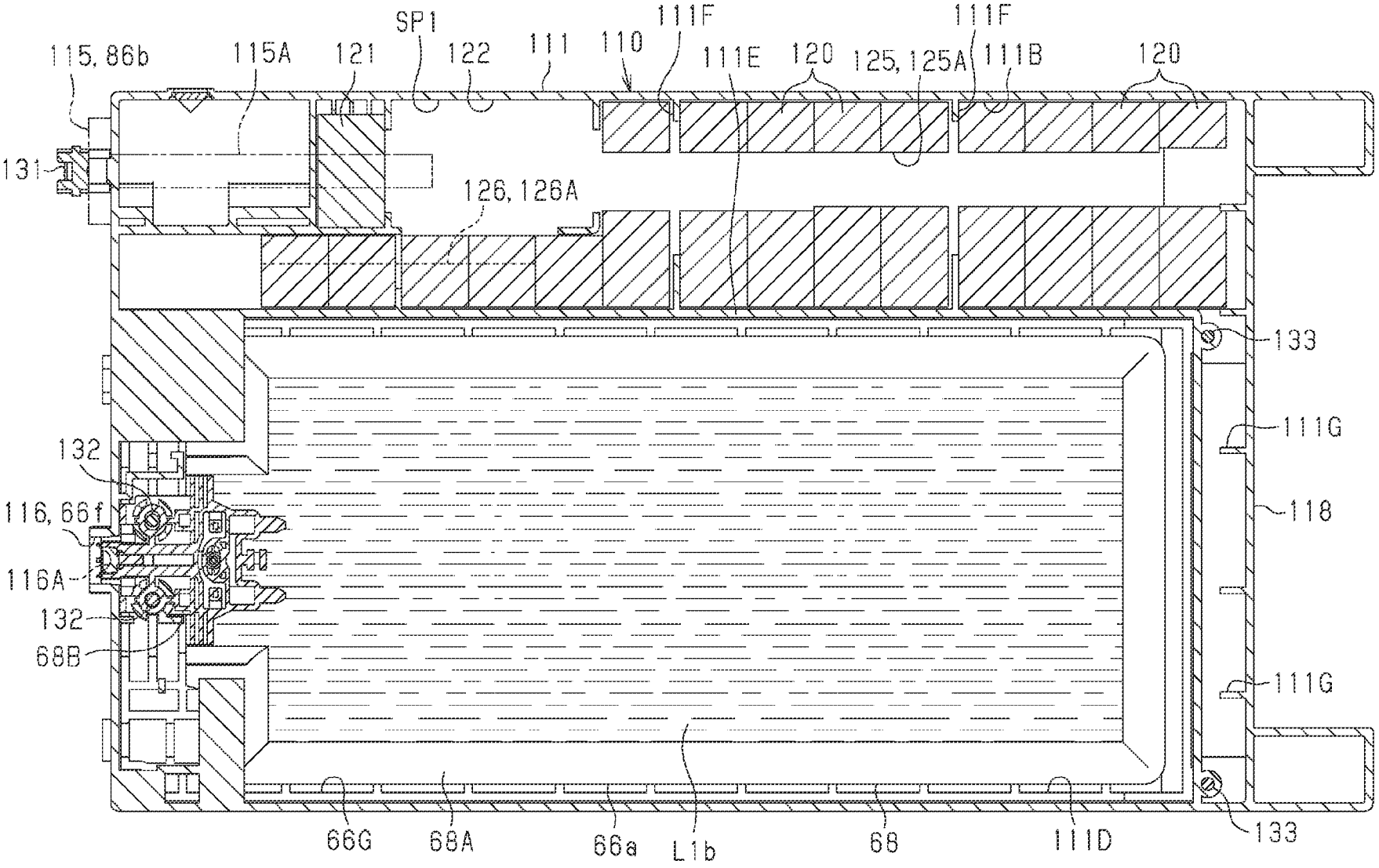
FIG. 15 is a cross-sectional view taken along line XV-XV in FIG. 10.

As shown in FIGS. 11 and 15, the waste liquid chamber 86A has a space SP1 in which the absorbing members 120 are not disposed in a portion corresponding to the waste liquid flow-in portion 115, and in the space SP1, a waste liquid flow-in pipe 115A extends upstream in the mounting direction A from the waste liquid flow-in portion 115. The waste liquid flow-in pipe 115A is held in a state of being inserted into a pipe insertion hole 121A of a holding member 121 accommodated in the space SP1. The holding member 121 is made of the same material as the absorbing member 120, and functions as the absorbing member, for example. An inner tip of the waste liquid flow-in pipe 115A is open to the hollow of a waste liquid flow-in chamber 122. Therefore, the waste liquid L2 flowing in from the waste liquid flow-in portion 115 is first discharged to the waste liquid flow-in chamber 122 through the waste liquid flow-in pipe 115A.

The plurality of absorbing members 120 are press-fitted into the first accommodating recessed portion 111B in a state of being partitioned by partition plates 111F. Further, both ends of the plurality of absorbing members 120 in the mounting direction A are accommodated in a state of being positioned in contact with the plurality of guide plates 111G (only a part of which is shown in FIG. 11). The plurality of absorbing members 120 are made of block members having a predetermined shape having the same thickness in the mounting direction A. Only the one disposed at the end downstream in the mounting direction A is thick and has a shape that conforms to the shape of the first accommodating recessed portion 111B.

Here, when adjacent absorbing members are in contact with each other in the plurality of absorbing members 120, the waste liquid L2 permeates the adjacent absorbing members 120 through contacting portions. However, at the part partitioned by the partition plate 111F, the two adjacent absorbing members 120 are adjacent to each other with a gap corresponding to the thickness of the partition plate 111F therebetween. For this reason, it is difficult for the waste liquid L2 to permeate from one absorbing member 120 separated by the partition plate 111F to the other absorbing member 120. Therefore, grooves 125 and 126 are formed at the bottom of the waste liquid chamber 86A. In this example, by forming notched recessed portions in the bottoms of the plurality of absorbing members 120, the grooves 125 and 126 made of the notched recessed portions are formed. Then, when the plurality of absorbing members 120 are accommodated in the first accommodating recessed portion 111B, as shown in FIG. 11, waste liquid flow paths 125A and 126A extending in the mounting direction A are formed at the bottoms of the plurality of absorbing members 120 by the grooves 125 and 126. The waste liquid L2 discharged to the waste liquid flow-in chamber 122 flows through the waste liquid flow paths 125A and 126A extending in the mounting direction A and permeates substantially evenly over the plurality of absorbing members 120. That is, even if there is a gap between two absorbing members 120 adjacent to each other with the partition plate 111F separated from each other, waste liquid L2 easily permeates the entire plurality of absorbing members 120. In this way, the waste liquid L2 discharged to the waste liquid flow-in chamber 122 permeates the entire plurality of absorbing members 120.

Further, as shown in FIG. 11, in the plurality of absorbing members 120 accommodated in the first accommodating recessed portion 111B, a hole portion 123 is formed in a region corresponding to the ventilation hole 112A. On the back surface of the first cover 112, a moisture permeable membrane 124 is fixed at a position corresponding to the ventilation hole 112A and the hole portion 123. The waste liquid chamber 86A partitioned by the first accommodating recessed portion 111B and the first cover 112 communicates with the ventilation hole 112A through the moisture permeable membrane 124. Since the moisture permeable membrane 124 is located at a position corresponding to the hole portion 123, the moisture permeable membrane 124 is separated from the waste liquid L2 absorbed by the absorbing members 120. Therefore, the inside of the waste liquid chamber 86A communicates with the atmosphere through the ventilation hole 112A, and even if the user tilts the waste liquid box 110 or holds it upside down, the waste liquid L2 does not leak from the ventilation hole 112A.

Further, as shown in FIG. 11, a notch hole 127 is formed in a portion corresponding to the liquid flow-out portion 116, in the plurality of absorbing members 120 accommodated in the first accommodating recessed portion 111B. This notch hole 127 is used in a space for escaping a shaft of a screw 132 for fixing a flow-out member 68B of an adjusting water pack 68 accommodated in the second accommodating recessed portion 111D when assembling the waste liquid box 110, a work space for fastening nuts, or the like, to the shaft of the screw 132, or the like.

Figure 12:
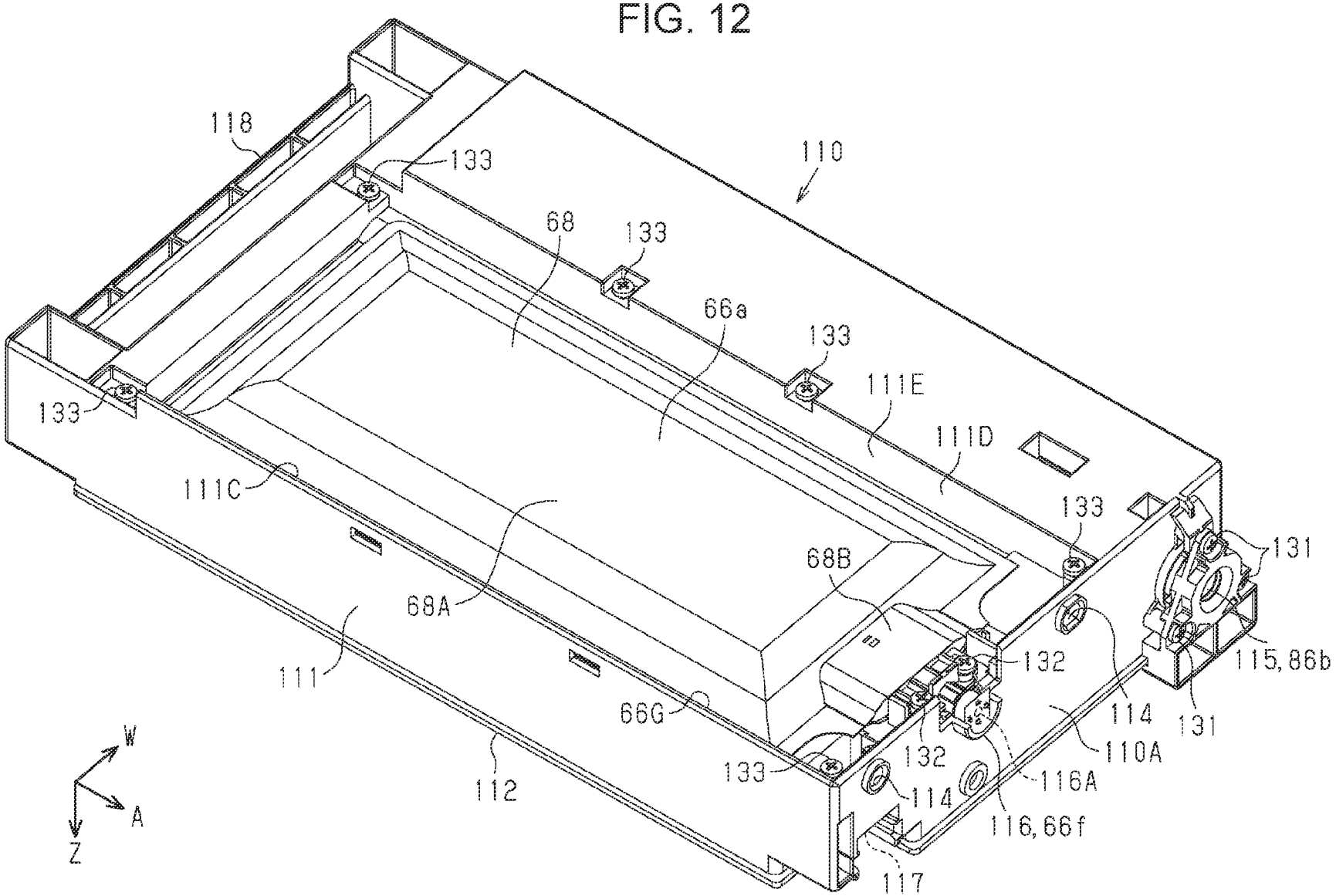
FIG. 12 is a perspective view showing the waste liquid box with a second cover removed.

FIG. 12 shows a second surface side of the waste liquid box 110 when the second cover 113 is removed. As shown in FIG. 12, the second accommodating recessed portion 111D opened by the second opening 111C is provided on the second surface of the box main body 111 in a recessed manner.

The adjusting water accommodating portion 66*a* of the present embodiment is formed by the adjusting water pack 68 accommodated in an accommodation chamber 66G partitioned by the second accommodating recessed portion 111D and the second cover 113 covering the second accommodating recessed portion 111D.

The adjusting water accommodating portion 66*a* is the adjusting water pack 68 as an example of a bag body for accommodating the adjusting water L1*b*. The adjusting water pack 68 includes a bag portion 68A in which the adjusting water L1*b* is accommodated, and a flow-out member 68B fixed to one end of the bag portion 68A. The flow-out member 68B has an outlet 116A at its tip that can be coupled to the liquid flow-in portion 104.

The amount of the adjusting water L1*b* accommodated in the adjusting water accommodating portion 66*a* is set to an amount of liquid at which the waste liquid accommodating portion 86 is fully filled with the waste liquid L2 earlier than when the adjusting water L1*b* accommodated in the adjusting water accommodating portion 66*a* is exhausted.

Figure 13:
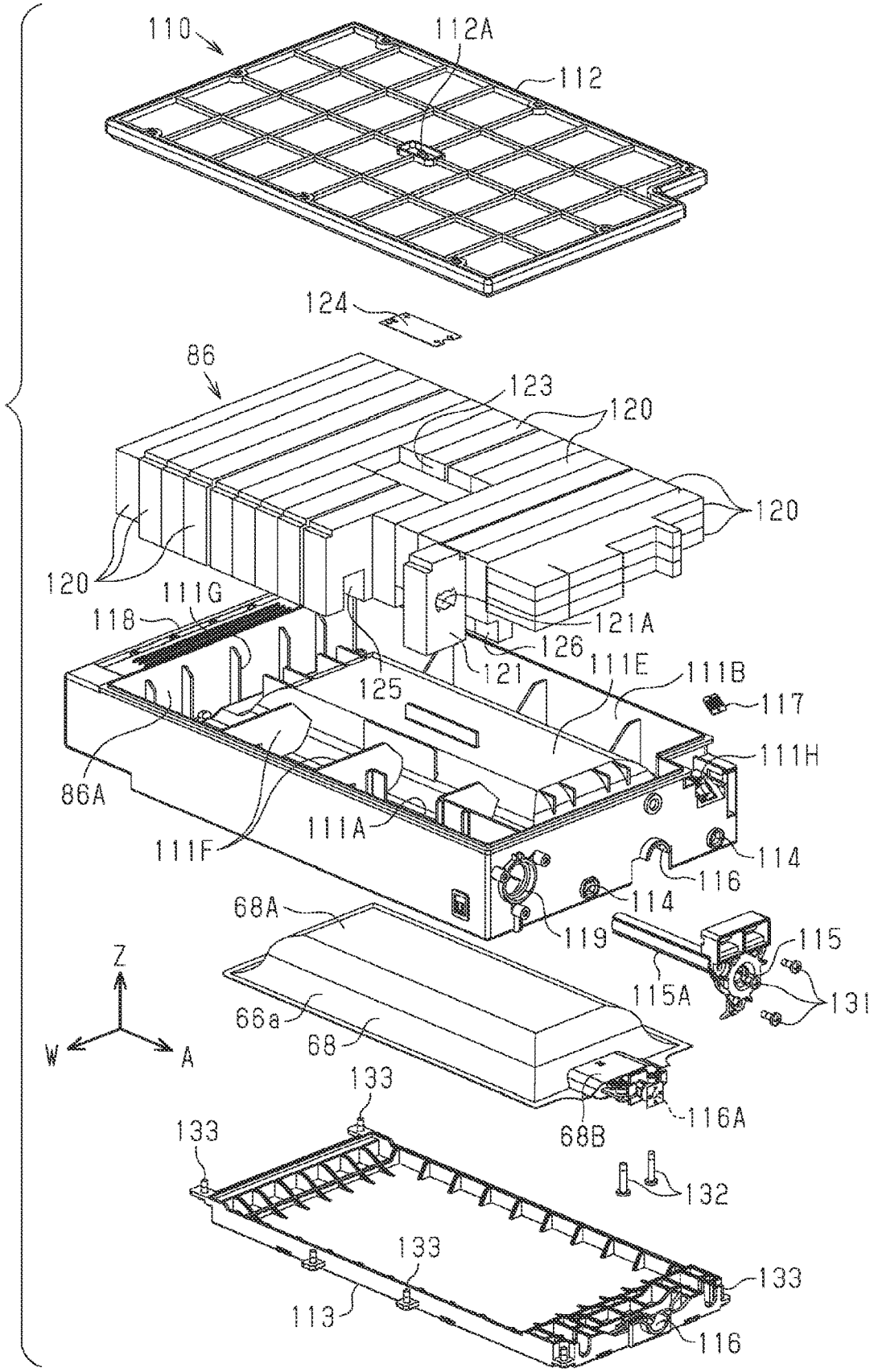
FIG. 13 is an exploded perspective view of the waste liquid box when viewed from diagonally above.
Figure 14:
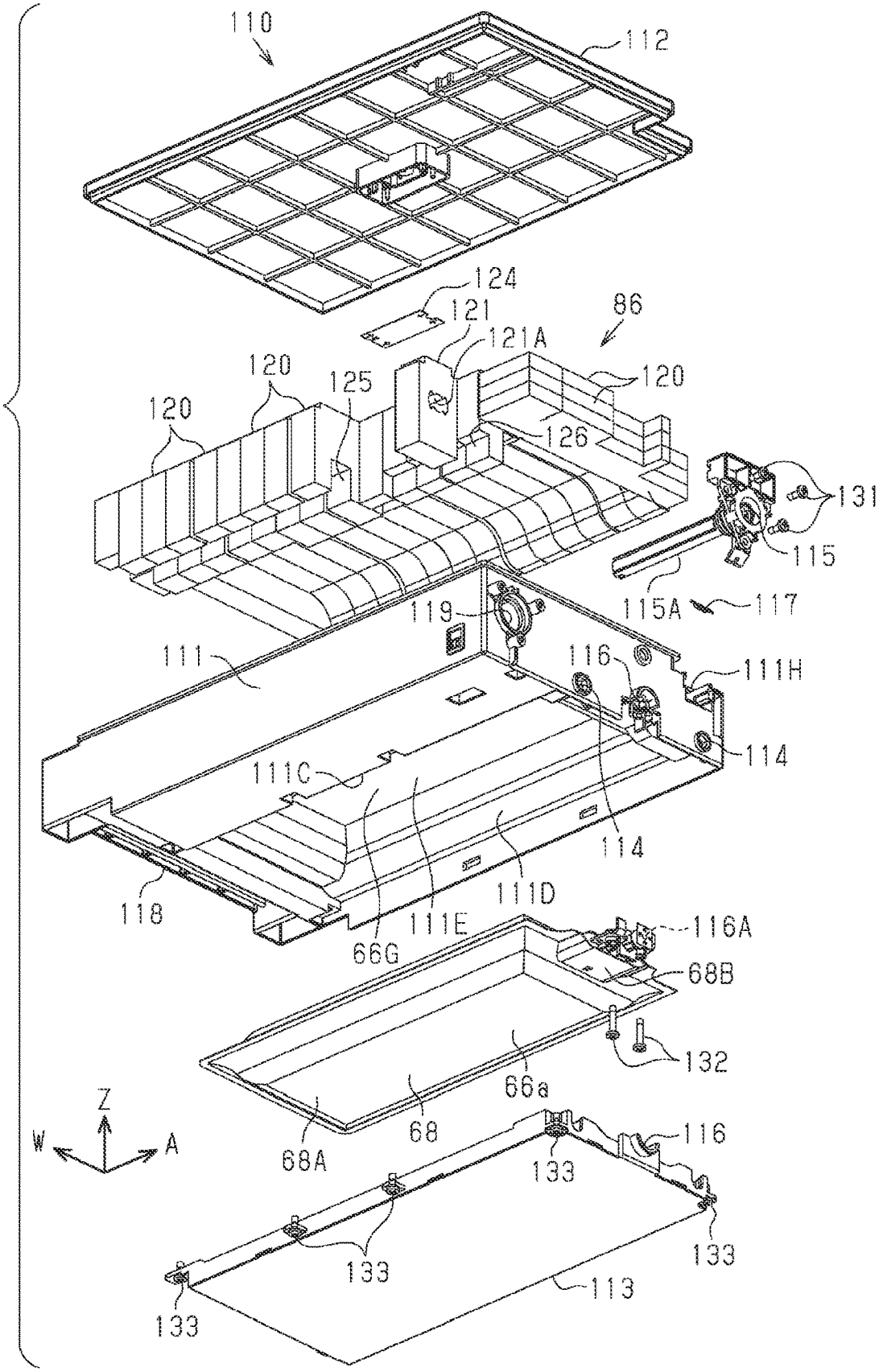
FIG. 14 is an exploded perspective view of the waste liquid box when viewed from diagonally below.

As shown in FIGS. 13 and 14, the waste liquid box 110 is mainly constituted by the first cover 112, the absorbing members 120, the box main body 111, the adjusting water accommodating portion 66*a* (adjusting water pack 68), and the second cover 113 in this order from the top. The absorbing members 120 and the holding member 121 are accommodated in the first accommodating recessed portion 111B of the box main body 111. The waste liquid flow-in portion 115 is assembled by screws 131 with the waste liquid flow-in pipe 115A inserted into the assembly hole 119 that opens to the mounting surface 110A of the box main body 111. By closing the first opening 111A opened above the box main body 111 by the first cover 112 welded to the upper surface of the box main body 111, the waste liquid chamber 86A in which the absorbing members 120 and the like are accommodated is formed by partitioning. Further, the circuit board 117 is mounted on a board assembly portion 111H formed of a slope recessed in the upper portion of one end of the mounting surface 110A in the width direction W.

As shown in FIG. 14, the adjusting water pack 68 is accommodated in the second accommodating recessed portion 111D. The flow-out member 68B of the adjusting water pack 68 is assembled at a position corresponding to the liquid flow-out portion 116 of the mounting surface 110A. The flow-out member 68B is fixed to the box main body 111 with two screws 132. By closing the second opening 111C opened below the box main body 111 is by the second cover 113 fixed to the lower surface of the box main body 111 with a plurality of screws 133, the accommodation chamber 66G in which the adjusting water pack 68 is accommodated is formed by partitioning. The outlet 116A of the adjusting water pack 68 is surrounded by the liquid flow-out portion 116 where the semi-cylindrical liquid flow-out portion 116 close to the box main body 111 and a semi-cylindrical liquid flow-out portion 116 close to the second cover 113 are joined in a single tubular shape.

In the posture in which the waste liquid box 110 is mounted on the mounting portion 100, the upper surfaces of the absorbing members 120 are covered with the first cover 112. As shown in FIG. 13, in the box main body 111, the first accommodating recessed portion 111B and the second accommodating recessed portion 111D are partitioned through a partition wall 111E. In this way, the waste liquid chamber 86A in which the recovered waste liquid L2 is accommodated and the accommodation chamber 66G in which the adjusting water accommodating portion 66*a* is accommodated are partitioned the through the partition wall 111E. Therefore, the waste liquid L2 in the waste liquid chamber 86A does not enter the accommodation chamber 66G in which the adjusting water accommodating portion 66*a* is accommodated.

Electrical Configuration of Liquid Ejecting Apparatus

Figure 16:
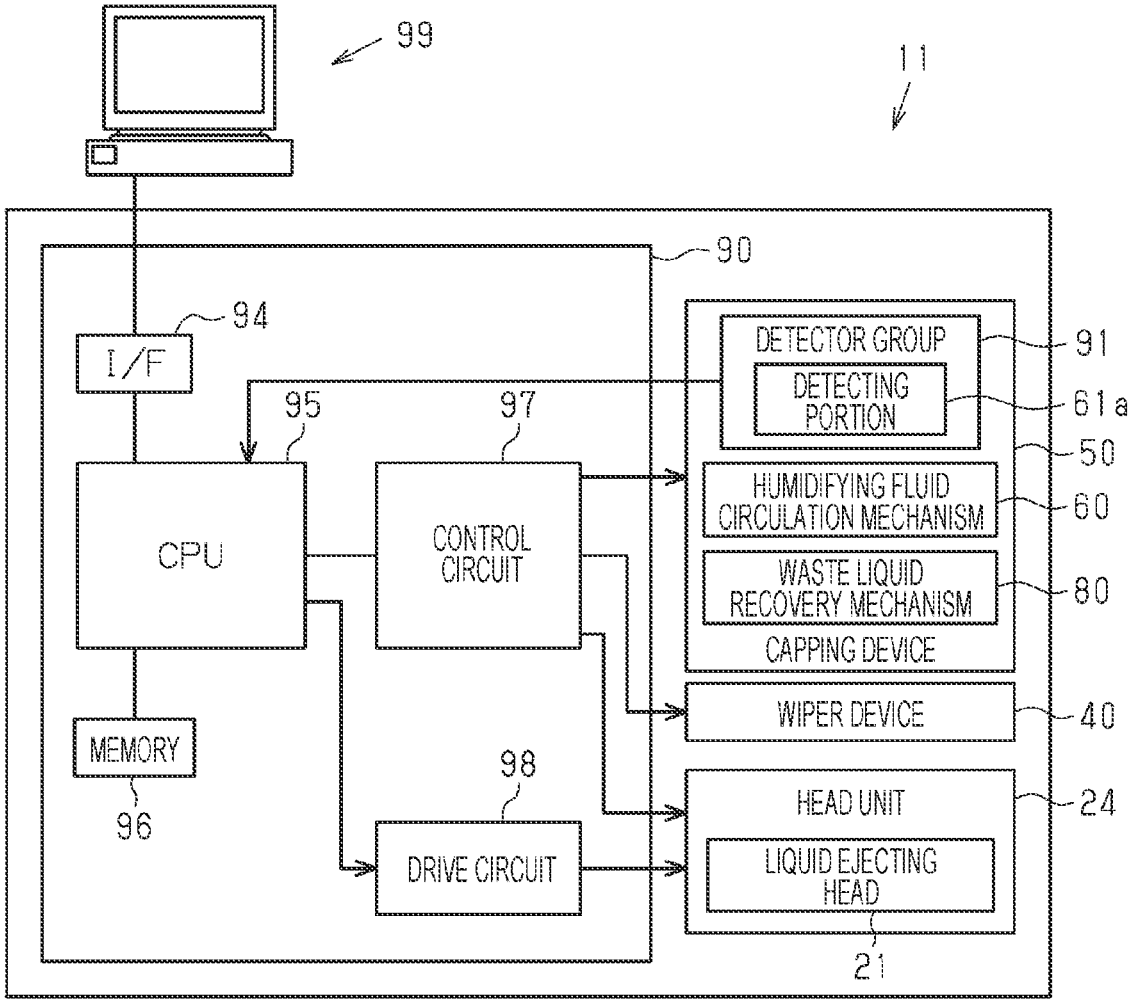
FIG. 16 is a block diagram showing an electrical configuration of the liquid ejecting apparatus.

As shown in FIG. 16, the liquid ejecting apparatus 11 includes a controller 90 that controls the head unit 24, a wiper device 40, and the capping device 50. The capping device 50 includes a detector group 91 controlled by the controller 90. The detector group 91 includes a detecting portion 61*a* that detects the liquid surface in the humidifying fluid accommodating portion 61. The detecting portion 61*a* outputs a detection result to the controller 90.

The controller 90 includes an interface portion 94, a CPU 95, a memory 96, a control circuit 97, and a drive circuit 98. The interface portion 94 transmits and receives data between a computer 99, which is an external device, and the liquid ejecting apparatus 11. The drive circuit 98 generates a drive signal for driving an actuator of the liquid ejecting head 21.

The CPU 95 is an arithmetic processing unit. The memory 96 is a storage device that secures an area or a work area for storing a program of the CPU 95, and has a storage element such as a RAM or an EEPROM. The CPU 95 controls the head unit 24, the wiper device 40, the capping device 50, and the like via the control circuit 97 according to the program stored in the memory 96.

Figure 17:
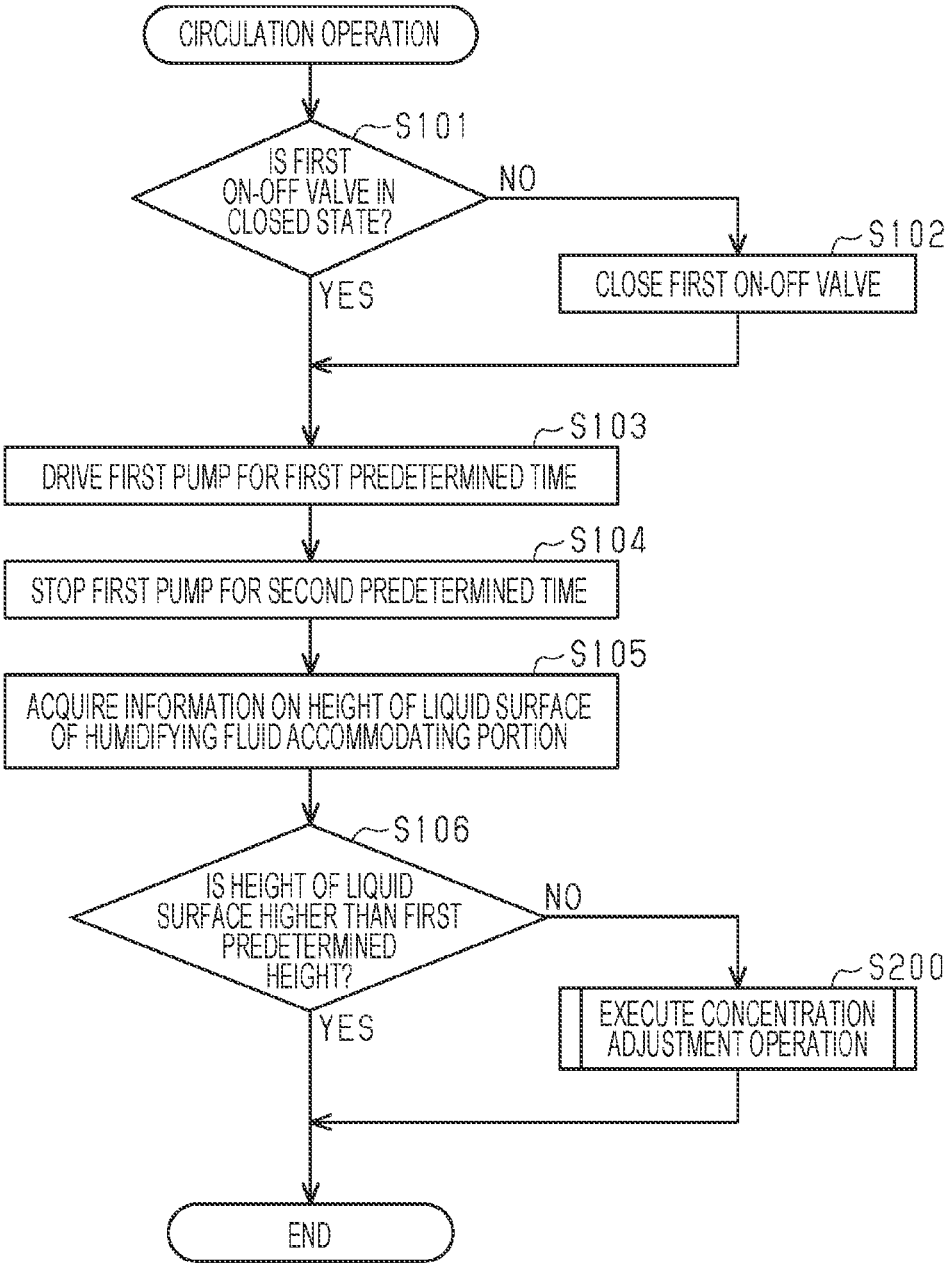
FIG. 17 is a flowchart showing a circulation operation.
Figure 18:
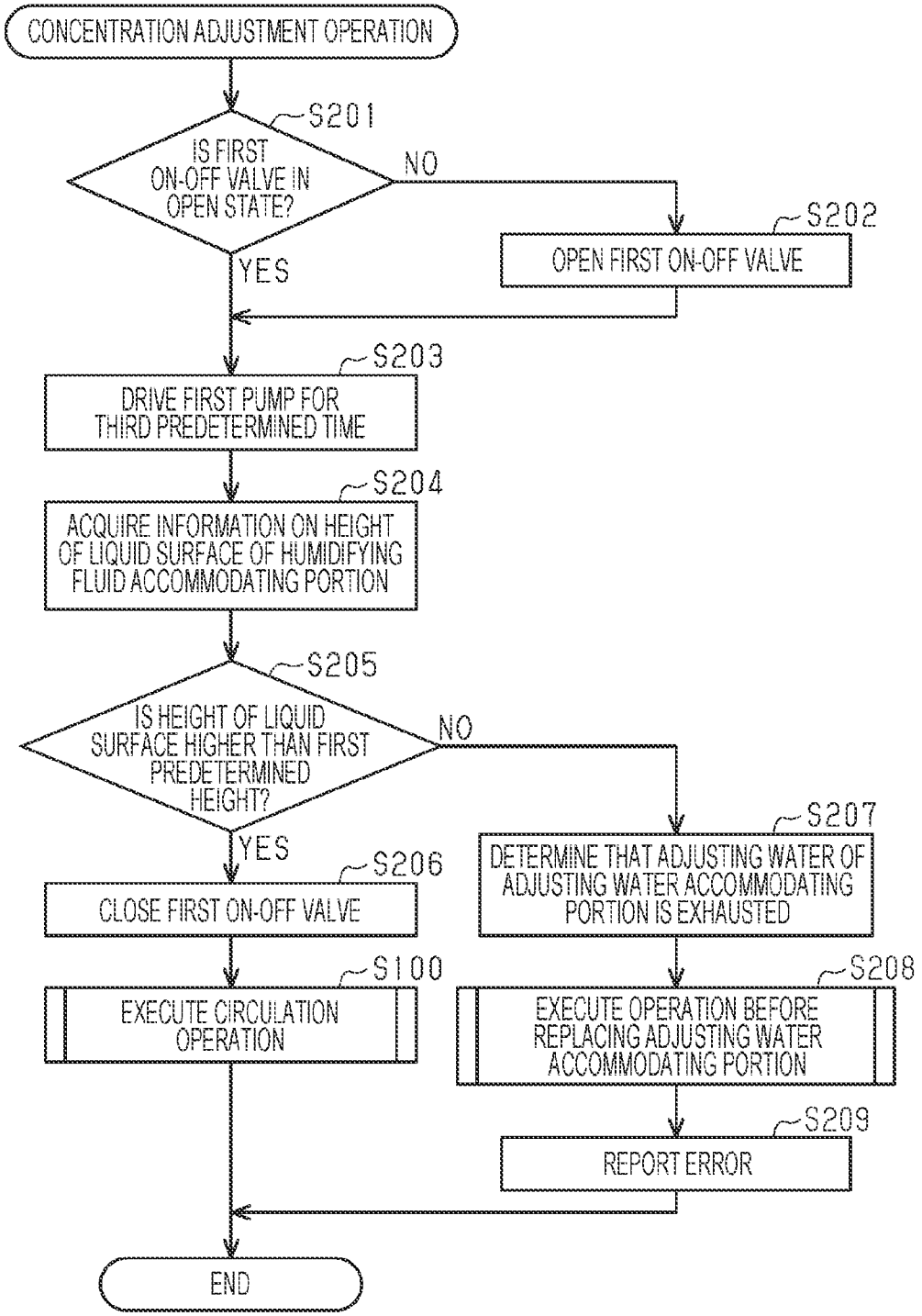
FIG. 18 is a flowchart showing a concentration adjustment operation.

The memory 96 stores a plurality of programs including a program shown in a flowchart in FIG. 17 for causing the CPU 95 of the controller 90 to execute a circulation operation and a program shown in a flowchart in FIG. 18 for causing the CPU 95 to execute a concentration adjustment operation.

About Circulation Operation of Humidifying Fluid

A circulation operation in a maintenance method for the capping device will be described.

Figure 19:
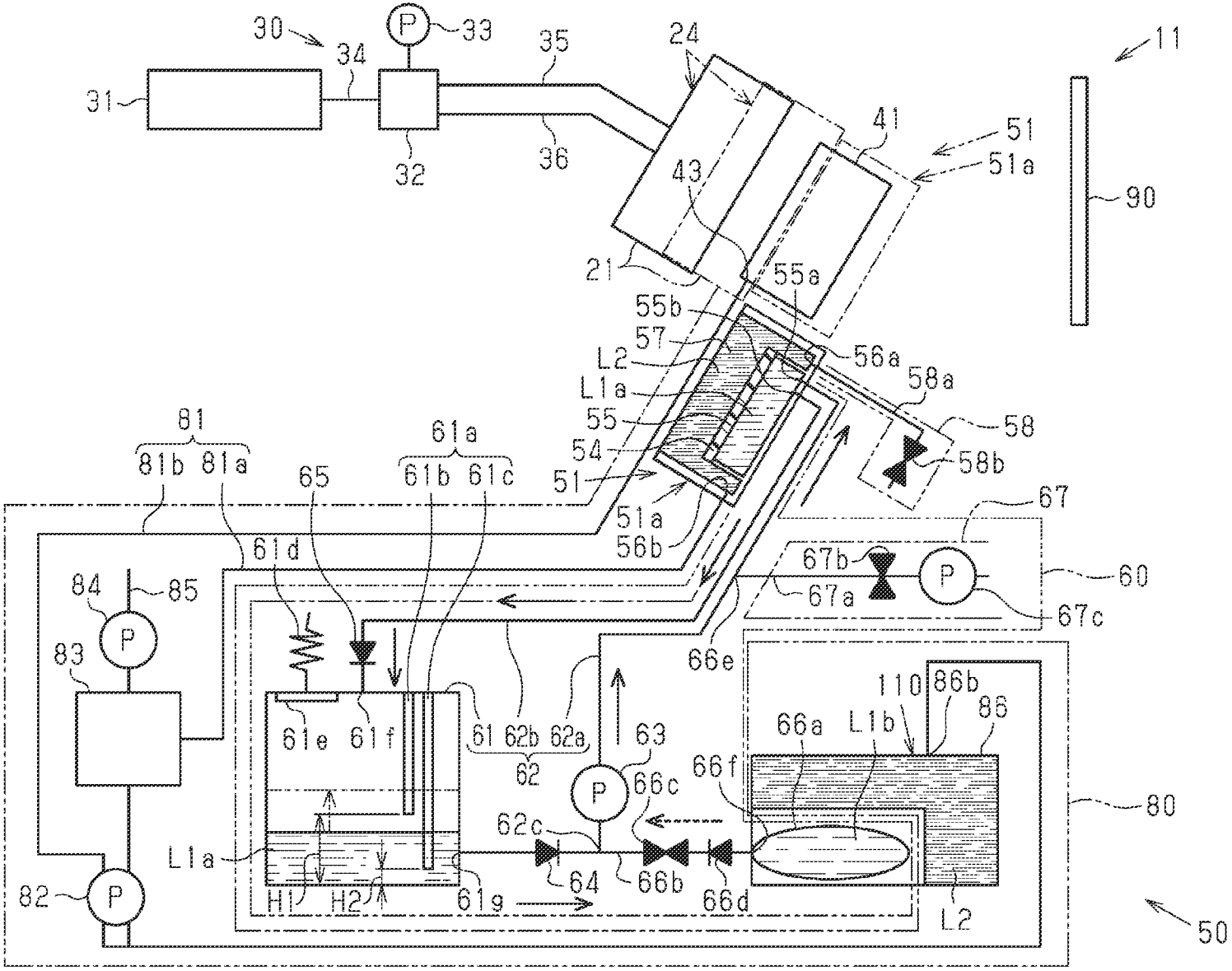
FIG. 19 is a schematic view showing a state of a humidifying fluid when the circulation operation and the concentration adjustment operation are executed.

As shown in FIG. 19, the capping device 50 performs the circulation operation. In the circulation operation, the controller 90 controls the humidifying fluid circulation mechanism 60 to cause the humidifying fluid L1*a* in the circulation path 62 to flow in the direction of a solid arrow shown in FIG. 19 in a state where the first on-off valve 66*c* is closed. Then, the controller 90 checks the amount of moisture evaporated from the humidifying fluid L1*a*.

The circulation path is constituted by the humidifying fluid accommodating portion 61 accommodating the humidifying fluid L1*a* containing water for humidifying the closed space SP shown in FIG. 4, the supply flow path 62*a* through which the humidifying fluid accommodating portion 61 and the cap 51*a* communicate with each other, the recovery flow path 62*b* allowing the cap 51*a* and the humidifying fluid accommodating portion 61 to communicate with each other, and the humidifying chamber 55 in the cap 51*a* shown in FIG. 4. It is desirable that the internal pressure in the cap 51*a* at the time of the circulation operation be set to be equal to or lower than the meniscus pressure resistance of the liquid ejecting head 21 by adjusting the circulation flow rate by the first pump 63.

As shown in FIG. 19, in the circulation operation of the humidifying fluid L1*a*, the humidifying fluid L1*a* flows through the circulation path 62 in the direction of the solid arrow shown in FIG. 19 to circulate in the circulation path. By the controller 90 causing the humidifying fluid L1*a* to flow in the circulation path 62, the humidifying fluid L1*a* flows through the single-way, winding flow path in the humidifying chamber 55. Moisture from the humidifying fluid L1*a* evaporates mainly in the humidifying chamber 55 in the cap 51*a*. Then, for example, at the timing when the humidifying fluid L1*a* in the humidifying chamber 55 flows into the humidifying fluid accommodating portion 61 and the humidifying fluid L1*a* in the humidifying fluid accommodating portion 61 flows into the humidifying chamber 55, the controller 90 stops the flow of the humidifying fluid L1*a* and checks the amount of moisture evaporated from the humidifying fluid L1*a*. That is, the purpose of the circulation operation in the maintenance method for the capping device 50 includes checking the amount of moisture evaporated from the humidifying fluid L1*a*.

As shown in FIG. 19, the controller 90 manages the time by a timer or the like and regularly executes the circulation operation. For example, when the liquid ejecting apparatus 11 is powered on, the controller 90 executes the circulation operation once a day. At the end of a procedure of the circulation operation described later, the controller 90 acquires information on the liquid surface height in the humidifying fluid accommodating portion 61 from the detecting portion 61*a* in order to check the amount of moisture evaporated from the humidifying fluid L1*a*. When the amount of moisture evaporated in the cap 51*a* is large, the liquid surface height in the humidifying fluid accommodating portion 61 is low. The amount of moisture evaporated increases during the time when the cap 51*a* is positioned at the retreat position shown in FIGS. 2 and 5, that is, the time when the cap 51*a* does not form the closed space SP surrounding the openings 22*a* of the nozzles 22 shown in FIG. 4. Therefore, the controller 90 may manage the time when the cap 51*a* is positioned in the retreat position and perform the circulation operation for each temperature and humidity environment. The controller 90 may execute the circulation operation even before the liquid ejecting apparatus 11 is installed and the first recording is made on the medium M, before the cap unit 51 is replaced with a new cap unit 51 and the first recording is made on the medium M, or before the adjusting water accommodating portion 66*a* is replaced with the full adjusting water accommodating portion 66*a* and the first recording is made on the medium M.

In order to reduce the frequency of circulation operation, it is desirable that the humidifying fluid accommodating portion 61 has a large area of the liquid surface as compared with the depth inside the humidifying fluid accommodating portion 61. Thereby, the change in the height of the liquid surface can be reduced when the amount of the liquid in the humidifying fluid accommodating portion 61 changes due to the evaporation of the moisture contained in the humidifying fluid L1*a*. Further, in order to make as gentle as possible the change in the concentration of the humidifying fluid L1*a* due to the evaporation of the moisture contained in the humidifying fluid L1*a* from the humidifying fluid L1*a*, it is desirable that the volume of the humidifying fluid accommodating portion 61 is as large as possible within the size of the liquid ejecting apparatus 11.

About Concentration Adjustment Operation of Humidifying Fluid

The concentration adjustment operation in the maintenance method for the capping device will be described.

As shown in FIG. 19, the capping device 50 performs the concentration adjustment operation. In the concentration adjustment operation, the controller 90 controls the humidifying fluid circulation mechanism 60 to cause the humidifying fluid L1*a* in the circulation path 62 to flow in the direction of a solid arrow shown in FIG. 19 in a state where the first on-off valve 66*c* is open. At this time, since the first on-off valve 66*c* is in the open state, the adjusting water L1*b* in the adjusting water supply portion 66 flows in the direction of a broken line arrow shown in FIG. 19 and is supplied into the circulation path 62. That is, the concentration adjustment operation in the maintenance method for the capping device 50 includes supplying the adjusting water L1*b* into the circulation path 62 by the adjusting water supply portion 66 and causing the humidifying fluid L1*a* to flow in the circulation path 62.

The concentration adjustment operation is executed by the controller 90 when, at the end of the circulation operation procedure described above, it is detected by the detecting portion 61*a* that the height of the liquid surface in the humidifying fluid accommodating portion 61 when the controller 90 acquires information on the height of the liquid surface in the humidifying fluid accommodating portion 61 is lower than the first predetermined height H1. That is, when the concentration adjustment operation is performed when the detecting portion 61*a* detects that the liquid surface in the humidifying fluid accommodating portion 61 is below the predetermined height, the capping device 50 supplies the adjusting water L1*b* in the adjusting water accommodating portion 66*a* into the circulation path 62 until it is detected that the liquid surface is or is above the predetermined height. Then, thereafter, the humidifying fluid L1*a* is caused to flow in the circulation path 62.

Moisture evaporates from the humidifying fluid L1*a* in the cap 51*a*, and the humidifying fluid L1*a* circulates in the circulation path 62 by the above-mentioned circulation operation. Thereby, the moisture in the humidifying fluid accommodating portion 61 is also reduced, and the height of the liquid surface in the humidifying fluid accommodating portion 61 is lowered. As the evaporation progresses further, the height of the liquid surface in the humidifying fluid accommodating portion 61 becomes lower than the first predetermined height H1. The first predetermined height H1 is set such that the concentration of the humidifying fluid L1*a* at this time becomes higher than the predetermined concentration. By the controller 90 executing the concentration adjustment operation, the adjusting water L1*b* in the adjusting water accommodating portion 66*a* is supplied into the circulation path 62 such that the liquid surface thereof becomes higher than the first predetermined height H1. Thereby, substantially the same amount of water as that evaporated in the cap 51*a* is supplied into the circulation path 62, and the concentration of the humidifying fluid L1*a* becomes smaller than the predetermined concentration. That is, the concentration of the humidifying fluid L1*a* returns to the concentration of the humidifying fluid L1*a* before the moisture evaporates in the cap 51*a*.

In the concentration adjustment operation, the controller 90 opens the first on-off valve 66*c* and supplies the adjusting water L1*b* in the adjusting water accommodating portion 66*a* into the circulation path 62. Then, when the controller 90 determines that the height of the liquid surface in the humidifying fluid accommodating portion 61 is higher than the first predetermined height H1, the first on-off valve 66*c* is closed and the above-mentioned circulation operation is performed to allow the humidifying fluid L1*a* in the humidifying fluid accommodating portion 61 to flow in the circulation path 62. That is, the concentration adjustment operation in the maintenance method for the capping device 50 includes opening the first on-off valve 66*c* when the adjusting water L1*b* in the adjusting water accommodating portion 66*a* is supplied into the circulation path 62, and closing the first on-off valve 66*c* when the humidifying fluid L1*a* is made to flow in the circulation path 62.

In the first merging portion 62*c* of the circulation path 62, the humidifying fluid L1*a* flowing from the humidifying fluid accommodating portion 61 and the adjusting water L1*b* flowing from the adjusting water supply portion 66 merge. When the volume of the adjusting water L1*b* flowing from the adjusting water supply portion 66 is larger than the volume of the humidifying fluid L1*a* flowing from the humidifying fluid accommodating portion 61, the rate of change in the height of the liquid surface in the humidifying fluid accommodating portion 61 becomes faster and the liquid surface detection variation becomes large, which makes it difficult to detect the height of the liquid surface at the right time. Therefore, in the first merging portion 62*c*, it is desirable that the pressure loss of the flow path close to the adjusting water supply portion 66 is set to be the same as or larger than the pressure loss of the flow path close to the humidifying fluid accommodating portion 61.

About Cap Replacement Preparation Operation

Further, when the cap 51*a* is replaced, a cap replacement preparation operation is performed. The cap replacement preparation operation is an operation performed by the capping device 50 when the cap 51*a* is replaced. Before the cap 51*a* is replaced, the humidifying fluid L1*a* in the cap 51*a* is recovered. In the capping device 50 of the present embodiment, when the cap is replaced, the cap unit 51 shown in FIG. 3 is replaced. A configuration in which the cap 51*a* is individually replaced may be employed.

At the time of the cap replacement preparation operation, in a state where the first on-off valve 66*c* is closed and when the second on-off valve 67*b* is open, the controller 90 controls the pressurized air supply portion 67 of the humidifying fluid circulation mechanism 60 to cause pressurized air to flow in the pressurized air supply path 67*a* in the direction of the broken line arrow shown in FIG. 17. At this time, the pressurized air supply portion 67 supplies the pressurized air into the circulation path 62, and thus the humidifying fluid L1*a* in the flow path from the second merging portion 66*e* to the inlet portion 61*f* in the circulation paths formed by the circulation path 62 is pushed into the humidifying fluid accommodating portion 61. Then, the flow path from the second merging portion 66*e* to the inlet portion 61*f* is filled with air. Thereby, the humidifying fluid L1*a* in the cap 51*a* is recovered in the humidifying fluid accommodating portion 61.

Since the moisture in the humidifying fluid L1*a* evaporates in the cap 51*a*, the concentration of the humidifying fluid L1*a* in the cap 51*a* is high. Thereby, when the humidifying fluid L1*a* in the cap 51*a* is recovered in the humidifying fluid accommodating portion 61, the concentration of the humidifying fluid L1*a* in the humidifying fluid accommodating portion 61 becomes high. Further, when the humidifying fluid L1*a* in the cap 51*a* is recovered in the humidifying fluid accommodating portion 61, a small amount of the humidifying fluid L1*a* having a high concentration remains in the cap 51*a*. As a result, the amount of the humidifying fluid L1*a* in the humidifying fluid accommodating portion 61 is reduced by that amount.

Operation Before Replacing Adjusting Water Accommodating Portion.

When it is determined that the adjusting water L1*b* in the adjusting water accommodating portion 66*a* is exhausted, an operation before replacing the adjusting water accommodating portion, which is performed before replacing the adjusting water accommodating portion 66*a*, will be described.

The operation before replacing the adjusting water accommodating portion is an operation executed by the controller 90 when the amount of the adjusting water L1*b* in the adjusting water accommodating portion 66*a* reaches an amount at which the determination is to be made that replacement of the adjusting water accommodating portion 66*a* is required. In the present embodiment, the adjusting water accommodating portion 66*a* is accommodated in the same waste liquid box 110 as the waste liquid accommodating portion 86, and thus the controller 90 executes the operation before replacing the adjusting water accommodating portion even at the replacement time when the waste liquid accommodating portion 86 is fully filled with the waste liquid L2.

In the present embodiment, when the first pump 63 is driven by for the third predetermined time T3 in the above-mentioned concentration adjustment operation, the controller 90 determines that the adjusting water in the adjusting water accommodating portion 66*a* is exhausted when it is detected by the detecting portion 61*a* that the height of the liquid surface in the humidifying fluid accommodating portion 61 is lower than the first predetermined height H1. That is, when the concentration of the humidifying fluid L1*a* in the circulation path 62 cannot be returned to the concentration before the moisture evaporates in the cap 51*a*, the controller 90 determines that the adjusting water accommodating portion 66*a* is required to be replaced.

When it is determined that the adjusting water accommodating portion 66*a* is required to be replaced, the controller 90 executes an operation such as the cap replacement preparation operation described above. Then, after the humidifying fluid L1*a* in the cap 51*a* is recovered, until the adjusting water accommodating portion 66*a* is replaced, a first parameter table for flushing is switched to a second parameter table when the adjusting water L1*b* in the adjusting water accommodating portion 66*a* is exhausted.

The parameter table is a table in which the conditions and the number of times flushing is performed are described, and flushing is performed based on this table. When the humidifying fluid L1*a* in the cap 51*a* is recovered, the closed space SP in the cap 51*a* is not humidified by the humidifying fluid L1*a*, and accordingly, the controller 90 executes empty ejection, which is an ejection of a liquid not related to printing, to the closed space SP in the cap 51*a* to humidify the nozzles 22. Therefore, the conditions and the number of times of flushing are changed to parameters suitable for humidifying the nozzles 22.

Until the adjusting water accommodating portion 66*a* is replaced, the above-mentioned circulation operation that has been performed regularly up until then is not executed. When the adjusting water accommodating portion 66*a* is replaced, the controller 90 starts the above-mentioned concentration adjustment operation after returning the second parameter table to the first parameter table before the parameter table is switched. Then, thereafter, the above-mentioned circulation operation is also regularly executed.

About Liquid Ejected by Liquid Ejecting Head

The ink ejected by the liquid ejecting apparatus 11 will be described in detail below.

The ink used in the liquid ejecting apparatus 11 contains a resin in constitution, and does not substantially contain glycerin with a boiling point at one atmosphere of 290° C. If the ink substantially contains glycerin, the drying properties of the ink significantly decrease. As a result, in various media, in particular, in a medium which is non-absorbent or has low absorbency to ink, not only light and dark unevenness in the image is noticeable, but also fixability of the ink is not obtained. It is preferable that the ink does not substantially contain alkyl polyols (except glycerin described above) having a boiling point corresponding to one atmosphere is 280° C. or higher.

Here, the wording "does not substantially contain" in the specification means that an amount or more which sufficiently exhibits the meaning of adding is not contained. To put this quantitatively, it is preferable that glycerin be not included at 1.0% by mass or more with respect to the total mass (100% by mass) of the ink, not including 0.5% by mass or more is more preferable, not including 0.1% by mass or more is further preferable, not including 0.05% by mass or more is even more preferable, and not including 0.01% by mass or more is particularly preferable. It is most preferable that 0.001% by mass or more of glycerin be not included.

Next, additives (components) which are included in or may be included in the ink will be described.

1. Coloring Material

The ink may contain a coloring material. The coloring material is selected from a pigment and a dye.

1-1. Pigment

It is possible to improve light resistance of the ink by using a pigment as the coloring material. Either of an inorganic pigment or an organic pigment may be used as the pigment. Although not particularly limited, examples of the inorganic pigment include carbon black, iron oxide, titanium oxide and silica oxide.

Although not particularly limited, examples of the organic pigment include quinacridone-based pigments, quinacridonequinone-based pigments, dioxazine-based pigments, phthalocyanine-based pigments, anthrapyrimidine-based pigments, anthanthrone-based pigments, indanthrone-based pigments, flavanthrone-based pigments, perylene-based pigments, diketo-pyrrolo-pyrrole-based pigments, perinone-based pigments, quinophthalone-based pigments, anthraquinone-based pigments, thioindigo-based pigments, benzimidazolone-based pigments, isoindolinone-based pigments, azomethine-based pigments and azo-based pigments. Specific examples of the organic pigment include substances as follows.

Examples of the pigment used in the cyan ink include C.I. Pigment Blue 1, 2, 3, 15, 15:1, 15:2, 15:3, 15:4, 15:6, 15:34, 16, 18, 22, 60, 65, and 66, and C.I. Vat Blue 4 and 60. Among these substances, either of C.I. Pigment Blue 15:3 and 15:4 is preferable.

Examples of the pigment used in the magenta ink include C.I. Pigment Red 1, 2, 3, 4, 5, 6, 7, 8, 9, 10, 11, 12, 14, 15, 16, 17, 18, 19, 21, 22, 23, 30, 31, 32, 37, 38, 40, 41, 42, 48(Ca), 48(Mn), 57(Ca), 57:1, 88, 112, 114, 122, 123, 144, 146, 149, 150, 166, 168, 170, 171, 175, 176, 177, 178, 179, 184, 185, 187, 202, 209, 219, 224, 245, 254, and 264, and C.I. Pigment Violet 19, 23, 32, 33, 36, 38, 43, and 50. Among these substances, one type or more selected from a group consisting of C.I. Pigment Red 122, C.I. Pigment Red 202, and C.I. Pigment Violet 19 are preferable.

Examples of the pigment used in the yellow ink include C.I. Pigment Yellow 1, 2, 3, 4, 5, 6, 7, 10, 11, 12, 13, 14, 16, 17, 24, 34, 35, 37, 53, 55, 65, 73, 74, 75, 81, 83, 93, 94, 95, 97, 98, 99, 108, 109, 110, 113, 114, 117, 120, 124, 128, 129, 133, 138, 139, 147, 151, 153, 154, 155, 167, 172, 180, 185, and 213. Among these substances, one type or more selected from a group consisting of C.I. Pigment Yellow 74, 155, and 213 are preferable.

Examples of pigments used in other colors of ink, such as green ink and orange ink, include pigments known in the related art.

It is preferable that the average particle diameter of the pigment be equal to or less than 250 nm in order to be able to suppress clogging in the nozzles 22 and to cause the ejection stability to be more favorable. The average particle diameter in the specification is volumetric basis. As a measurement method, for example, it is possible to perform measurement with a particle size distribution analyzer in which a laser diffraction scattering method is the measurement principle. Examples of the particle size distribution analyzer include a particle size distribution meter (for example, Microtrac UPA manufactured by Nikkiso Co., Ltd.) in which dynamic light scattering is the measurement principle.

1-2. Dye

A dye may be used as the coloring material. Although not particularly limited, acid dyes, direct dyes, reactive dyes, and basic dyes can be used as the dye. The content of the coloring material is preferably 0.4% to 12% by mass with respect to the total mass (100% by mass) of the ink, and is more preferably 2% by mass or more and 5% by mass or less.

2. Resin

The ink contains a resin. The ink contains a resin, and thus a resin coating film is formed on a medium, and as a result, the ink is sufficiently fixed on the medium, and an effect of favorable abrasion resistance of the image is mainly exhibited. Thus, the resin emulsion is preferably a thermoplastic resin. The thermal deformation temperature of the resin is preferably equal to or higher than 40° C. and more preferably equal to or higher than 60° C., in order to obtain advantageous effects in that clogging of the nozzles 22 does not easily occur, and the abrasion resistance of the medium is maintained.

Here, the "thermal deformation temperature" in the present specification is a temperature value represented by a glass transition temperature (Tg) or a minimum film forming temperature (MFT). That is, "a thermal deformation temperature of 40° C. or higher" means that either of the Tg or the MFT may be 40° C. or higher. Since the MFT is superior to the Tg for easily grasping redispersibility of the resin, the thermal deformation temperature is preferably the temperature value represented by the MFT. If the ink is excellent in redispersibility of the resin, the nozzles 22 are not easily clogged because the ink is not fixed.

Although not particularly limited, specific examples of the thermoplastic resin include (meth)acrylic polymers, such as poly(meth)acrylic ester or copolymers thereof, polyacrylonitrile or copolymers thereof, polycyanoacrylate, polyacrylamide, and poly(meth)acrylic acid; polyolefin-based polymers, such as polyethylene, polypropylene, polybutene, polyisobutylene, polystyrene and copolymers thereof, petroleum resins, coumarone-indene resins and terpene resins; vinyl acetate or vinyl alcohol polymers, such as polyvinyl acetate or copolymers thereof, polyvinyl alcohol, polyvinyl acetal, and polyvinyl ether; halogen-containing polymers, such as polyvinyl chloride or copolymers thereof, polyvinylidene chloride, fluororesins and fluororubbers; nitrogen-containing vinyl polymers, such as polyvinyl carbazole, polyvinylpyrrolidone or copolymers thereof, polyvinylpyridine, or polyvinylimidazole; diene based polymers, such as polybutadiene or copolymers thereof, polychloroprene and polyisoprene (butyl rubber); and other ring-opening polymerization type resins, condensation polymerization-type resins and natural macromolecular resins.

The content of the resin is preferably 1% to 30% by mass with respect to the total mass (100% by mass) of the ink, and 1% to 5% by mass is more preferable. When the content is in the above-described range, it is possible further improve glossiness and abrasion resistance of the coated image to be formed. Examples of the resin which may be included in the ink include a resin dispersant, a resin emulsion, and a wax.

2-1. Resin Emulsion

The ink may contain a resin emulsion. The resin emulsion forms a resin coating film preferably along with a wax (emulsion) when the medium is heated, and thus the ink is sufficiently fixed onto the medium, and the resin emulsion exhibits an effect of improving abrasion resistance of the image, accordingly. In a case of printing the medium with an ink which contains a resin emulsion according to the above effects, the ink has particularly excellent abrasion resistance on a medium which is non-absorbent or has low absorbency to ink.

The resin emulsion which functions as a binder is contained in the ink, in an emulsion state. The resin which functions as the binder is contained in the ink in the emulsion state, and thus it is possible to easily adjust the viscosity of the ink to an appropriate range in an ink jet recording method, and to improve the storage stability and ejection stability of the ink.

Although not limited to the following, examples of the resin emulsion include homopolymers or copolymers of (meth)acrylate, (meth)acrylic ester, acrylonitrile, cyanoacrylate, acrylamide, olefin, styrene, vinyl acetate, vinyl chloride, vinyl alcohol, vinyl ether, vinyl pyrrolidone, vinyl pyridine, vinyl carbazole, vinyl imidazole, and vinylidene chloride, fluororesins, and natural resins. Among these substances, either of a methacrylic resin and a styrene-methacrylate copolymer resin is preferable, either of an acrylic resin and a styrene-acrylate copolymer resin is more preferable, and a styrene-acrylate copolymer resin is still more preferable. The above copolymers may have a form of any of random copolymers, block copolymers, alternating copolymers, and graft copolymers.

The average particle diameter of the resin emulsion is preferably in a range of 5 nm to 400 nm, and more preferably in a range 20 nm to 300 nm, in order to further improve the storage stability and ejection stability of the ink. The content of the resin emulsion among the resins is preferably in a range of 0.5% to 7% by mass to the total mass (100% by mass) of the ink. If the content is in the above range, it is possible to reduce the solid content concentration, and to further improve the ejection stability.

2-2. Wax

The ink may contain a wax. The ink contains the wax, and thus fixability of the ink on a medium which is non-absorbent or with low absorbency to ink is more excellent. Among these, it is preferable that the wax be an emulsion type. Although not limited to the following, examples of the wax include a polyethylene wax, a paraffin wax, and a polyolefin wax, and among these, a polyethylene wax, described later, is preferable. In the present specification, the "wax" mainly means a substance in which solid wax particles are dispersed in water using a surfactant which will be described later.

The ink contains a polyethylene wax, and thus it is possible to improve the abrasion resistance of the ink. The average particle diameter of a polyethylene wax is preferably in a range of 5 nm to 400 nm, and more preferably in a range 50 nm to 200 nm, in order to further improve the storage stability and ejection stability of the ink.

The content (solid content conversion) of the polyethylene wax is independently of one another and is preferably in a range of 0.1% to 3% by mass with respect to the total mass (100% by mass) of the ink, a range of 0.3% to 3% by mass is more preferable, and a range of 0.3% to 1.5% by mass is further preferable. If the content is in the above ranges, it is possible to favorably solidify and fix the ink even on a medium that is non-absorbent or with low absorbency to ink, and it is possible to further improve the storage stability and ejection stability of the ink.

3. Surfactant

The ink may contain a surfactant. Although not limited to the following, examples of the surfactant include nonionic surfactants. The nonionic surfactant has an action of evenly spreading the ink on the medium. Therefore, when printing is performed by using an ink including the nonionic surfactant, a high definition image with very little bleeding is obtained. Although not limited to the following, examples of such a nonionic surfactant include silicon-based, polyoxyethylene alkylether-based, polyoxypropylene alkylether-based, polycyclic phenyl ether-based, sorbitan derivative and fluorine-based surfactants, and among these a silicon-based surfactant is preferable.

The content of the surfactant is preferably in a range of 0.1% by mass or more and 3% by mass or less with respect to the total mass (100% by mass) of the ink, in order to further improve the storage stability and ejection stability of the ink.

4. Organic Solvent

The ink may include a known volatile water-soluble organic solvent. As described above, it is preferable that the ink does not substantially contain glycerin (boiling point at one atmosphere of 290° C.) which is one type of an organic solvent, and do not substantially contain alkyl polyols (excluding glycerin described above) having a boiling point corresponding to one atmosphere of 280° C. or higher.

5. Aprotic Polar Solvent

The ink may contain an aprotic polar solvent. The ink contains an aprotic polar solvent, and thus the above-described resin particles included in the ink are dissolved, and thus, it is possible to effectively suppress clogging of the nozzles 22 at a time of printing. Since the aprotic polar solvent has properties of dissolving a medium such as vinyl chloride, adhesiveness of an image is improved.

Although not particularly limited, the aprotic polar solvent preferably includes one type or more selected from pyrrolidones, lactones, sulfoxides, imidazolidinones, sulfolanes, urea derivatives, dialkylamides, cyclic ethers, and amide ethers. Representative examples of the pyrrolidones include 2-pyrrolidone, N-methyl-2-pyrrolidone, and N-ethyl-2-pyrrolidone, representative examples of the lactones include γ-butyrolactone, γ-valerolactone, and ε-caprolactone, and representative examples of the sulfoxides include dimethyl sulfoxide, and tetramethylene sufloxide.

Representative examples of the imidazolidinones include 1,3-dimethyl-2-imidazolidinone, representative examples of the sulfolanes include sulfolane, and dimethyl sulfolane, and representative examples of the urea derivatives include dimethyl urea and 1,1,3,3-tetramethyl urea. Representative examples of the dialkylamides include dimethyl formamide and dimethylacetamide, and representative examples of the cyclic ethers include 1,4-dioxsane, and tetrahydrofuran.

Among these substances, pyrrolidones, lactones, sulfoxides and amide ethers, are particularly preferable from a viewpoint of the above-described effects, and 2-pyrrolidone is the most preferable. The content of the above-described aprotic polar solvent is preferably in a range of 3% to 30% by mass with respect to the total mass (100% by mass) of the ink, and is more preferably in a range of 8% to 20% by mass.

6. Other Components

The ink may further include a fungicide, an antirust agent, a chelating agent, and the like in addition to the above components.

About Humidifying Fluid

Next, the components of the surfactant mixed into the humidifying fluid L1*a* will be described.

As the surfactant, cationic surfactants such as alkylamine salts and quaternary ammonium salts; anionic surfactant such as dialkyl sulfosuccinate salts, alkyl naphthalene sulfosuccinate salts and fatty acid salts; amphoteric surfactants, such as alkyl dimethyl amine oxide, and alkylcarboxybetaine; nonionic surfactants such as polyoxyethylene alkyl ethers, polyoxyethylene alkyl allyl ethers, acetylene glycols, and polyoxyethylene-polyoxypropylene block copolymers may be used; among these substances, particularly, anionic surfactants or nonionic surfactants are preferable.

The content of the surfactant is preferably 0.1% to 5.0% by mass with respect to the total mass of the humidifying fluid L1*a*. The content of the surfactant is preferably 0.5% to 1.5% by mass with respect to the total mass of the humidifying fluid L1*a*, from a viewpoint of foamability and defoaming properties after forming air bubbles. The surfactant may be used singly or in a combination of two or more. It is preferable that the surfactant contained in the humidifying fluid L1*a* be the same as the surfactant contained in the ink (liquid). For example, when the surfactant contained in the ink (liquid) is a nonionic surfactant, although not limited to the following, examples of nonionic surfactants include silicon-based surfactants, polyoxy ethylene alkylether-based surfactants, polyoxy propylene alkyl ether-based surfactants, polycyclic phenyl ether-based surfactants, sorbitan derivatives, and fluorine-based surfactants; among these substances, silicon-based surfactants are preferable.

In particular, it is preferable that an adduct in which 4 to 30 added mols of ethyleneoxide (EO) are added to acetylene diol be used as the surfactant, in order that the heights of foams directly after foaming and after five minutes elapses from the foaming, which are obtained by using the Ross Miles method are set to be in the above range (foam height directly after foaming is equal to or higher than 50 mm, and foam height after five minutes elapses from the foaming is equal to or lower than 5 mm), and the content of the adduct be 0.1% to 3.0% by weight with respect to the total weight of a cleaning solution. Further, it is preferable that an adduct in which 10 to 20 added mols of ethyleneoxide (EO) are added to acetylene diol, in order that the heights of foams directly after foaming and after five minutes elapses from the foaming, which are obtained by using the Ross Miles method is set to be in the above preferable range (foam height directly after foaming is equal to or higher than 100 mm, and foam height after five minutes elapses from the foaming is equal to or lower than 5 mm), and the content of the adduct be 0.5% to 1.5% by weight with respect to the total weight of the cleaning solution. If the content of the ethyleneoxide adduct of acetylene diol is excessively high, there is a concern of reaching the critical micelle concentration and forming an emulsion.

The surfactant has a function of causing wetting and spreading of the water-based ink on a recording medium to be easily performed. The surfactants able to be used in the present disclosure are not particularly limited, and examples thereof include anionic surfactants such as dialkyl sulfosuccinate salts, alkyl naphthalene sulfosuccinate salts, fatty acid salts; nonionic surfactants such as polyoxyethylene alkyl ethers, polyoxyethylene alkyl allyl ethers, acetylene glycols, and polyoxyethylene-polyoxypropylene block copolymers; cationic surfactants such as alkyl amine salts and quaternary ammonium salts; silicon-based surfactants, and fluorine-based surfactants.

The surfactant has an effect of causing aggregations to be divided and dispersed by a surface activity effect between the humidifying fluid L1*a* and the aggregation. Because of the ability to lower the surface tension of the cleaning solution, there is an effect that the cleaning solution easily performs infiltration between the aggregation and the nozzle surface 23, and the aggregation is easily peeled from the nozzle surface 23.

It is possible to suitably use any surfactant as long as the compound has a hydrophilic portion and a hydrophobic portion in the same molecule. Specific examples thereof preferably include compounds represented by Formulas (I) to (IV). That is, examples include a polyoxyethylene alkyl phenyl ether-based surfactant in Formula (I), an acetylene glycol-based surfactant in Formula (II), a polyoxyehtylene-alkyl ether-based surfactants in Formula (III), and a polyoxyethylene polyoxypropylenealkyl ether-based surfactants in Formula (IV).

(I)

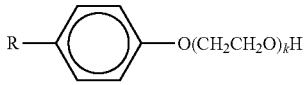

(R is a hydrocarbon chain which has 6 to 14 carbon atoms and may be branched, and k: 5 to 20)

(II)

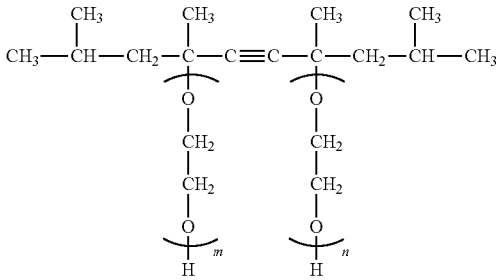

(m, n ≤ 20, 0 < m + n ≤ 40)

(III)

(R is a hydrocarbon chain which has 6 to 14 carbon atoms and may be branched, and n is 5 to 20)

(IV)

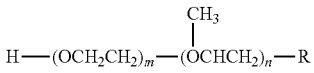

(R is a hydrocarbon chain having 6 to 14 carbon atoms and m and n are numerals of 20 or lower)

The followings may be used as the surfactant in addition to the compounds in Formulas (I) to (IV): alkyl and aryl ethers of polyhydric alcohols such as diethylene glycol monophenyl ether, ethylene glycol monophenyl ether, ethylene glycol monoallyl ether, diethylene glycol monophenyl ether, diethylene glycol mono-butyl ether, propylene glycol mono-butyl ether, and tetraethylene glycol chlorophenyl ether, nonionic surfactants such as polyoxyethylene polyoxypropylene block copolymers and fluorine-based surfactants, and lower alcohols such as ethanol and 2-propanol. In particular, diethylene glycol mono-butyl ether is preferable.

Operation

The operation of the present embodiment will be described.

The liquid ejecting apparatus 11 is assembled and a humidifying fluid filling operation is performed before shipment from the factory, and the liquid ejecting apparatus 11 is shipped from the factory in a state where a predetermined amount of the humidifying fluid L1*a* is accommodated in the humidifying fluid accommodating portion 61. At the time of shipment, the humidifying fluid L1*a* in the cap 51*a* is discharged in advance, and the cap 51*a* is in a state where there is almost no humidifying fluid L1*a*.

When the liquid ejecting apparatus 11 shipped from the factory reaches the user, the liquid ejecting apparatus 11 is installed by the user. The user mounts the waste liquid box 110 on the mounting portion 100 of the liquid ejecting apparatus 11. As a result, the waste liquid accommodating portion 86 is coupled to the first waste liquid flow path 81*a*, and the adjusting water accommodating portion 66*a* is coupled to the adjusting water supply flow path 66*b*. Then, the user performs an initial operation using the operation portion 15 before using the liquid ejecting apparatus 11 for printing. The controller 90 executes the circulation operation procedure shown in FIG. 17 as the preparation operation. When the first circulation operation is completed, the liquid ejecting apparatus 11 can perform recording on the medium M. Then, the controller 90 manages at least one of the recording time, the elapsed time from the end of the previous circulation operation, and the like by the timer, and performs the circulation operation at a predetermined timing when the time reaches a set time.

Next, a circulation operation procedure executed by the controller 90 will be described with reference to the flowchart shown in FIG. 17.

In step S101, the controller 90 determines whether or not the first on-off valve 66*c* is in the closed state. When the first on-off valve 66*c* is in the closed state, the flow proceeds to step S103. When the first on-off valve 66*c* is in the open state, the flow proceeds to step S102. Then, in step S102, the controller 90 closes the first on-off valve 66*c*.

In step S103, the controller 90 drives the first pump 63 for a first predetermined time T1 in a state where the first on-off valve 66*c* is closed. Thereby, as shown in FIG. 19, the humidifying fluid L1*a* flows in the circulation path 62 in the direction of the solid arrow shown in FIG. 19.

In step S104, the controller 90 stops the first pump 63 for a second predetermined time T2 in a state where the first on-off valve 66*c* is closed. Thereby, the liquid surface state in the humidifying fluid accommodating portion 61 is stabilized. In addition, in order to shorten the time until the liquid surface state stabilizes, the area of the liquid surface is made large as compared with the depth inside the humidifying fluid accommodating portion 61, and thus it is desirable to reduce the amount of change in the height of the liquid surface when the amount of liquid in the humidifying fluid accommodating portion 61 changes.

In step S105, the controller 90 acquires information on the height of the liquid surface in the humidifying fluid accommodating portion 61 from the detecting portion 61*a*. Then, in step S106, the controller 90 determines whether or not the height of the liquid surface is higher than the first predetermined height H1. When the height of the liquid surface is higher than the first predetermined height H1, the procedure ends.

When the height of the liquid surface is lower than the first predetermined height H1, the flow proceeds to step S200. Then, in step S200, the controller 90 executes a subroutine of a concentration adjustment operation described later. When the subroutine of the concentration adjustment operation is completed, the controller 90 ends the procedure.

The humidifying fluid L1*a* can be circulated in the cap 51*a* by the circulation operation shown in FIG. 19 before recording for the first time after installation with the liquid ejecting apparatus 11. Then, the humidifying chamber 55 in the cap 51*a* can be filled with the humidifying fluid L1*a*.

When the liquid ejecting apparatus 11 performs recording on the medium M, the medium M supplied from the medium accommodating portion 16 shown in FIG. 1 goes to the recording portion 20 through the transport path 19. Then, the liquid ejecting head 21 ejects the liquid toward the medium M transported in the first transport direction Z1. As a result, characters, images, and the like are recorded on the medium M.

Since the cap 51*a* is in the open state during recording, evaporation of moisture from the humidifying fluid L1*a* from the humidifying chamber 55 is promoted more than during capping. Assuming that the environmental conditions such as temperature and humidity are the same, the higher the recording frequency and the longer the recording time, the greater the evaporation of moisture from the humidifying fluid L1*a*.

On the other hand, as shown in FIG. 4, during capping, the moisture that evaporates from the humidifying fluid L1*a* and passes through the first moisture permeable membrane 54 humidifies the waste liquid L2 absorbed by the absorber 53. Thereby, when the viscosity of the waste liquid L2 absorbed by the absorber 53 is high, the viscosity of the waste liquid L2 is adjusted by the moisture evaporated from the humidifying fluid L1*a*. The closed space SP can be humidified more efficiently by the moisture evaporated from the humidifying fluid L1*a* and the waste liquid L2 of having the adjusted viscosity. Even during capping, the moisture in the humidifying fluid L1*a* evaporates little by little.

As shown in FIG. 4, when the liquid ejecting head 21 does not eject the liquid, the cap unit 51 is in the capping state of contacting the nozzle surface 23 of the liquid ejecting head 21. That is, the cap unit 51 moves from the retreat position in the third direction D3 and is positioned at the maintenance position, and then the head unit 24 moves from the recording position in the first direction D1 and is positioned at the maintenance position. In this capping state, the cap 51*a* comes into contact with the nozzle surface 23 of the liquid ejecting head 21 to form the closed space SP where the nozzles 22 are open.

As shown in FIG. 4, the humidifying chamber 55 is filled with the humidifying fluid L1*a*. Moisture evaporated from the humidifying fluid L1*a* can pass through the first moisture permeable membrane 54 and the absorber 53 together with the moist air containing the moisture, and humidifies the inside of the closed space SP. Therefore, the openings 22*a* of the nozzles 22 can be humidified. Then, since the thickening of the liquid in the nozzles 22 is suppressed, the occurrence of ejection failure can be prevented.

Further, the liquid ejecting apparatus 11 regularly performs flushing, which is an ejection operation for discharging droplets unrelated to printing from the nozzles 22 to the closed space SP in the cap 51*a*. As shown in FIG. 4, even during flushing, a state where the cap 51*a* is in contact with the nozzle surface 23 of the liquid ejecting head 21 to surround the nozzles 22 is maintained. Further, the liquid ejecting apparatus 11 cleans the liquid ejecting head 21 when the cleaning has to be performed and when a cleaning instruction is received by the user using the operation portion 15.

When flushing or cleaning is performed, the liquid discharged from the nozzles 22 of the liquid ejecting head 21 adheres to the nozzle surface 23. Therefore, after flushing and cleaning, the liquid ejecting apparatus 11 performs wiping. As shown in FIG. 3, in a state in which the head unit 24 is in the maintenance position, the wiper carriage 41 moves from the retreat position in the fifth direction D5 and moves to the folding position, and the nozzle surface 23 is wiped by the wiper member 42, accordingly. Thereby, dirt such as liquid, dust, or the like adhering to the nozzle surface 23 of the liquid ejecting head 21 is removed.

The waste liquid L2 discharged from the nozzles 22 into the cap 51*a* by flushing or cleaning is recovered in the waste liquid accommodating portion 86 in the waste liquid box 110. That is, as shown in FIG. 5, the waste liquid recovery mechanism 80 recovers, by the third pump 82, the waste liquid L2 discharged into the cap 51*a* by flushing or cleaning, in the waste liquid accommodating portion 86 in the waste liquid box 110 through the first waste liquid flow path 81*a*. At the time of recovering the waste liquid L2, the fourth pump 84 lowers the air pressure in the buffer chamber 83, and the waste liquid L2 in the cap 51*a* easily flows into the buffer chamber 83, accordingly, and thus the waste liquid L2 is difficult to remain in the cap 51*a*. Further, the waste liquid L2 recovered from the nozzle surface 23 into the wiper carriage 41 by wiping is also recovered in the waste liquid accommodating portion 86 in the waste liquid box 110 through the second waste liquid flow path 81*b*. Since the first moisture permeable membrane 54 in the cap 51*a* does not allow the liquid to pass, the waste liquid L2 does not flow into the humidifying chamber 55 during flushing or cleaning.

During non-recording, the state switches to the capping state shown in FIG. 4, and the closed space SP where the nozzles 22 are open is humidified by the moisture contained in the humidifying fluid L1*a* filled in the humidifying chamber 55. Thereby, the amount of moisture contained in the humidifying fluid L1*a* filled in the humidifying chamber 55 is reduced. As a result, the concentration of the humidifying fluid L1*a* filled in the humidifying chamber 55 is higher than the concentration of the humidifying fluid L1*a* in the humidifying fluid accommodating portion 61.

As shown in FIG. 19, the first pump 63 is regularly driven to perform the circulation operation. That is, the humidifying fluid L1*a* is circulated in the circulation path 62 in a circulation direction indicated by a solid arrow in FIG. 19. By the circulation operation, the amount of moisture contained in the humidifying fluid L1*a* filled in the humidifying chamber 55, that is, the moisture concentration of the humidifying fluid L1*a* can be returned to an appropriate concentration. The controller 90 manages the time by a timer or the like, and regularly executes the circulation operation. Thereby, the concentration of the humidifying fluid L1*a* in the entire circulation path 62 can be made uniform at an appropriate timing. Thereby, the occurrence of ejection failure by insufficient humidification of the openings of the nozzles 22 can be prevented.

When the seal portion 56*c* of the cap 51*a* has a reduced sealing property due to deterioration or fatigue due to long-term use, or when it is damaged or malfunctions for some reason, the seal portion 56*c* is replaced with a new one for each cap unit 51 or for each cap 51*a*. Prior to the cap replacement, the cap replacement preparation operation is performed. By supplying pressurized air into the cap 51*a* from the pressurized air supply portion 67, the humidifying fluid L1*a* in the cap 51*a* is pushed out and recovered in the humidifying fluid accommodating portion 61. Therefore, the weight loss of the humidifying fluid L1*a* due to the cap replacement is kept to a minimum.

After the cap replacement preparation operation is completed, the cap unit 51 or the cap 51*a* is replaced with a new one. After the replacement, the above-mentioned circulation operation is executed, and the humidifying chamber 55 in the new cap 51*a* is filled with the humidifying fluid L1*a*. Thereby, the closed space SP surrounding the openings of the nozzles 22 when the replaced cap 51*a* comes into contact with the liquid ejecting head 21 is humidified, and thus ejection failures due to thickening of the liquid in the nozzles 22 or the like are prevented.

The volume of the humidifying fluid L1*a* accommodated in the humidifying fluid accommodating portion 61 is reduced by the amount of the evaporated moisture by the capping device 50 humidifying the closed space SP with the moisture contained in the humidifying fluid L1*a* filled in the humidifying chamber 55, and periodically performing the circulation operation.

In the circulation operation, when it is detected by the detecting portion 61*a* that the height of the liquid surface in the humidifying fluid accommodating portion 61 is lower than the first predetermined height H1, it is determined that the concentration of the humidifying fluid L1*a* in the circulation path 62 is higher than the predetermined concentration, and the concentration adjustment operation procedure shown in FIG. 18 is executed.

Next, the concentration adjustment operation procedure executed by the controller 90 will be described with reference to the flowchart shown in FIG. 18.

In step S201, the controller 90 determines whether or not the first on-off valve 66*c* is in the open state. When the first on-off valve 66*c* is in the open state, the flow proceeds to step S203. When the first on-off valve 66*c* is in the closed state, the flow proceeds to step S202, and in step S202, the controller 90 opens the first on-off valve 66*c*.

In step S203, the controller 90 drives the first pump 63 for a third predetermined time T3 in a state where the first on-off valve 66*c* is open. Thereby, as shown in FIG. 19, the humidifying fluid L1*a* flows in the circulation path 62 in the direction of the solid arrow shown in FIG. 19. Then, the adjusting water L1*b* flows in the adjusting water supply flow path 66*b* in the direction of the arrow shown by the broken line shown in FIG. 19, and merges with the humidifying fluid L1*a* at the first merging portion 62*c*. Then, the merged humidifying fluid L1*a* and the adjusting water L1*b* become the humidifying fluid L1*a* with the adjusted concentration, which flows from the first merging portion 62*c* toward the cap 51*a*, flows in the circulation path 62 in the direction of the solid arrow shown in FIG. 19, and flows into the humidifying fluid accommodating portion 61. Then, the liquid surface in the humidifying fluid accommodating portion 61 becomes higher than the liquid surface before the start of the concentration adjustment operation.

In step S204, the controller 90 acquires information on the height of the liquid surface in the humidifying fluid accommodating portion 61 from the detecting portion 61*a*. Then, in step S205, the controller 90 determines whether or not the height of the liquid surface is higher than the first predetermined height H1. When the height of the liquid surface is higher than the first predetermined height H1, the flow proceeds to step S206. When the height of the liquid surface is lower than the first predetermined height H1, the procedure proceeds to step S207.

In step S206, the controller 90 closes the first on-off valve 66*c* and shifts the procedure to a subroutine of the circulation operation shown in FIG. 17 in step S100. When the controller 90 ends the subroutine of the circulation operation, the controller 90 ends the procedure.

As shown in FIG. 19, when the detecting portion 61*a* detects that the liquid surface in the humidifying fluid accommodating portion 61 is below the first predetermined height H1, the concentration adjustment operation shown in FIG. 18 is performed. In this case, the capping device 50 supplies the adjusting water L1*b* in the adjusting water accommodating portion 66*a* into the circulation path 62 until it is detected that the liquid surface reaches the first predetermined height H1 or higher, with the third predetermined time as an upper limit. Then, after the concentration adjustment operation is performed, the circulation operation shown in FIG. 17 is performed again such that the capping device 50 causes the humidifying fluid L1*a* to flow in the circulation path 62. Thereby, after the evaporated moisture is replenished to the humidifying fluid L1*a*, the humidifying fluid L1*a* is agitated, which makes it possible to make uniform the concentration of the humidifying fluid L1*a* in the entire circulation path 62.

When the controller 90 determines in step S207 that the adjusting water L1*b* in the adjusting water accommodating portion 66*a* is exhausted, in step S208, the controller 90 executes an operation before replacing the adjusting water accommodating portion. That is, when the amount of the adjusting water L1*b* in the adjusting water accommodating portion 66*a* reaches the amount at which it is determined that the adjusting water accommodating portion 66*a* is required to be replaced, the capping device 50 executes the operation before replacing the adjusting water accommodating portion. When the controller 90 ends the operation before replacing the adjusting water accommodating portion, the procedure proceeds to step S209.

In steps S203 to S205, the controller 90 may drive the first pump 63 while acquiring information on the height of the liquid surface in the humidifying fluid accommodating portion 61 from the detecting portion 61*a* in a state where the first on-off valve 66*c* is open, and may stop the first pump 63 when the height of the liquid surface is higher than the first predetermined height H1. Then, when the third predetermined time T3 elapses after driving the first pump 63, in step S207, the controller 90 may determine that the adjusting water L1*b* in the adjusting water accommodating portion 66*a* is exhausted when it is detected by the detecting portion 61*a* that the height of the liquid surface is lower than the first predetermined height H1.

In step S209, the controller 90 causes the display 15*a* of the operation portion 15 to display the information indicating that the adjusting water L1*b* in the adjusting water accommodating portion 66*a* has disappeared, such that an error is reported that the adjusting water L1*b* in the adjusting water accommodating portion 66*a* is exhausted. The user receiving the error report replaces the adjusting water accommodating portion 66*a*.

However, in the present embodiment, the accommodation amount of the adjusting water L1*b* accommodated in the adjusting water accommodating portion 66*a* is set such that the waste liquid accommodating portion 86 is first fully filled with the waste liquid L2 before the timing when the adjusting water L1*b* accommodated in the adjusting water accommodating portion 66*a* is exhausted (end liquid surface level). Therefore, the above error report does not occur in the normal usage.

In the present embodiment, the setting is made such that the waste liquid accommodating portion 86 is fully filled with the waste liquid L2 and the replacement of the waste liquid box 110 is promoted before it is determined that the adjusting water in the adjusting water accommodating portion 66*a* is exhausted. That is, in order to satisfy such a condition, the amount of the adjusting water before use accommodated in the adjusting water accommodating portion 66*a* and the capacity of the waste liquid accommodating portion 86 to be fully filled with the waste liquid L2 are set. The amount of decrease in moisture per unit time (that is, adjusting water decrease rate V1) (milliliter/day) from the humidifying fluid L1*a* is estimated based on the maximum recording frequency, the longest total recording time expected in normal use, and the like. In addition, the maximum amount of waste liquid generated per unit time (that is, waste liquid generation rate V2) (milliliter/day) that is assumed based on the frequency of flushing, cleaning, and wiping and the amount of liquid consumed per unit time (waste liquid amount) is estimated. Assuming that a waste liquid capacity is F (milliliter), time T (day) until the waste liquid accommodating portion 86 is fully filled with the waste liquid L2 is calculated by $T=F/V2$. Further, a remaining amount R of the adjusting water L1*b* after the lapse of the time T from the start of use of the adjusting water accommodating portion 66*a* is calculated by the formula $R=G-V1*T$, where G is an initial amount of the adjusting water L1*b* accommodated.

Therefore, the initial accommodation amount G by the adjusting water accommodating portion 66*a* is set so as to satisfy $R=G-V1*F/V2>0$. That is, the initial accommodation amount G by the adjusting water accommodating portion 66*a* is set to a larger amount than $V1*F/V2$. For example, assuming that a margin amount is a, the initial accommodation amount G by the adjusting water accommodating portion 66*a* is set to $G=V1*F/V2+\alpha$. According to such a setting, the adjusting water L1*b* remains in the adjusting water accommodating portion 66*a* when the waste liquid accommodating portion 86 is fully filled with the waste liquid L2, even if the cleaning frequency or the like is slightly higher than the normal frequency.

For example, the above error will be reported only in the case of abnormal use, such as when the cleaning frequency or the like is excessively higher than the normal frequency, or when the liquid ejecting apparatus 11 is emergency stopped and the cap 51*a* is left open for a long time and a weight loss rate of the adjusting water L1*b* is excessively high.

The controller 90 ends the concentration adjustment operation procedure when the circulation operation of step S100 (FIG. 17), which is executed after the replenishment of the adjusting water is completed (S206), is completed, or when an error is reported in step S209.

As described above, in a normal case, the waste liquid accommodating portion 86 is fully filled with the waste liquid L2 before the adjusting water L1*b* of the adjusting water accommodating portion 66*a* is exhausted. When the controller 90 detects that the waste liquid accommodating portion 86 is fully filled with the waste liquid L2, the controller 90 causes the display 15*a* to display information indicating that the waste liquid box 110 is fully filled with waste liquid and a message promoting the replacement of the waste liquid box 110. The user who sees the message replaces the waste liquid box 110 with a new one. That is, the user pulls out the waste liquid box 110 that is fully filled with the waste liquid L2 in a direction opposite to the mounting direction A, and removes the waste liquid box 110 from the mounting portion 100. Next, the user pushes the new waste liquid box 110 into the mounting direction A to mount it on the mounting portion 100.

The controller 90 detects that the new waste liquid box 110 is mounted through the electrical coupling between the board coupling portion 105 and the coupling terminal 117A of the circuit board 117. Then, the controller 90 executes a circulation operation (FIG. 17) and a concentration adjustment operation (FIG. 18). When the waste liquid box 110 is replaced, the concentration adjustment operation (FIG. 18) may be executed first without performing the circulation operation.

As described above, the capping device 50 includes the cap 51*a* having the humidifying chamber 55 and the first moisture permeable membrane 54, and with one cap 51*a*, the liquid discharged from the nozzles 22 can be received and the nozzles 22 can be humidified. Then, agitation and concentration of the humidifying fluid L1*a* can be optimized by circulating the humidifying fluid L1*a* in the circulation path 62 while replenishing moisture to the humidifying fluid L1*a* by the evaporated amount. Therefore, the humidifying fluid L1*a* in the entire circulation path 62 can be maintained in the state suitable for humidifying the nozzles 22 of the liquid ejecting head 21. When the humidifying fluid L1*a* of the humidifying fluid accommodating portion 61 is insufficient, the adjusting water L1*b* is replenished from the adjusting water accommodating portion 66*a*. Then, the adjusting water accommodating portion 66*a* is integrally incorporated in the waste liquid box 110, and is replaced with a new one together with the waste liquid accommodating portion 86 when the waste liquid box 110 is fully filled with the waste liquid L2 and replaced with a new one. The user can only replace the waste liquid box 110 with little awareness of the replaceable adjusting water accommodating portion 66*a*. Therefore, even if the adjusting water accommodating portion 66*a* accommodating the adjusting water L1*b* is configured to be replaceable, the number of boxes and cartridges to be replaced does not increase, and the replacement work hardly increases.

The effect of the present embodiment will be described.

(1) The waste liquid box 110 is detachably mounted on the mounting portion 100 having the waste liquid flow-out portion 103, which is an example of a discharge portion for discharging the waste liquid L2, and the liquid flow-in portion 104. The waste liquid box 110 includes the waste liquid flow-in portion 115 that is coupled to the waste liquid flow-out portion 103 when the waste liquid box is mounted on the mounting portion 100, and a waste liquid accommodating portion 86 in which the waste liquid L2 discharged from the waste liquid flow-out portion 103 is accommodatable. Further, the waste liquid box 110 includes the liquid flow-out portion 116 that is coupled to the liquid flow-in portion 104 when the waste liquid box 110 is mounted on the mounting portion 100, and the adjusting water accommodating portion 66*a*, which is an example of the liquid accommodating portion that accommodates the adjusting water L1*b*, which is an example of the liquid flowing out to the liquid flow-in portion 104. The adjusting water L1*b* is a liquid containing water for humidifying the cap 51*a* as an example of the humidified portion.

With the aforementioned configuration, the waste liquid box 110 including the waste liquid accommodating portion 86 is provided with the adjusting water accommodating portion 66*a* for accommodating the adjusting water L1*b* containing humidifying water, and thus in addition to the waste liquid box 110 in which the waste liquid L2 is accommodated, it is not necessary to separately provide a liquid accommodating body such as a humidifying box or a cartridge in which the humidifying liquid is accommodated. Further, the user does not have to purchase and spend more time and effort to replace an extra adjusting water box as a consumable item other than the liquid supply source 31 that accommodates the ink required for printing.

(2) The adjusting water L1*b* is a liquid containing water and a preservative. With the aforementioned configuration, the adjusting water L1*b* containing humidifying water can be used for a long period of time.

(3) The amount of the adjusting water L1*b* accommodated in the adjusting water accommodating portion 66*a* is set to an amount of liquid at which the waste liquid accommodating portion 86 is fully filled with the waste liquid L2 before the adjusting water L1*b* accommodated in the adjusting water accommodating portion 66*a* is exhausted. With the aforementioned configuration, the first exhaustion of the adjusting water L1*b* containing the humidifying water can be suppressed.

(4) The first cover 112 that covers the waste liquid accommodating portion 86 is provided. The waste liquid accommodating portion 86 accommodates the absorbing member 120 capable of absorbing the waste liquid L2. In the posture in which the waste liquid box 110 is mounted on the mounting portion 100, the upper surfaces of the absorbing members 120 are covered with the first cover 112. With the aforementioned configuration, leakage of the waste liquid L2 absorbed by the absorbing member 120 to the outside can be suppressed.

(5) The adjusting water accommodating portion 66*a* is the adjusting water pack 68 which is an example of a bag body for accommodating the adjusting water L1*b*. With the aforementioned configuration, the adjusting water accommodating portion 66*a* can be easily provided.

(6) The second cover 113 that covers the adjusting water accommodating portion 66*a* is provided. In the posture in which the waste liquid box 110 is mounted on the mounting portion 100, the lower surface of the adjusting water accommodating portion 66*a* is covered with the second cover 113. With the aforementioned configuration, the adjusting water L1*b* does not leak due to the adjusting water pack 68, and thus the configuration in which the lower surface is covered can be achieved. For this reason, the waste liquid accommodating portion 86 and the adjusting water accommodating portion 66*a* can be easily divided and accommodated in the waste liquid box 110 in a state where the liquid does not easily leak.

(7) The mounting portion 100 has the board coupling portion 105. The waste liquid box 110 includes the circuit board 117 having the coupling terminal 117A that is electrically coupled to the board coupling portion 105 when the waste liquid box 110 is mounted on the mounting portion 100. In the posture in which the waste liquid box 110 is mounted on the mounting portion 100, the coupling terminal 117A of the circuit board 117 is provided at a position higher than the center of the waste liquid flow-in portion 115. With the aforementioned configuration, adhering of the waste liquid L2 to the coupling terminal 117A can be suppressed.

(8) When the direction in which the waste liquid box 110 is mounted on the mounting portion 100 is defined as the mounting direction A, the waste liquid flow-in portion 115 is provided on one side and the circuit board 117 is provided on the other side in the width direction W intersecting the mounting direction A. With the aforementioned configuration, adhering of the waste liquid L2 to the coupling terminal 117A can be suppressed.

(9) The liquid flow-out portion 116 is provided between the waste liquid flow-in portion 115 and the circuit board 117 in the width direction W, and is provided at a position lower than the circuit board 117 in the vertical direction Z. With the aforementioned configuration, adhering of the liquid, such as the waste liquid L2 and the adjusting water L1*b*, to the coupling terminal 117A can be suppressed.

(10) The liquid ejecting apparatus 11 includes the liquid ejecting head 21, which is an example of the liquid ejecting portion that ejects, from the nozzles 22, a liquid (for example, ink) supplied from the liquid supply source 31, and the cap 51*a* capable of contacting the liquid ejecting head 21 to form the closed space SP where the nozzles 22 are open. Further, the liquid ejecting apparatus 11 includes the mounting portion 100 on which the waste liquid box 110 is detachably mounted, the supply flow path 62*a* through which the liquid flow-in portion 104 and the cap 51*a* communicate with each other, and the first pump 63, which is an example of the first liquid feeding portion that feeds the adjusting water L1*b* in the waste liquid box 110 to the cap 51*a*. With the aforementioned configuration, the adjusting water L1*b* containing water can be used for humidifying the nozzles 22.

(11) The liquid ejecting apparatus 11 includes the first waste liquid flow path 81*a* through which the cap 51*a* and the waste liquid flow-out portion 103 communicate with each other, and the third pump 82, which is an example of the second liquid feeding portion that feeds, to the waste liquid flow-out portion 103, the waste liquid L2 discharged from the liquid ejecting head 21 into the cap 51*a*. With the aforementioned configuration, the humidifying cap 51*a* can also be used as the cap 51*a* for receiving the waste liquid L2.

(12) By replenishing the cap 51*a* with the humidifying fluid L1*a*, the frequency of cleaning and the frequency of powerful cleaning can be reduced, and thus the capacity of the waste liquid accommodating portion 86 can be reduced. Therefore, the size of the waste liquid box 110 does not increase so much for the integrated accommodation of the adjusting water accommodating portion 66*a*. That is, a small waste liquid box 110 for integrally accommodating the adjusting water accommodating portion 66*a* can be provided.

Second Embodiment

Next, a second embodiment will be described with reference to FIGS. 20 and 21. In the embodiment, the cap in the first embodiment is divided into two types, a discharge cap and a moisturizing cap. The discharge cap is a cap dedicated to receiving the waste liquid discharged from the nozzles 22 of the liquid ejecting head 21 during maintenance, and the moisturizing cap is a cap dedicated to moisturizing the nozzles 22 for preventing clogging of the nozzles 22 of the liquid ejecting head 21 when the head is not used. In the present embodiment, the configuration is the same as that of the first embodiment except for the configuration in which the cap is divided into two types, the moisturizing cap and the discharge cap.

Figure 20:
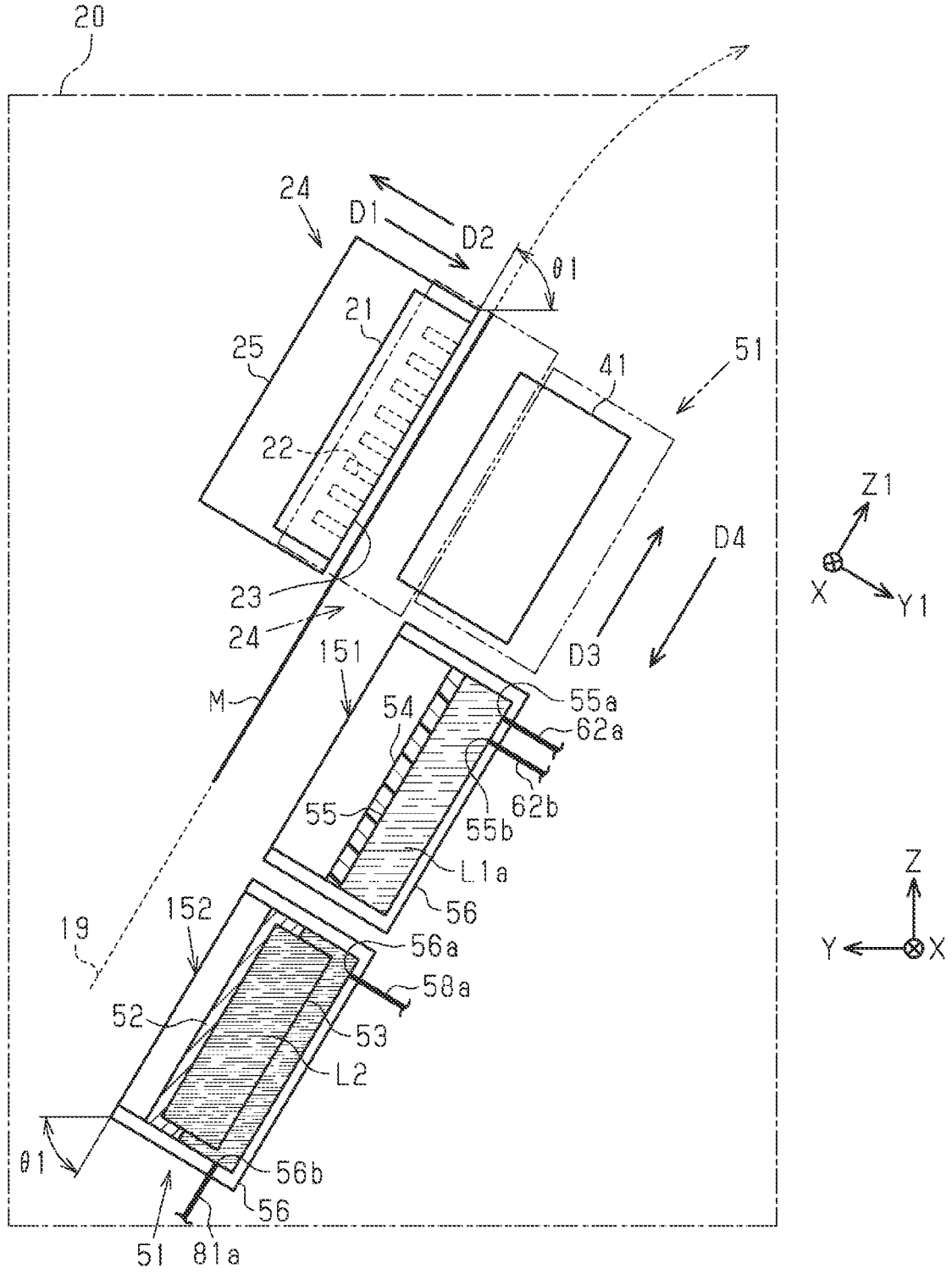
FIG. 20 is a schematic view showing the arrangement of components around a liquid ejecting head according to a modification example.

The liquid ejecting apparatus 11 includes the cap unit 51 shown in FIG. 20. The cap unit 51 includes a moisturizing cap 151 as an example of a humidified portion and a discharge cap 152. The moisturizing cap 151 and the discharge cap 152 are substantially the same in shape and size as the cap 51*a* of the first embodiment. The moisturizing cap 151 and the discharge cap 152 are integrally configured to be reciprocally movable in the first transport direction Z1, for example. For example, the moisturizing cap 151 and the discharge cap 152 can be fixed to the upper surface of a common slider (not shown), and can be disposed at a retreat position shown in FIG. 20 and a maintenance position indicated by a two-dot chain line in FIG. 20 by the slider reciprocally moving in the first transport direction Z1 by the power of a drive source (both not shown) through a power transmission mechanism. The moisturizing cap 151 and the discharge cap 152 may be individually movable.

During non-recording, the moisturizing cap 151 is disposed at a maintenance position facing the nozzle surface 23 of a liquid ejecting head 21. Further, during maintenance including cleaning and flushing, the discharge cap 152 is disposed at the maintenance position facing the nozzle surface 23 of the liquid ejecting head 21. In this state, the nozzle surface 23 of the liquid ejecting head 21 is capped by the moisturizing cap 151 or the discharge cap 152 by the liquid ejecting head 21 moving from a recording position indicated by a solid line in FIG. 20 to the maintenance position indicated by a two-dot chain line in FIG. 20. In the capping state, the moisturizing cap 151 or the discharge cap 152 comes into contact with the nozzle surface 23 of the liquid ejecting head 21 to form the closed space SP where the nozzles 22 are open. Specifically, the moisturizing cap 151 is configured to be able to contact the liquid ejecting head 21 to form the closed space SP where the nozzles 22 are open. Further, the discharge cap 152 is configured to be able to contact the liquid ejecting head 21 to form the closed space SP where the nozzles 22 are open.

As shown in FIG. 20, the humidifying chamber 55 and the first moisture permeable membrane 54 covering the humidifying chamber 55 are disposed on an inner bottom portion of the moisturizing cap 151. Therefore, in the state of being capped by the moisturizing cap 151, the closed space SP is humidified and the nozzles 22 is moisturized. As a result, clogging of the nozzle 22 due to thickening of the liquid in the nozzle 22 can be suppressed during non-recording or during power-off of the liquid ejecting apparatus 11.

Further, as shown in FIG. 20, the discharge cap 152 includes the absorber 53 and the restriction member 52 covering the absorber 53 in it. The restriction member 52 and the absorber 53 have the same functions as those provided in the cap 51*a* of the first embodiment. The moisturizing cap 151 may include one or both of the absorber 53 and the restriction member 52. In this case, the liquid dripping from the nozzle 22 can be absorbed by the absorber 53, and the restriction member 52 can suppress the lift and detachment of the absorber 53.

Figure 21:
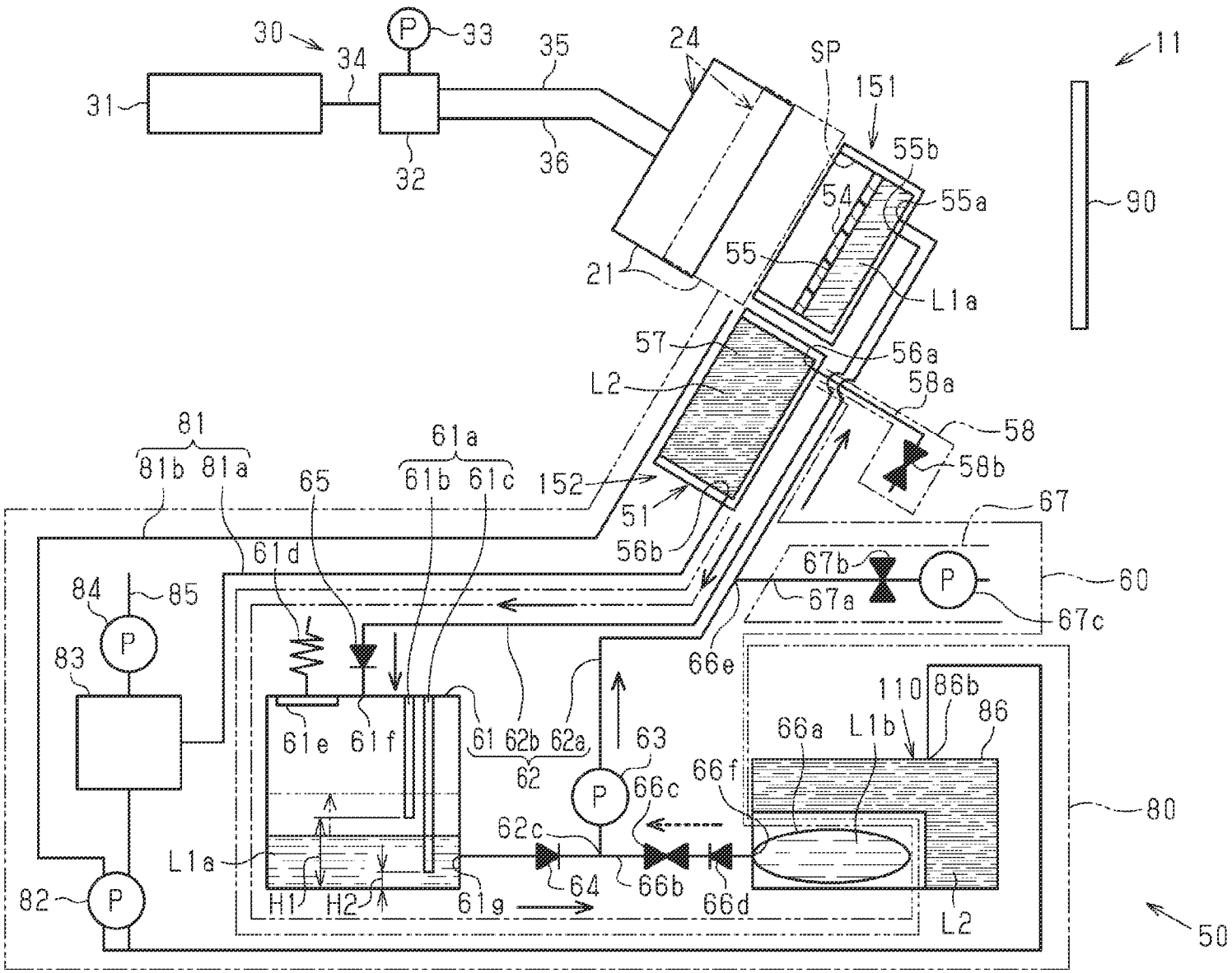
FIG. 21 is a schematic view showing a state of the humidifying fluid when the circulation operation and the concentration adjustment operation are executed.

As shown in FIGS. 20 and 21, the supply flow path 62*a* and the recovery flow path 62*b* are coupled to the humidifying chamber 55 of the moisturizing cap 151. Further, the first atmosphere communication passage 58*a* and the first waste liquid flow path 81*a* are coupled to the discharge cap 152.

As shown in FIG. 21, the humidifying chamber 55 of the moisturizing cap 151 is coupled to the humidifying fluid accommodating portion 61 through the supply flow path 62*a* and the recovery flow path 62*b* constituting the circulation path 62. The capping device 50 includes the supply flow path 62*a* through which the liquid flow-in portion 104 (see FIG. 6) and the moisturizing cap 151 communicate with each other, and the first pump 63, which is an example of the first liquid feeding portion that feeds, to the cap 51*a*, the adjusting water L1*b* which is the liquid in the adjusting water accommodating portion 66*a* which is an example of the liquid accommodating portion.

During non-recording, the moisturizing cap 151 is disposed at the maintenance position shown in FIG. 21, and the head unit 24 is disposed at the maintenance position shown by the two-dot chain line in FIGS. 20 and 21. As a result, the liquid ejecting head 21 is capped by the moisturizing cap 151. In the capping state, the closed space SP where the nozzles 22 are open is formed. The closed space SP is humidified by the steam of water contained in the humidifying fluid L1*a* from the humidifying chamber 55, whereby the nozzles 22 are moisturized.

The circulation operation of circulating the humidifying fluid L1*a* is performed at a predetermined timing, and thus the concentration of the humidifying fluid L1*a* in the humidifying chamber 55 is optimized. Further, when the humidifying fluid L1*a* in the humidifying fluid accommodating portion 61 is insufficient due to the weight loss by the evaporation of moisture, the first pump 63 is driven under the state where the first on-off valve 66*c* is opened. As a result, the adjusting water L1*b* is replenished from the adjusting water accommodating portion 66*a* in the waste liquid box 110 into the humidifying fluid accommodating portion 61 through the adjusting water supply flow path 66*b* and the circulation path 62. Therefore, the humidifying fluid L1*a* having an optimized concentration is supplied to the humidifying chamber 55. Accordingly, in the capping state of the moisturizing cap 151, the nozzles 22 that open in the closed space SP are appropriately moisturized.

Further, as shown in FIG. 21, the capping device 50 includes the first waste liquid flow path 81*a* communicating between the waste liquid flow-out portion 103 (see FIG. 6) and the discharge cap 152, which is an example of the discharge portion of the mounting portion 100, and the third pump 82 which is an example of the second liquid feeding portion that feeds, to the waste liquid flow-out portion 103, the waste liquid L2 discharged from the liquid ejecting head 21 into the discharge cap 152.

During flushing and cleaning, the discharge cap 152 is disposed at the maintenance position, and the head unit 24 moves from the recording position indicated by the solid line in FIGS. 20 and 21 to the maintenance position indicated by the two-dot chain line in the figure. As a result, the liquid ejecting head 21 is capped by the discharge cap 152. In the capping state, the closed space SP where the nozzles 22 are open is formed. The liquid ejected or discharged from the nozzles 22 of the liquid ejecting head 21 is received by the discharge cap 152 as the waste liquid L2. By driving the third pump 82, the waste liquid L2 is recovered from the discharge cap 152 to the waste liquid accommodating portion 86 in the waste liquid box 110 through the inlet portion 86*b*.

According to the second embodiment, the effects (1) to (12) of the first embodiment can be obtained in the same manner, and the following effects can be obtained.

(13) The liquid ejecting apparatus 11 includes a discharge cap 152 capable of contacting the liquid ejecting head 21 to form the closed space SP where the nozzles 22 are open, the first waste liquid flow path 81*a* communicating the discharge cap 152 and the waste liquid flow-out portion 103, and the third pump 82, which is an example of the second liquid feeding portion, which feeds, to the waste liquid flow-out portion 103, the waste liquid L2 discharged from the liquid ejecting head 21 into the discharge cap 152. With the aforementioned configuration, the moisturizing cap 151 for humidification and the discharge cap 152 for receiving the waste liquid L2 are independently provided, and thus a configuration suitable for each function can be employed.

The present embodiment can be implemented with modifications as follows. The present embodiment and the following modification examples can be implemented in combination with each other unless there is a technical contradiction.

The adjusting water L1*b* is referred to as a liquid containing water and a preservative, but it does not have to contain a preservative. For example, the adjusting water L1*b* may be a liquid containing water and other additives other than the preservative. Further, the adjusting water L1*b* may be a liquid containing only water.

The waste liquid L2 is a waste ink composed of ink discharged from the nozzles 22 by the liquid ejecting head 21 for maintenance, but may be a waste liquid other than the ink. For example, it may be a pretreatment liquid or a posttreatment liquid ejected from the nozzles 22 of the liquid ejecting head 21 toward the medium M. Further, the waste liquid L2 may be a cleaning solution for cleaning the nozzles 22 of the liquid ejecting head 21. The cleaning solution is a liquid sprayed onto the nozzle surface 23 of the liquid ejecting head 21 with a cleaning nozzle or the like to dissolve ink. As described above, the waste liquid L2 may be any liquid generated as a result of maintenance of the liquid ejecting head 21. Further, the cleaning solution used for cleaning may be accommodated as the waste liquid L2 in the waste liquid accommodating portion 86 of the waste liquid box 110. Further, the liquid accommodating body may include both a waste liquid accommodating portion accommodating the waste liquid of the ink and a waste liquid accommodating portion accommodating the waste liquid of the cleaning solution. Then, such a waste liquid accommodating body may include the liquid accommodating portion accommodating the liquid (for example, adjusting water L1*b*) containing water for humidification.

The liquid accommodating portion may be a tank chamber provided in the liquid accommodating body instead of a liquid pack such as the adjusting water pack 68. For example, the adjusting water tank chamber is provided, and ventilation holes are provided to communicate the inside of the chamber with the atmosphere. For example, by providing the moisture permeable membrane in the ventilation holes, leakage of the adjusting water from the ventilation holes may be prevented.

The adjusting water accommodating portion 66*a* has been described as an example of the liquid accommodating portion, but the liquid accommodating portion accommodated together with the waste liquid accommodating portion 86 in the waste liquid box 110 as an example of the liquid accommodating body is not limited to the adjusting water adjusting the concentration of the humidifying fluid L1*a* that humidifies the liquid ejecting head 21. For example, the liquid may be a replenishing humidifying fluid that replenishes the humidifying fluid L1*a* to the humidifying fluid accommodating portion 61. For example, a configuration may be possible in which, when the waste liquid box is replaced, the liquid accommodating portion is also replaced and the humidifying fluid L1*a* is replenished from the new liquid accommodating portion to the humidifying fluid accommodating portion 61.

A plurality of liquid accommodating portions may be accommodated in the waste liquid box 110, which is an example of the liquid accommodating body. In this case, the plurality of liquid accommodating portions may accommodate the same type of liquid or may accommodate different types of liquid. In this case, the liquid may be a liquid containing water for humidification.

A configuration may be possible in which, in the posture when the waste liquid box 110 is mounted on the mounting portion 100, the adjusting water accommodating portion 66*a*, which is an example of the liquid accommodating portion, is disposed on the upper side of the waste liquid box 110, and the waste liquid accommodating portion 86 is disposed on the lower side of the waste liquid box 110. Further, a configuration may be possible in which the adjusting water accommodating portion 66*a* and the waste liquid accommodating portion 86 may be disposed side by side in the horizontal direction in the waste liquid box 110 in the posture when the mounting portion 100 is mounted. With the aforementioned configuration, thinness of the waste liquid box 110 can be achieved. As described above, the layout of the adjusting water accommodating portion 66*a* and the waste liquid accommodating portion 86 in the waste liquid box 110 may be optionally set.

The adjusting water L1*b* is not limited to a liquid having a function of adjusting the concentration of the humidifying fluid L1*a*, and may be adjusting water that adjusts the components of the humidifying fluid L1*a*. For example, when the humidifying fluid L1*a* contains a component that evaporates or volatilizes with water, the adjusting water may contain the component.

The capping device 50 may have only one cap 51*a*, instead of the configuration in which a plurality of caps 51*a* are provided. For example, the head unit 24 may be provided with one cap. Further, one cap may be provided that is capable of contacting a plurality of unit ejecting heads 21*a* to form one closed space SP.

In the above embodiment, the flow path of the humidifying chamber 55 is formed in the labyrinthine shape of the single-way from the inlet 55*a* to the outlet 55*b*, but may be two-way or three-way. The flow path may be connected from the inlet 55*a* to the outlet 55*b*.

The arrangement of the unit ejecting heads 21*a* constituting the liquid ejecting head 21 can be changed as appropriate. The configuration is not limited to the configuration in which the unit ejecting heads 21*a* are arranged diagonally as in the above embodiment; for example, two rows in which the unit ejecting heads 21*a* are arranged at regular intervals in the width direction X are provided in a staggered arrangement in which the positions are shifted in the width direction by half the distance between the rows.

In the above embodiment, the adjusting water supply portion 66 capable of supplying the adjusting water L1*b* is provided in the supply flow path 62*a* in the circulation path 62; however, the adjusting water supply portion 66 may be provided in the recovery flow path 62*b* in the circulation path 62. In that case, the capping device 50 may further include a pump for supplying the adjusting water L1*b* to the recovery flow path 62*b*.

The capping device 50 may have a second detecting portion that detects the amount of the adjusting water L1*b* in the adjusting water accommodating portion 66*a*. Based on the detection result of the second detecting portion, the controller 90 may determine whether or not the amount of the adjusting water L1*b* in the adjusting water accommodating portion 66*a* reaches the amount required to replace the adjusting water accommodating portion 66*a*.

The waste liquid box 110 may be configured such that the adjusting water L1*b* in the adjusting water accommodating portion 66*a* can be replenished. Further, the capping device 50 may be configured such that the humidifying fluid accommodating portion 61 can be replaced.

The timing at which the circulation operation is executed may be changed by the administrator or the user.

The first predetermined time T1, the second predetermined time T2, the third predetermined time T3, and the fourth predetermined time T4 do not always have to be constant times. The values may be changed depending on the temperature and humidity environment. The values may also be changed by the administrator or user.

The humidified portion is not limited to caps such as the cap 51*a* and the moisturizing cap 151. For example, the humidified portion may be the medium accommodating portion 16 in which the medium M is accommodated. For example, the medium accommodating portion 16 may be humidified to moisturize the medium M. It is possible to suppress the variation in the curl of the medium M after recording due to the variation in the moisture contained in the medium M before recording by the change in the humidity in the main body 12 of the liquid ejecting apparatus 11.

The liquid ejecting apparatus may be an ink jet printing apparatus. The printing apparatus may include the mounting portion 100, and may accommodate both the waste liquid accommodating portion 86 and the adjusting water accommodating portion 66*a*, which is an example of the liquid accommodating portion, in the waste liquid box 110 as the liquid accommodating body mounted on the mounting portion.

The capping device 50 may be provided in the liquid ejecting apparatus that ejects the liquid from the liquid ejecting head 21 toward the medium M in the vertical direction. At the time of capping in the cap 51*a*, the seal portion 56*c* which is in close contact with the nozzle surface 23 of the liquid ejecting head 21, the absorber 53, the first moisture permeable membrane 54, and the humidifying chamber 55 may be provided in a horizontal state. That is, the cap 51*a* of the present embodiment may be provided in a horizontal state.

The capping device 50 may be provided in a liquid ejecting apparatus 11 which is a serial type ink jet printer for performing printing by ejecting a liquid toward the medium M by a liquid ejecting head supported by a carriage that moves reciprocally in the width direction X. When the reciprocating carriage moves from the ejection region where printing is performed on the medium M to the maintenance region outside the ejection region in the width direction X for maintenance, the cap of the capping device 50 disposed in the maintenance region may cap the nozzle surface of the liquid ejecting head. In that case, the capping device 50 may be configured such that, when the carriage moves to the maintenance region and the liquid ejecting head is positioned at the maintenance position, capping is performed by moving the cap toward the nozzle surface of the liquid ejecting head and bringing the cap into close contact with the nozzle surface. Then, the humidifying chamber 55 may be provided in the cap capable of contacting the nozzle surface of the liquid ejecting head to form the closed space where the nozzles are open during non-recording. Further, the capping device 50 includes the humidifying fluid circulation mechanism 60 that supplies the humidifying fluid L1*a* to the humidifying chamber 55. The humidifying fluid circulation mechanism 60 includes the mounting portion 100, the adjusting water accommodating portion 66*a* which is an example of a liquid accommodating portion, the waste liquid accommodating portion 86, and the like. Then, both the waste liquid accommodating portion 86 and the adjusting water accommodating portion 66*a* are accommodated in the waste liquid box 110, which is an example of the liquid accommodating body that is detachably mounted on the mounting portion 100. Thereby, even in the serial type liquid ejecting apparatus, it is not necessary to separately provide the adjusting water box (adjusting water cartridge) in addition to the waste liquid box 110. Further, the user does not have to purchase and spend more time and effort to replace an extra adjusting water box as a consumable item other than the liquid supply source 31 that accommodates the ink required for printing.

In the liquid ejecting apparatus, the adjusting water accommodating portion 66*a* may be eliminated, and instead, the humidifying fluid accommodating portion 61 may be provided in the waste liquid box 110. That is, by providing the humidifying fluid accommodating portion 61 in the waste liquid box 110, the humidifying fluid accommodating portion 61 may be attached to and detached from the mounting portion 100 together with the waste liquid accommodating portion 86.

Further, the waste liquid box 110 may be provided with three types of accommodating portions: the waste liquid accommodating portion 86, an adjusting water accommodating portion 66*a*, and a humidifying fluid accommodating portion 61.

The liquid ejecting apparatus 11 may be a liquid ejecting apparatus that ejects a liquid other than ink. The state of the liquid ejected as a minute amount of droplets from the liquid ejecting apparatus includes those having a granular, tear-like, or thread-like tail. The liquid referred to here may be any material that can be ejected from the liquid ejecting apparatus. For example, the liquid may be in the state when the substance is in the liquid phase, and the liquid includes fluids such as highly viscous or low viscous liquids, sol, gel water, other inorganic solvents, organic solvents, solutions, liquid resins, liquid metals, metal melts, and the like. The liquid includes not only a liquid as a state of a substance but also a liquid in which particles of a functional material made of a solid substance such as a pigment or a metal particle are dissolved, dispersed, or mixed in a solvent. Typical examples of the liquid include ink, liquid crystal, and the like as described in the above-described embodiment.

Hereinafter, the technical idea and the effect thereof figured out from the above-described embodiment and the modification examples will be described.

(A) A liquid accommodating body is detachably mounted on a mounting portion having a discharge portion for discharging a waste liquid and a liquid flow-in portion, the liquid accommodating body including a waste liquid flow-in portion that is coupled to the discharge portion when the liquid accommodating body is mounted on the mounting portion, a waste liquid accommodating portion configured to accommodate the waste liquid discharged from the discharge portion, and a liquid flow-out portion that is coupled to the liquid flow-in portion when the liquid accommodating body is mounted on the mounting portion, and a liquid accommodating portion configured to accommodate a liquid flowing out to the liquid flow-in portion, in which the liquid is a liquid containing water for humidifying a humidified portion.

With the aforementioned configuration, the liquid accommodating body including the waste liquid accommodating portion is provided with the liquid accommodating portion for accommodating the liquid containing the humidifying water, and thus it is not necessary to separately provide a liquid accommodating body for accommodating the humidifying liquid in addition to the liquid accommodating body for accommodating the waste liquid.

(B) In the liquid accommodating body, the liquid may be a liquid containing water and a preservative. With the aforementioned configuration, a liquid containing humidifying water can be used for a long period of time.

(C) In the liquid accommodating body, an amount of the liquid accommodated in the liquid accommodating portion may be set to a liquid amount at which the waste liquid accommodating portion is first fully filled with a waste liquid before the liquid accommodated in the liquid accommodating portion is exhausted.

With the aforementioned configuration, the first exhaustion of the liquid containing the humidifying water can be suppressed.

(D) The liquid accommodating body may further include a first cover that covers the waste liquid accommodating portion, the waste liquid accommodating portion may accommodate an absorbing member configured to absorb the waste liquid, and the absorbing member may be in a state in which an upper surface thereof is covered with the first cover in a posture in which the liquid accommodating body is mounted on the mounting portion.

With the aforementioned configuration, leakage of the waste liquid absorbed by the absorbing member to the outside can be suppressed.

(E) In the liquid accommodating body, the liquid accommodating portion may be a bag body that accommodates the liquid. With the aforementioned configuration, the liquid accommodating portion can be easily provided.

(F) The liquid accommodating body may further include a second cover that covers the liquid accommodating portion, and the liquid accommodating portion may be in a state in which a lower surface thereof is covered with the second cover in a posture in which the liquid accommodating body is mounted on the mounting portion.

With the aforementioned configuration, the liquid does not leak due to the bag body, and thus the configuration in which the lower surface is covered can be achieved. Therefore, the waste liquid accommodating portion and the liquid accommodating portion can be easily divided and accommodated in a state in which the liquid is less likely to leak into the liquid accommodating body.

(G) In the liquid accommodating body, the mounting portion may have a board coupling portion, the liquid accommodating body may further include a circuit board having a coupling terminal that is electrically coupled to the board coupling portion when the liquid accommodating body is mounted on the mounting portion, and the coupling terminal of the circuit board may be provided at a position higher than a center of the waste liquid flow-in portion in a posture in which the liquid accommodating body is mounted on the mounting portion.

With the aforementioned configuration, adhering of the waste liquid to the coupling terminal can be suppressed.

(H) In the liquid accommodating body, when a direction in which the liquid accommodating body is mounted on the mounting portion is defined as a mounting direction, the waste liquid flow-in portion may be provided on one side and the circuit board is provided on the other side in a width direction intersecting the mounting direction.

With the aforementioned configuration, adhering of the waste liquid to the coupling terminal can be suppressed.

(I) In the liquid accommodating body, the liquid flow-out portion may be provided between the waste liquid flow-in portion and the circuit board in the width direction, and is provided at a position lower than the circuit board in a vertical direction.

With the aforementioned configuration, adhering of the liquid to the coupling terminal can be suppressed.

(J) A liquid ejecting apparatus includes a liquid ejecting portion that ejects, from a nozzle, a liquid supplied from a liquid supply source, a cap configured, as a humidified portion, to contact the liquid ejecting portion to form a closed space where the nozzle is open, a mounting portion on which the liquid accommodating body is detachably mounted, a supply flow path through which the liquid flow-in portion and the cap communicate with each other, and a first liquid feeding portion that feeds the liquid in the liquid accommodating body to the cap.

With the aforementioned configuration, the liquid containing water can be used for humidifying nozzles.

(K) The liquid ejecting apparatus may further include a waste liquid flow path through which the cap and the discharge portion communicate with each other, and a second liquid feeding portion that feeds, to the discharge portion, the waste liquid discharged from the liquid ejecting portion into the cap.

With the aforementioned configuration, the humidifying cap can also be used as a cap for receiving the waste liquid.

(L) The liquid ejecting apparatus may further include a discharge cap configured to contact the liquid ejecting portion to form a closed space where the nozzle is open, a waste liquid flow path through which the discharge cap and the discharge portion communicate with each other, and a second liquid feeding portion that feeds, to the discharge portion, the waste liquid discharged from the liquid ejecting portion into the discharge cap.

With the aforementioned configuration, the humidifying cap and the cap for receiving the waste liquid are independently provided, and thus a configuration suitable for each function can be employed.

What is claimed is:

1. A liquid accommodating body that is detachably mounted on a mounting portion having a discharge portion for discharging a waste liquid and a liquid flow-in portion, the liquid accommodating body comprising:

a box main body;

a waste liquid flow-in portion that is coupled to the discharge portion when the liquid accommodating body is mounted on the mounting portion;

a waste liquid accommodating portion configured to accommodate the waste liquid discharged from the discharge portion; and a liquid flow-out portion that is coupled to the liquid flow-in portion when the liquid accommodating body is mounted on the mounting portion; and a liquid accommodating portion configured to accommodate a liquid flowing out to the liquid flow-in portion, wherein the liquid is a liquid containing water for humidifying a humidified portion, and the waste liquid accommodating portion and the liquid accommodating portion are included inside the box main body.

2. The liquid accommodating body according to claim 1, wherein the liquid includes a preservative.

3. The liquid accommodating body according to claim 1, wherein an amount of the liquid accommodated in the liquid accommodating portion is set to a liquid amount at which the waste liquid accommodating portion is first fully filled with a waste liquid before the liquid accommodated in the liquid accommodating portion is exhausted.

4. The liquid accommodating body according to claim 1, further comprising a first cover that covers the waste liquid accommodating portion, wherein the waste liquid accommodating portion accommodates an absorbing member configured to absorb the waste liquid, and the absorbing member is in a state in which an upper surface thereof is covered with the first cover in a posture in which the liquid accommodating body is mounted on the mounting portion.

5. The liquid accommodating body according to claim 1, wherein the liquid accommodating portion has a bag body that accommodates the liquid.

6. The liquid accommodating body according to claim 5, further comprising a second cover that covers the liquid accommodating portion, wherein the liquid accommodating portion is in a state in which a lower surface thereof is covered with the second cover in a posture in which the liquid accommodating body is mounted on the mounting portion.

7. The liquid accommodating body according to claim 1, wherein the mounting portion has a board coupling portion, the liquid accommodating body further comprises a circuit board having a coupling terminal that is electrically coupled to the board coupling portion when the liquid accommodating body is mounted on the mounting portion, and the coupling terminal of the circuit board is provided at a position higher than a center of the waste liquid flow-in portion in a posture in which the liquid accommodating body is mounted on the mounting portion.

8. The liquid accommodating body according to claim 7, wherein when a direction in which the liquid accommodating body is mounted on the mounting portion is defined as a mounting direction, the waste liquid flow-in portion is provided on one side and the circuit board is provided on the other side in a width direction intersecting the mounting direction.

9. The liquid accommodating body according to claim 8, wherein the liquid flow-out portion is provided between the waste liquid flow-in portion and the circuit board in the width direction, and is provided at a position lower than the circuit board in a vertical direction.

10. A liquid ejecting apparatus comprising:

a liquid ejecting portion that ejects, from a nozzle, a liquid supplied from a liquid supply source;

a cap configured, as a humidified portion, to contact the liquid ejecting portion to form a closed space where the nozzle is open;

the mounting portion on which the liquid accommodating body according to claim 1 is detachably mounted;

a supply flow path through which the liquid flow-in portion and the cap communicate with each other; and a first liquid feeding portion that feeds the liquid in the liquid accommodating body to the cap.

11. The liquid ejecting apparatus according to claim 10, further comprising:

a waste liquid flow path through which the cap and the discharge portion communicate with each other; and a second liquid feeding portion that feeds, to the discharge portion, the waste liquid discharged from the liquid ejecting portion into the cap.

12. The liquid ejecting apparatus according to claim 10, further comprising:

a discharge cap configured to contact the liquid ejecting portion to form a closed space where the nozzle is open;

a waste liquid flow path through which the discharge cap and the discharge portion communicate with each other; and a second liquid feeding portion that feeds, to the discharge portion, the waste liquid discharged from the liquid ejecting portion into the discharge cap.

* * * * *